US012168584B2

(12) United States Patent
Yamano et al.

(10) Patent No.: US 12,168,584 B2
(45) Date of Patent: Dec. 17, 2024

(54) SHEET CONVEYANCE APPARATUS, SHEET PROCESSING APPARATUS, AND IMAGE FORMING SYSTEM

(71) Applicant: CANON KABUSHIKI KAISHA, Tokyo (JP)

(72) Inventors: Hiroyuki Yamano, Shizuoka (JP); Jun Agata, Shizuoka (JP); Hiroharu Tsuji, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/985,201

(22) Filed: Nov. 11, 2022

(65) Prior Publication Data

US 2023/0075706 A1 Mar. 9, 2023

Related U.S. Application Data

(63) Continuation of application No. 17/097,090, filed on Nov. 13, 2020, now Pat. No. 11,518,638.

(30) Foreign Application Priority Data

Nov. 26, 2019 (JP) ..... 2019-213639
Aug. 27, 2020 (JP) ..... 2020-143775

(51) Int. Cl.
*B65H 29/60* (2006.01)
*B65H 31/10* (2006.01)
*B65H 37/04* (2006.01)

(52) U.S. Cl.
CPC ..... *B65H 29/60* (2013.01); *B65H 31/10* (2013.01); *B65H 37/04* (2013.01)

(58) Field of Classification Search
CPC .. B65H 2404/122; B65H 37/04; B65H 29/60; B65H 2404/65; B65H 2601/2525
See application file for complete search history.

(56) References Cited

U.S. PATENT DOCUMENTS 5,620,177 A 4/1997 Takemoto et al.
6,435,395 B1 8/2002 Miyaguchi et al.
(Continued)

FOREIGN PATENT DOCUMENTS

CA 2237537 A * 12/1998 ..... B26D 5/20
CA 2237537 A1 12/1998
(Continued)

OTHER PUBLICATIONS

European Search Report dated Apr. 20, 2021, in related European Patent Application No. 20208283.0.
(Continued)

*Primary Examiner* — Jennifer Bahls
(74) *Attorney, Agent, or Firm* — VENABLE LLP

(57) ABSTRACT

A sheet conveyance apparatus includes a controller controlling a driver to cause a guide to start rotation in a state in which a trailing end in a sheet conveyance direction of a preceding sheet conveyed by a roller pair having a first roller and a second roller such that the trailing end of the preceding sheet is moved from the position above a first guide to a position between a second guide and a sheet support by the rotation of the guide and that a succeeding sheet conveyed by the roller pair subsequently to the preceding sheet passes the position above the first guide after the rotation of the guide. The first roller is rotated by a driving force supplied from a driving source, and the guide rotates about a rotation axis of the first roller while rotating relatively to the first roller.

22 Claims, 26 Drawing Sheets

(56) References Cited

U.S. PATENT DOCUMENTS

| | | | | |
|---|---|---|---|---|
| 6,997,456 | B2 | 2/2006 | Fukatsu et al. | |
| 7,258,339 | B2 | 8/2007 | Fukatsu et al. | |
| 8,668,198 | B2 | 3/2014 | Tsuji et al. | |
| 8,840,104 | B2 | 9/2014 | Fujikake | |
| 8,998,201 | B2 | 4/2015 | Rademakers et al. | |
| 9,146,520 | B2 | 9/2015 | Fuse et al. | |
| 9,758,335 | B2 | 9/2017 | Taki | |
| 9,994,408 | B2 | 6/2018 | Terao | |
| 10,252,876 | B2 | 4/2019 | Taki | |
| 10,322,901 | B2 | 6/2019 | Terao | |
| 2006/0082047 | A1 | 4/2006 | Fukatsu et al. | |
| 2006/0239735 | A1 | 10/2006 | Ogata et al. | |
| 2008/0122165 | A1* | 5/2008 | Shirasaki | B65H 29/14 271/220 |
| 2010/0109228 | A1 | 5/2010 | Obara et al. | |
| 2010/0244361 | A1 | 9/2010 | Unnasch | |
| 2012/0038101 | A1 | 2/2012 | Osaki | |
| 2012/0286469 | A1* | 11/2012 | Sato | B65H 31/36 271/220 |
| 2016/0347568 | A1 | 12/2016 | Taki | |
| 2019/0300318 | A1 | 10/2019 | Ohashi et al. | |
| 2020/0379397 | A1 | 12/2020 | Agata et al. | |

FOREIGN PATENT DOCUMENTS

| | | | |
|---|---|---|---|
| CN | 106241472 | A | 12/2016 |
| EP | 2794441 | A1 | 10/2014 |
| JP | S60-251487 | A | 12/1985 |
| JP | H10-330025 | A | 12/1998 |
| JP | H11-199113 | A | 7/1999 |
| JP | 2000-247524 | A | 9/2000 |
| JP | 2004-059314 | A | 2/2004 |
| JP | 2008-257380 | A | 10/2008 |
| JP | 2008-297099 | A | 12/2008 |
| JP | 2010-195494 | A | 9/2010 |
| JP | 2015-504832 | A | 2/2015 |
| JP | 2016-216245 | A | 12/2016 |
| WO | 2013/092629 | A1 | 6/2013 |

OTHER PUBLICATIONS

Chinese Office Action dated Dec. 9, 2022, in related Chinese Patent Application No. 202011330820.9 (with English translation).

Japanese Office Action dated Jun. 11, 2023, in Japanese Patent Application No. 2020-143775.

* cited by examiner

SHEET CONVEYANCE APPARATUS, SHEET PROCESSING APPARATUS, AND IMAGE FORMING SYSTEM

This application is a continuation of application Ser. No. 17/097,090, filed Nov. 13, 2020.

BACKGROUND OF THE INVENTION

Field of the Invention

The present invention relates to a sheet processing apparatus that conveys a sheet, a sheet processing apparatus that processes a sheet, and an image forming system that forms an image on a sheet.

Description of the Related Art

A sheet processing apparatus used in an image forming system such as a multifunctional apparatus of an electrophotographic system includes a sheet conveyance apparatus that discharges and stacks sheets to be subjected to a process such as a binding process onto and on a processing tray. In addition, the image forming system includes a sheet processing apparatus that discharges and stacks sheets as a product onto and on a discharge tray. In the case of discharging sheets onto a supporting portion such as the processing tray or the discharge tray, if a newly discharged sheet collides with a sheet that is already supported thereon, the alignment of sheets may be disturbed or discharge failure may occur.

Japanese Patent Laid-Open No. 2010-195494 discloses a configuration in which a lever for pressing a trailing end portion of sheets stacked on a sheet discharge tray is provided and the lever is moved to a position above the uppermost sheet by swinging the lever by a solenoid device each time one sheet is discharged. Japanese Patent Laid-Open No. 2004-059314 discloses a configuration in which a pressing member that presses sheets stacked on an intermediate supporting portion and a guide member that guides the upper surface of a sheet to be discharged onto the intermediate supporting portion are caused to operate in a coordinated manner.

However, according to the configurations described in the respective documents, there is a case where the possibility of collision of the leading end of a newly discharged sheet with the trailing end of a sheet supported on a processing tray or a sheet discharge tray cannot be sufficiently reduced.

SUMMARY OF THE INVENTION

The present invention provides a sheet conveyance apparatus, a sheet processing apparatus, and an image forming system which can reduce the possibility of collision of sheets.

According to one aspect of the invention, a sheet conveyance apparatus includes a supporting portion configured to support a sheet, a conveyance member configured to convey the sheet toward the supporting portion in a sheet conveyance direction, a guide member rotatably provided above the supporting portion and including a first guide portion and a second guide portion, the first guide portion being configured to guide a lower surface of the sheet conveyed by the conveyance member, the second guide portion being configured to face the supporting portion, a driving portion configured to rotationally drive the guide member, and a controller configured to control the driving portion to cause the guide member to start a rotation in a state in which a trailing end in the sheet conveyance direction of a preceding sheet conveyed by the conveyance member is at a position above the first guide portion, such that the trailing end of the preceding sheet is moved from the position above the first guide portion to a position between the second guide portion and the supporting portion by the rotation of the guide member and that a succeeding sheet conveyed by the conveyance member subsequently to the preceding sheet passes the position above the first guide portion after the rotation of the guide member.

Further features of the present invention will become apparent from the following description of exemplary embodiments with reference to the attached drawings.

DESCRIPTION OF THE EMBODIMENTS

Exemplary embodiments of the present invention will be described below with reference to drawings.

First Exemplary Embodiment

Figure 1:
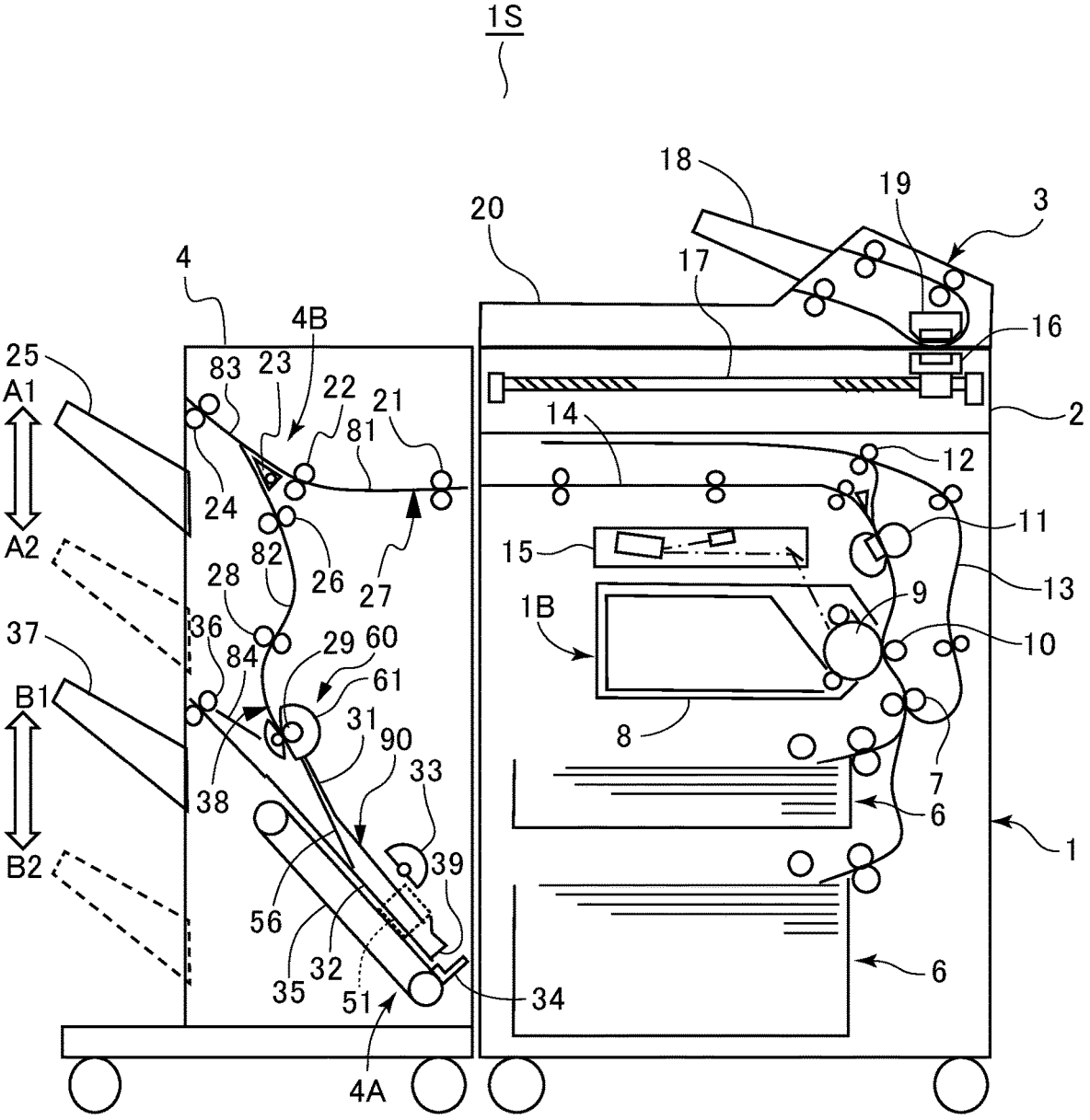
FIG. 1 is a schematic view of an image forming system according to a first exemplary embodiment.

FIG. 1 is a schematic view of an image forming system 1S according to a first exemplary embodiment. The image forming system 1S of the present exemplary embodiment includes an image forming apparatus 1, an image reading apparatus 2, a document feeding apparatus 3, and a post-processing apparatus 4. The image forming system 1S forms an image on a sheet serving as a recording material, and outputs the sheet after processing the sheet by the post-processing apparatus 4 if necessary. Hereinafter, simple description of the operation of each apparatus will be given, and then the post-processing apparatus 4 will be described in detail.

The document feeding apparatus 3 conveys a document placed on a document tray 18 to image reading portions 16 and 19. The image reading portions 16 and 19 are image sensors that read image information from respective document surfaces, and both surfaces of a document are read in one time of conveyance of the document. The document whose image information has been read is discharged onto a document discharge portion 20. In addition, the image reading apparatus 2 can read image information from a still document set on a platen glass, by reciprocating the image reading portion 16 by a driving device 17. Examples of the still document include documents such as booklet documents for which the document feeding apparatus 3 cannot be used.

The image forming apparatus 1 is an electrophotographic apparatus including an image forming portion 1B of a direct transfer system. The image forming portion 1B includes a cartridge 8 including a photosensitive drum 9, and a laser scanner unit 15 disposed above the cartridge 8. In the case of performing an image forming operation, the surface of the rotating photosensitive drum 9 is charged, and the laser scanner unit 15 draws an electrostatic latent image on the surface of the photosensitive drum 9 by exposing the photosensitive drum 9 on the basis of image information. The electrostatic latent image born on the photosensitive drum 9 is developed into a toner image by charged toner particles, and the toner image is transferred to a transfer portion where the photosensitive drum 9 and a transfer roller 10 face each other. The controller of the image forming apparatus 1, which is a printer controller 100 that will be described later, executes an image forming operation by the image forming portion 1B on the basis of image information read by the image reading portions 16 and 19 or image information received from an external computer via a network.

The image forming apparatus 1 includes a plurality of feeding apparatuses 6 that feed sheets serving as recording materials one by one at a predetermined interval. A sheet fed from a feeding apparatus 6 is conveyed to the transfer portion after the skew thereof is corrected by registration rollers 7, and in the transfer portion, the toner image born on the photosensitive drum 9 is transferred thereto. A fixing unit 11 is disposed downstream of the transfer portion in a conveyance direction of the sheet. The fixing unit 11 includes a rotary member pair that nips and conveys the sheet, and a heat generating member such as a halogen lamp for heating the toner image, and performs image fixing processing on the toner image on the sheet by heating and pressurizing the toner image.

In the case of discharging the sheet having undergone image formation to the outside of the image forming apparatus 1, the sheet having passed through the fixing unit 11 is conveyed to the post-processing apparatus 4 via a horizontal conveyance portion 14. In the case of a sheet image formation on a first surface of which is finished in duplex printing, the sheet having passed through the fixing unit 11 is passed onto reverse conveyance rollers 12, switched back and conveyed by the reverse conveyance rollers 12, and conveyed to the registration rollers 7 again via a reconveyance portion 13. Then, an image is formed on a second surface of the sheet as a result of the sheet passing through the transfer portion and the fixing unit 11 again, and then the sheet is conveyed to the post-processing apparatus 4 via the horizontal conveyance portion 14.

The image forming portion 1B described above is an example of an image forming portion that forms an image on a sheet, and an electrophotographic unit of an intermediate transfer system that transfers a toner image formed on a photosensitive member onto a sheet via an intermediate transfer member may be used therefor. In addition, a printing unit of an inkjet system or an offset printing system may be used as the image forming portion.

Post-Processing Apparatus

The post-processing apparatus 4 includes a binding processing portion 4A that performs a binding process on sheets received from the image forming apparatus 1, and discharges the sheets as a sheet bundle. In addition, the post-processing apparatus 4 is also capable of simply discharging a sheet received from the image forming apparatus 1 without performing a binding process thereon.

The post-processing apparatus 4 includes an entry path 81, an in-body discharge path 82, a first discharge path 83, and a second discharge path 84 as a conveyance path for conveying a sheet, and an upper discharge tray 25 and a lower discharge tray 37 are provided as discharge destinations onto which a sheet is discharged. The entry path 81 serves as a first conveyance path of the present exemplary embodiment through which a sheet is received from the image forming apparatus 1 and conveyed, and the in-body discharge path 82 serves as a second conveyance path of the present exemplary embodiment through which the sheet is conveyed toward the binding processing portion 4A. The first discharge path 83 is a conveyance path through which the sheet is discharged onto the upper discharge tray 25, and the second discharge path 84 is a conveyance path serving as a third conveyance path through which the sheet is discharged onto the lower discharge tray 37.

In the entry path 81, inlet rollers 21, pre-buffer rollers 22, and an entrance sensor 27 are disposed. In the first discharge path 83, the reverse conveyance rollers 24 serving as a reverse conveyance unit is disposed. In the in-body discharge path 82, in-body discharge rollers 26, intermediate conveyance rollers 28, kick-out rollers 29, and a pre-intermediate supporting sensor 38 are disposed. In the second discharge path 84, bundle discharge rollers 36 are disposed. The entrance sensor 27 and the pre-intermediate supporting sensor 38 each serve as an example of a sheet detection portion that detects passage of a sheet at a predetermined detection position in a conveyance path in a sheet processing apparatus. As the entrance sensor 27 and the pre-intermediate supporting sensor 38, optical sensors that detect presence/absence of a sheet at the detection position by using light as will be described later can be used.

A sheet conveyance path in the post-processing apparatus 4 will be described below. To be noted, a buffering operation by a buffering portion 4B including the reverse conveyance rollers 24, and the detailed configuration and operation of the binding processing portion 4A will be described later.

The sheet discharged from the horizontal conveyance portion 14 of the image forming apparatus 1 is received by the inlet rollers 21, and is conveyed toward the pre-buffer rollers 22 through the entry path 81. The entrance sensor 27 detects the sheet at a detection position between the inlet rollers 21 and the pre-buffer rollers 22. The pre-buffer rollers 22 convey the sheet received from the inlet rollers 21 toward the first discharge path 83.

To be noted, at a predetermined timing after the entrance sensor 27 has detected passage of a trailing end of the sheet, the sheet conveyance speed of the pre-buffer rollers 22 is increased to a speed higher than the conveyance speed in the horizontal conveyance portion 14. In addition, the sheet conveyance speed of the inlet rollers 21 may be set to be higher than that in the horizontal conveyance portion 14, and the conveyance speed may be increased by the inlet rollers 21 upstream of the pre-buffer rollers 22. In this case, it is preferable that a one-way clutch is disposed between a conveyance roller of the horizontal conveyance portion 14 and a motor that drives the conveyance roller such that the conveyance roller idles even when the sheet is pulled by the inlet rollers 21.

In the case where the discharge destination of the sheet is the upper discharge tray 25, the reverse conveyance rollers 24 discharge the sheet received from the pre-buffer rollers 22 onto the upper discharge tray 25. In this case, the reverse conveyance rollers 24 decelerate to a predetermined discharge speed at a predetermined timing after the trailing end of the sheet has passed through the pre-buffer rollers 22.

In the case where the discharge destination of the sheet is the lower discharge tray 37, the reverse conveyance rollers 24 switch back and convey the sheet received from the pre-buffer rollers 22 toward the in-body discharge path 82. A non-return flap 23 is provided at a branching portion upstream of the reverse conveyance rollers 24 in the sheet discharge direction of the reverse conveyance rollers 24 where the entry path 81 and the in-body discharge path 82 branch from the first discharge path 83. The non-return flap 23 has a function of suppressing backward movement of the sheet switched back by the reverse conveyance rollers 24 into the entry path 81.

The in-body discharge rollers 26, the intermediate conveyance rollers 28, and the kick-out rollers 29 disposed in the in-body discharge path 82 convey the sheet received from the reverse conveyance rollers 24 toward an intermediate supporting portion 90 provided in the binding processing portion 4A while passing the sheet onto one another. In this operation, a drum guide 61 described later prevents collision between a preceding sheet that has been already discharged to the intermediate supporting portion 90 and a succeeding sheet that is newly discharged to the intermediate supporting portion 90. In addition, the pre-intermediate supporting sensor 38 detects the sheet at a position between the intermediate conveyance rollers 28 and the kick-out rollers 29.

The binding processing portion 4A includes a stapler 51 serving as a binding unit of the present exemplary embodiment, and staples a predetermined position of the sheet bundle by the stapler 51 after aligning a plurality of sheets received from the in-body discharge path 82. The detailed configuration and operation of the binding processing portion 4A will be described later. The sheet bundle stapled by the binding processing portion 4A is passed onto bundle discharge rollers 36 through the second discharge path 84 serving as a third conveyance path, and is discharged onto the lower discharge tray 37 by the bundle discharge rollers 36 serving as a discharge unit.

The upper discharge tray 25 and the lower discharge tray 37 are both capable of moving up and down with respect to the casing of the post-processing apparatus 4. The post-processing apparatus 4 includes sheet surface detection sensors that respectively detect positions of upper surfaces of sheets, that is, the height of sheets supported on the upper discharge tray 25 and the lower discharge tray 37, and when either of the sensors detects a sheet, lowers the corresponding tray in an A2 or B2 direction. In addition, when it is detected by the sheet surface detection sensors that the sheets on the upper discharge tray 25 or the lower discharge tray 37 have been removed, the corresponding tray is lifted in an A1 or B1 direction. Therefore, the upper discharge tray 25 and the lower discharge tray 37 are controlled to ascend/descend in accordance with a supported sheet amount on each tray so as to maintain the upper surface of supported sheets at a constant height. In the present exemplary embodiment, the upper discharge tray 25 and the lower discharge tray 37, which respectively serve as a first supporting portion and a second supporting portion, are both controlled to ascend/descend by means of motor drive. Note that the upper discharge tray 25 and the lower discharge tray 37 may be controlled to ascend/descend by another mechanism, such as an urging member like a spring.

Buffering Operation

Figure 2:
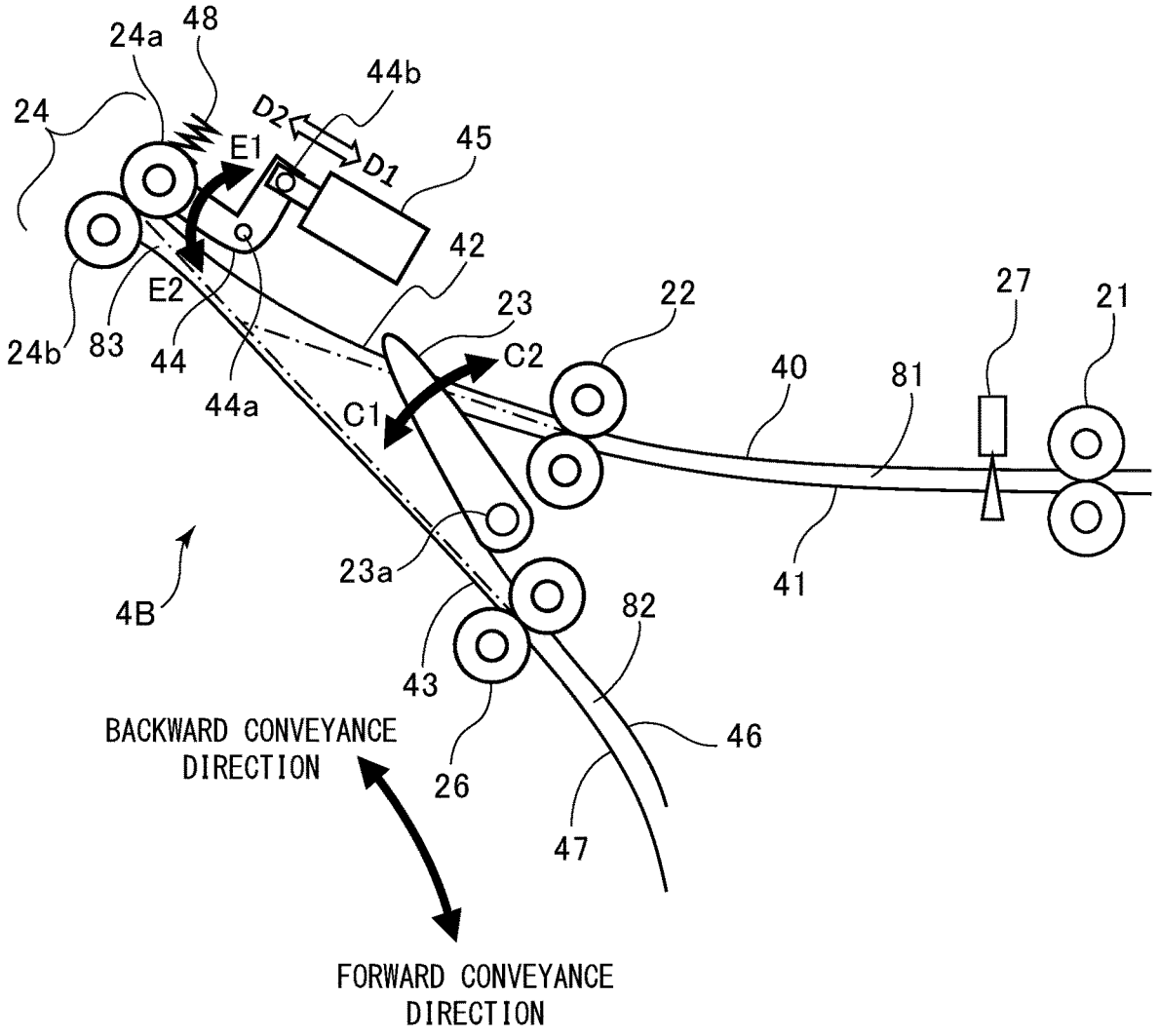
FIG. 2 is a schematic view of a buffering portion according to the first exemplary embodiment.

Next, the buffering operation will be described in detail with reference to FIGS. 2 to 4D. FIG. 2 is a schematic view of the buffering portion 4B, and FIGS. 3A to 4D each illustrate a buffering operation.

As illustrated in FIG. 2, the buffering portion 4B of the present exemplary embodiment includes the reverse conveyance rollers 24 serving as a reverse conveyance roller pair, the non-return flap 23, and in-body discharge rollers 26 serving as an intermediate roller pair. In addition, the inlet rollers 21, the pre-buffer rollers 22, and the entrance sensor 27 disposed in the entry path 81 also contribute to the buffering operation.

Conveyance guides making up the sheet conveyance path between the inlet rollers 21 and the pre-buffer rollers 22, that is, a part of the entry path 81, will be referred to as an "entrance upper guide 40" and an "entrance lower guide 41". In addition, conveyance guides making up the sheet conveyance path between the in-body discharge rollers 26 and the intermediate conveyance rollers 28, that is, a part of the in-body discharge path 82, will be referred to as an "in-body discharge upper guide 46" and an "in-body discharge lower guide 47". Further, a conveyance guide that guides the sheet from the same side as the entrance upper guide 40 at a position between the pre-buffer rollers 22 and the reverse conveyance rollers 24 will be referred to as a "reverse conveyance upper guide 42". In addition, a conveyance guide that guides the sheet from the same side as the in-body discharge lower guide 47 at a position between the reverse conveyance rollers 24 and the in-body discharge rollers 26 will be referred to as a "reverse conveyance lower guide 43".

The sheet conveyed by the inlet rollers 21 is guided to the pre-buffer rollers 22 by the entrance upper guide 40 and the entrance lower guide 41. The entrance sensor 27 is disposed on the entrance upper guide 40. As the entrance sensor 27, a reflection-type photosensor that radiates infrared light toward the entry path 81 and detects reflection light from the sheet to determine presence/absence of the sheet at a detection position can be used. In this case, a hole having a size equal to or bigger than the diameter of spotting light of the entrance sensor 27 is provided in the entrance lower guide 41 at a position opposing the entrance sensor 27 such that the infrared light is not reflected when the sheet is not passing through.

The non-return flap 23 is disposed at the portion downstream of the pre-buffer rollers 22 where the entry path 81 and the in-body discharge path 82 branch from the first discharge path 83. The non-return flap 23 is rotatably supported with respect to the in-body discharge upper guide 46 via a rotation shaft 23*a*. In addition, the non-return flap 23 is urged all the time by an unillustrated spring in a C2 direction, that is, a clockwise direction in FIG. 2, toward a position of FIG. 2 where the distal end portion of the non-return flap 23 overlaps with the reverse conveyance upper guide 42 as viewed in the axial direction of the rotation shaft 23*a*, that is, the width direction of the sheet. In addition, the spring constant of the spring mentioned above is set to such a value that when the sheet delivered out from the pre-buffer rollers 22 abuts the non-return flap 23, the non-return flap 23 pivots in a C1 direction, that is, a counterclockwise direction in FIG. 2, against the urging force of the spring. Therefore, the non-return flap 23 allows passage of the sheet conveyed from the pre-buffer rollers 22 toward the reverse conveyance rollers 24. Meanwhile, when the trailing end of the sheet in the entry path 81 passes the non-return flap 23, the non-return flap 23 pivots in the C2 direction to suppress backward movement of the sheet from the reverse conveyance rollers 24 to the pre-buffer rollers 22.

The reverse conveyance rollers 24 includes a reverse conveyance upper roller 24*a* and a reverse conveyance lower roller 24*b*. In the present exemplary embodiment, driving force is input to both of the reverse conveyance upper roller 24*a* and the reverse conveyance lower roller 24*b*, and rotation of the reverse conveyance upper roller 24*a* and rotation of the reverse conveyance lower roller 24*b* are synchronized all the time.

The reverse conveyance rollers 24 are configured to abut and separate from each other by a plunger solenoid 45. Specifically, one end of a separation lever 44 is coupled to a roller shaft of the reverse conveyance upper roller 24*a*, and the separation lever 44 is supported so as to be rotatable about a lever support shaft 44*a* with respect to the reverse conveyance upper guide 42. A solenoid coupling shaft 44*b* provided on the other end of the separation lever 44 is coupled to a plunger of the plunger solenoid 45.

When power is supplied to the plunger solenoid 45, the plunger is attracted in a D1 direction by magnetic force, the separation lever 44 rotates in an E1 direction, and the reverse conveyance rollers 24 transition to a separate state in which a nip portion of the roller pair is open. When the supply of power to the plunger solenoid 45 is stopped, the reverse conveyance upper roller 24*a* abuts the reverse conveyance lower roller 24*b* by an urging force of a pressurizing spring 48 coupled to the roller shaft of the reverse conveyance upper roller 24*a*, and the reverse conveyance rollers 24 transition to an abutting state in which the nip portion is closed. At this time, the separation lever 44 rotates in an E2 direction in accordance with the movement of the reverse conveyance upper roller 24*a*, and the plunger of the plunger solenoid 45 moves in a D2 direction.

The in-body discharge rollers 26 are a roller pair next to the reverse conveyance rollers 24 in a sheet conveyance direction in the in-body discharge path 82, and are capable of rotating in a normal rotation direction and in a reverse rotation direction. That is, the in-body discharge rollers 26 are capable of conveying the sheet in both of the sheet conveyance direction from the reverse conveyance rollers 24 toward the binding processing portion 4A, that is, a forward conveyance direction in the in-body discharge path 82, and a backward conveyance direction from the binding processing portion 4A toward the reverse conveyance rollers 24.

Next, the buffering operation of the buffering portion 4B will be described in detail with reference to FIGS. 3A to 4D. The buffering operation is an operation in which a predetermined number of sheets constituting a sheet bundle of the next copy is held in the buffering portion 4B until the binding process on the sheet bundle of the previous copy is completed in the binding processing portion 4A. By performing the buffering operation, the image forming system can execute an image formation job including a binding process without degrading the productivity, that is, the number of images output per unit time, of the image forming apparatus 1.

Hereinafter, to distinguish sheets, the sheets will be referred to as, in the order of being passed onto the post-processing apparatus 4 from the image forming apparatus 1, a "sheet S1", a "sheet S2", and a "sheet S3". In addition, among ends of the sheet in the sheet conveyance direction, the end that passes through the inlet rollers 21 first will be referred to as a "first end", and the end that passes through the inlet rollers 21 after the first end will be referred to as a "second end". In addition, the conveyance speed of the sheet in the horizontal conveyance portion 14 of the image forming apparatus 1 will be referred to as V1, and the conveyance speed after being accelerated in the post-processing apparatus 4 will be referred to as V2.

Figure 3A:
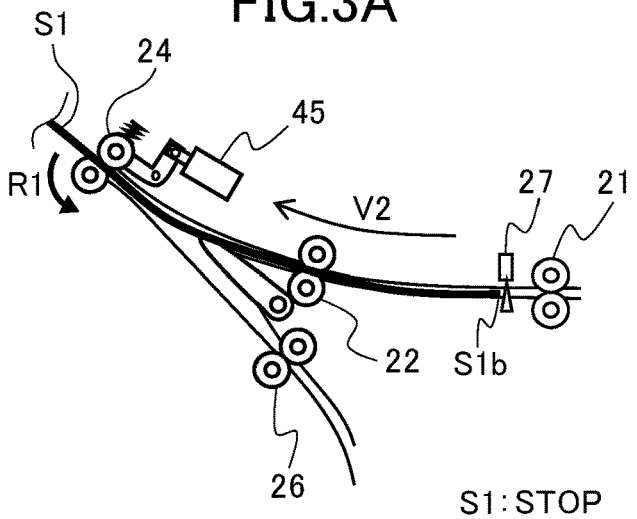
FIGS. 3A to 3D are diagrams for describing a buffering operation according to the first exemplary embodiment.

FIG. 3A illustrates a state at a time when the trailing end of the sheet S1 in the entry path 81, that is, a second end S1*b* has just passed the detection position of the entrance sensor 27. When the entrance sensor 27 detects the passage of the second end S1*b* of the sheet S1, the pre-buffer rollers 22 and the reverse conveyance rollers 24 accelerate the sheet S1 from the speed V1 to the speed V2. As a result of accelerating the sheet S1 in this manner, the distance between the sheet S1 and the sheet S2 following the sheet S2 is increased, and thus a sheet interval required for the reversing operation, that is, the switch-back by the reverse conveyance rollers 24 is secured. At the time of FIG. 3A, the reverse conveyance rollers 24 rotate in a pre-reversal rotation direction R1, and convey the sheet S1 in a direction toward the upper discharge tray 25.

Figure 3B:
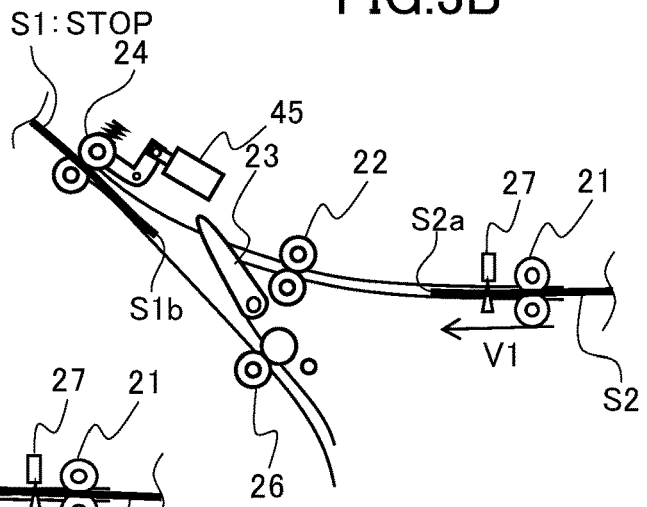

FIG. 3B illustrates a state at a time when the trailing end of the sheet S1 in the entry path 81, that is, the second end S1*b* has just passed the non-return flap 23. The reverse conveyance rollers 24 temporarily stop the rotation at a predetermined timing after the trailing end of the sheet S1, that is, the second end S1*b* has passed the non-return flap 23. The predetermined timing is determined on the basis of elapsed time from the timing at which the entrance sensor 27 has detected the passage of the trailing end of the sheet S1, that is, the second end S1*b*.

Figure 3C:
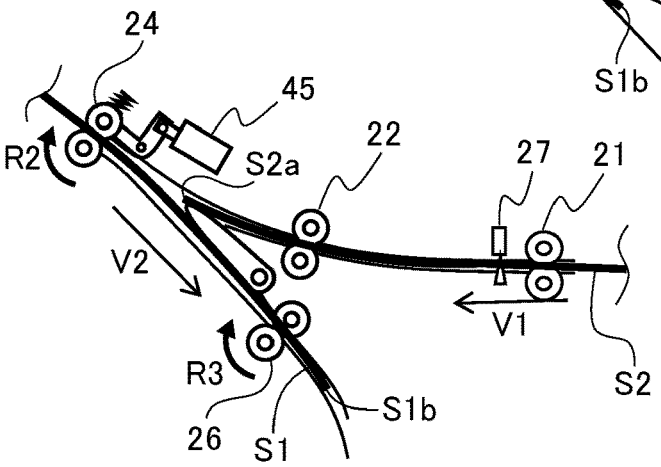

FIG. 3C illustrates a state after the reverse conveyance rollers 24 have started rotating in a rotation direction R2, which is a rotation direction after the start of reverse rotation, and the sheet S1 has been passed onto the in-body discharge rollers 26. The in-body discharge rollers 26 receive the sheet S1 in a state of being rotating in a rotation direction R3, and conveys the sheet S1 in a forward conveyance direction in the in-body discharge path 82. In addition, after the leading end of the sheet S1 in the in-body discharge path 82, that is, the second end S1*b* has passed the position of the non-return flap 23, the leading end of the sheet S2 in the entry path 81, that is, a first end S2*a* reaches the non-return flap 23. Therefore, the sheets S1 and S2 are conveyed so as to pass each other in the branching portion of the conveyance path.

Figure 3D:
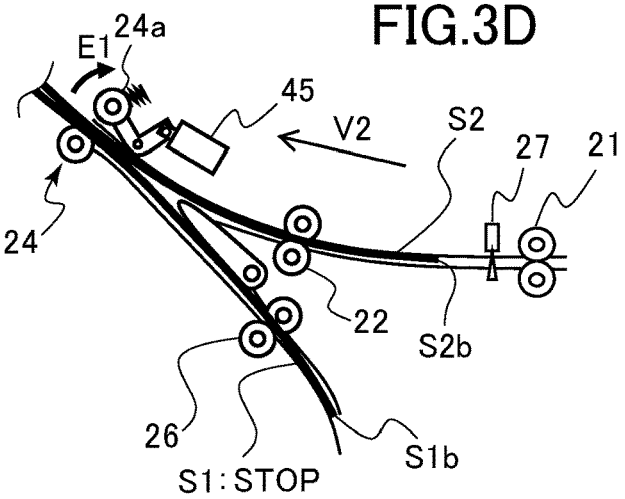

FIG. 3D illustrates a state at a time when the leading end of the sheet S1 in the in-body discharge path 82, that is, the second end S1*b* has been conveyed by a predetermined amount from the in-body discharge rollers 26 and the in-body discharge rollers 26 have temporarily stopped. After the time of FIG. 3C, power is supplied to the plunger solenoid 45 before the leading end of the sheet S2 in the entry path 81, that is, the first end S2*a* reaches the reverse conveyance rollers 24. As a result of this, the reverse conveyance upper roller 24*a* moves in the E1 direction, and the reverse conveyance rollers 24 are separated from each other. The sheet S1 is held by the in-body discharge rollers 26 in a stationary state, and part of the sheet S1 is positioned between the reverse conveyance rollers 24 in a separate state. Therefore, the sheet S2 delivered into the first discharge path 83 from the entry path 81 by the pre-buffer rollers 22 is conveyed so as to slide on the sheet S1. To be noted, the sheet S2 is also accelerated from the speed V1 to the speed V2 by the pre-buffer rollers 22 after the entrance sensor 27 has detected the passage of the trailing end of the sheet S2, that is, the second end S2*b*.

Figure 4A:
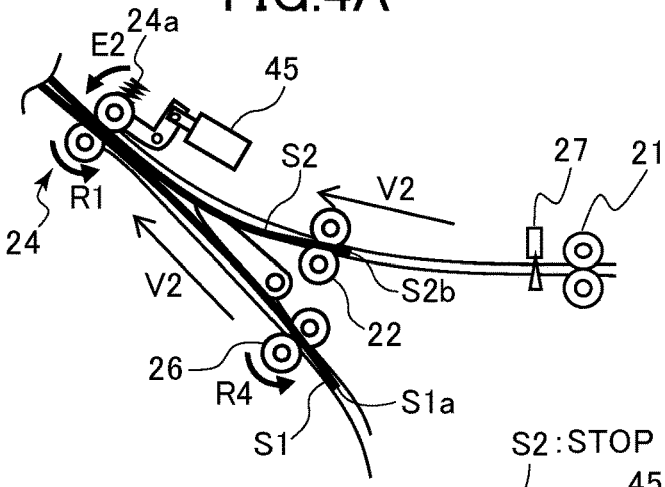
FIGS. 4A to 4D are diagrams for describing the buffering operation according to the first exemplary embodiment.

FIG. 4A illustrates a state after the in-body discharge rollers 26 have started conveying the sheet S1 in the backward conveyance direction. The in-body discharge rollers 26 start rotating in a rotation direction R4 at a timing when the sheet S2 is conveyed to a predetermined position, and convey the sheet S1 in the backward conveyance direction toward the reverse conveyance rollers 24. The target speed of the in-body discharge rollers 26 is also set to the speed V2 similarly to the pre-buffer rollers 22. At a timing after the speed of the sheet S1 has become approximately equal to the speed of the sheet S2, that is, after the relative speed therebetween has become approximately zero, the supply of power to the plunger solenoid 45 is stopped. As a result of this, the reverse conveyance upper roller 24*a* moves in the E2 direction, thus the reverse conveyance rollers 24 abut each other again, and the sheets S1 and S2 are nipped between the reverse conveyance rollers 24 in a state of being superimposed on each other. In addition, the reverse conveyance rollers 24 have started rotating in the rotation direction R1 in synchronization with the in-body discharge rollers 26, and are controlled such that the peripheral speed thereof becomes equal to that of the pre-buffer rollers 22 and the in-body discharge rollers 26, which is the speed V2, before the separate state is switched to the abutting state.

Figure 4B:
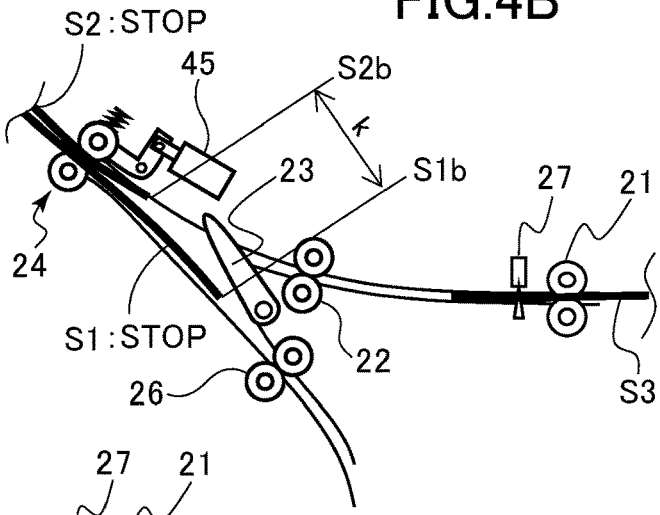

FIG. 4B illustrates a state after the trailing end of the sheet S2 in the entry path 81, that is, the second end S2*b* has passed the non-return flap 23. The reverse conveyance rollers 24 temporarily stop the rotation at a predetermined timing after the trailing end of the sheet S2, that is, the second end S2*b* has passed the non-return flap 23. At this time, the sheet S1 and S2 in a superimposed state both stop moving, and the second end S1*b* of the sheet S1 projects in the forward conveyance direction of the in-body discharge path 82 by a predetermined offset amount k with respect to the second end S2*b* of the sheet S2. This offset amount k is controlled by the in-body discharge rollers 26 starting the conveyance of the sheet S1 in the backward conveyance direction at a predetermined timing as described with reference to FIG. 4A.

Figure 4C:
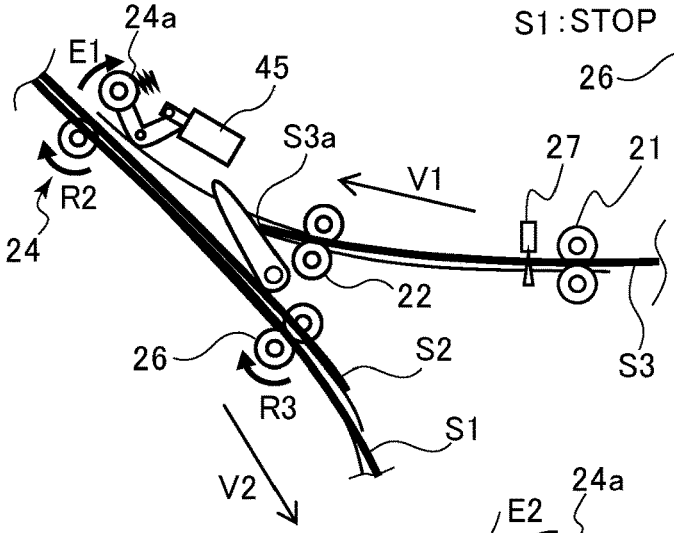

FIG. 4C illustrates a state after the reverse conveyance rollers 24 have started rotating in the rotation direction R2, and the sheets S1 and S2 in the superimposed state have been passed onto the in-body discharge rollers 26. The in-body discharge rollers 26 receive the sheets S1 and S2 in a state of being rotating in the rotation direction R3, and convey the sheets S1 and S2 in the forward conveyance direction in the in-body discharge path 82. The sheets S1 and S2 are conveyed to the binding processing portion 4A through the in-body discharge path 82 while maintaining the superimposed state.

To be noted, the leading end of the third sheet S3 in the entry path 81, that is, the first end S3*a* reaches the non-return flap 23 after the leading end of the sheet S2 in the in-body discharge path 82, that is, the second end S2*b* has passed the position of the non-return flap 23. Therefore, the sheets S2 and S3 are conveyed so as to pass each other at the branching portion of the conveyance path. In addition, the reverse conveyance upper roller 24*a* moves in the E1 direction after the sheet S2 is nipped between the in-body discharge rollers 26, and the reverse conveyance rollers 24 transition to the separate state again as preparation for receiving the sheet S3 following the sheet S2.

Figure 4D:
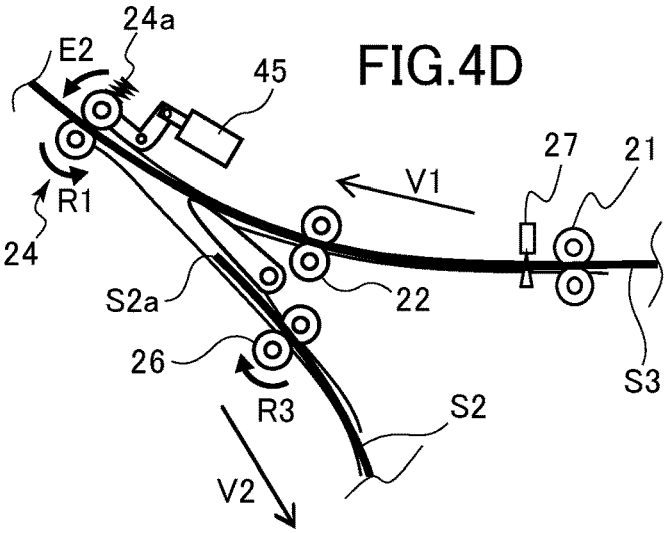

FIG. 4D illustrates a state after the reverse conveyance rollers 24 have transitioned from the separate state to the abutting state. After the first end S2*a* of the sheet S2 is released from the reverse conveyance rollers 24, the reverse conveyance rollers 24 are switched from the separate state to the abutting state and nip the sheet S3. Then, the reverse conveyance rollers 24 perform the reverse conveyance operation on the sheet S3, and the sheet S3 is conveyed to the binding processing portion 4A through the in-body discharge path 82 subsequently to the sheets S1 and S2.

Case of Buffering Three or More Sheets

Although an operation of buffering the two sheets S1 and S2 has been described above with reference to FIGS. 3A to 4D, the buffering portion 4B of the present exemplary embodiment is also capable of buffering three or more sheets. In this case, the in-body discharge rollers 26 stop in a state of nipping the sheets S1 and S2 as illustrated in FIG. 4C, and convey the sheets S1 and S2 in the backward conveyance direction at a predetermined timing after the entrance sensor 27 has detected the second end of the third sheet S3. Then, the reverse conveyance rollers 24 take the abutting state after the conveyance speed of the in-body discharge rollers 26 is synchronized with the conveyance speed of the pre-buffer rollers 22, and thus the reverse conveyance rollers 24 nip the three sheets S1, S2, and S3 in a superimposed state. At this time, the in-body discharge rollers 26 start the backward conveyance of the sheets S1 and S2 at a predetermined timing, and thus the second end of the second sheet S2 projects in the forward conveyance direction by the predetermined offset amount k with respect to the second end of the third sheet S3.

In addition, by repeating opening/closing the reverse conveyance rollers 24 and reverse rotation of the in-body discharge rollers 26 in an appropriate order, the buffering portion 4B can buffer, for example, five sheets at most. As a result of having a buffering function of superimposing three or more sheets, the post-processing apparatus 4 can process sheets without lowering the productivity of the image forming apparatus 1, which contributes to improvement of the overall productivity of the image forming system.

Drive Control of Roller

Figure 5:
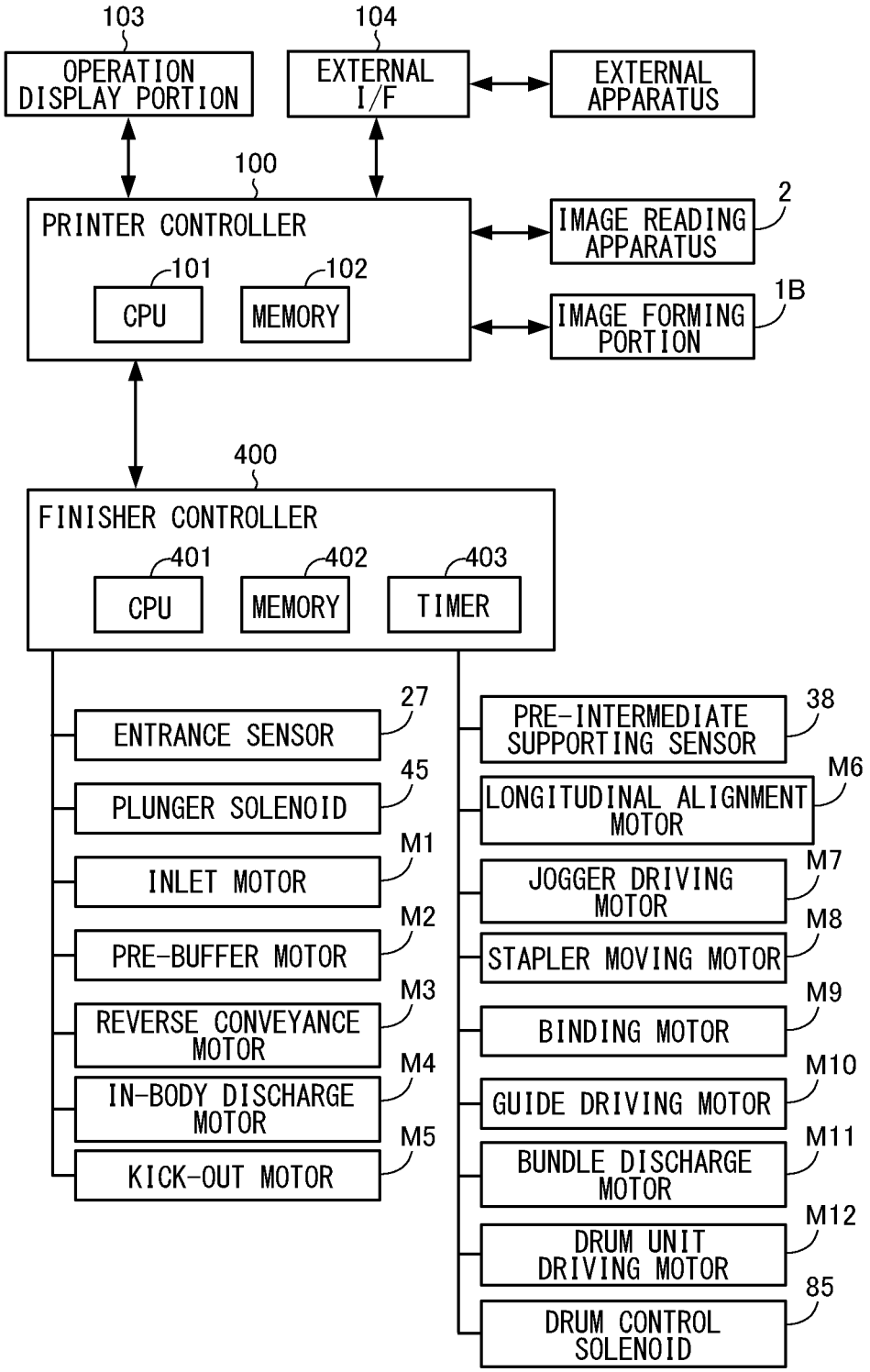
FIG. 5 is a block diagram of the image forming system according to the first exemplary embodiment.

Next, a control configuration that realizes the operation described with reference to FIGS. 3A to 4D will be described. FIG. 5 is a block diagram illustrating a configuration of the image forming system 1S according to the present exemplary embodiment. The image forming apparatus 1 includes the printer controller 100, and the post-processing apparatus 4 includes a finisher controller 400. The printer controller 100 and the finisher controller 400 are connected to each other via a communication interface, and control the operation of the image forming system 1S in cooperation with each other.

The printer controller 100 includes a central processing unit: CPU 101, and a memory 102. The CPU 101 reads and executes a program stored in the memory 102, and thus performs overall control of the image forming apparatus 1. For example, the CPU 101 performs processing of causing the image forming portion 1B to perform an image forming operation, processing of causing the image reading apparatus 2 to perform a reading operation to obtain image information, and the like. The memory 102 includes a nonvolatile storage medium such as a read-only memory: ROM, and a volatile storage medium such as a random access memory: RAM, and serves as a storage space for programs and data and a work space for the CPU 101 to execute the programs in. The memory 102 serves as an example of a non-transitory storage medium storing a program for controlling an image forming apparatus.

The printer controller 100 is connected to an external apparatus such as a personal computer or a mobile information device via the external interface (I/F) 104, and receives a command to execute an image formation job or the like issued to the image forming system 1S. In addition, the printer controller 100 is connected to an operation display portion 103 serving as a user interface of the image forming system 1S. The operation display portion 103 includes a display apparatus such as a liquid crystal panel that shows information to the user, and an input device such as a physical key or a touch panel function of a liquid crystal panel through which an input operation from the user is received. The printer controller 100 communicates with the operation display portion 103 to control what is displayed on the display apparatus and receive information input through the input device.

The finisher controller 400, which serves as a controller of the present exemplary embodiment, includes a central processing unit: CPU 401, a memory 402, and a timer 403. The CPU 401 reads and executes a program stored in the memory 402, and performs overall control of the post-processing apparatus 4. The memory 402 includes a non-volatile storage medium such as a read-only memory: ROM, and a volatile storage medium such as a random access memory: RAM, and serves as a storage space for programs and data and a work space for the CPU 401 to execute the programs in. The memory 402 serves as an example of a non-transitory storage medium storing a program for controlling an image forming apparatus.

The timer 403 is a circuit element having a timekeeping function, and is provided as an integrated circuit serving as a real-time clock, or as a module of a program executed by the CPU 401. To be noted, this is not limited to the timer 403, and each function provided in the printer controller 100 and finisher controller 400 can be mounted on the circuit of the controller in the form of independent hardware such as an application specific integrated circuit: ASIC, or provided as software as a function unit of a program. In addition, part or all of functions of the finisher controller 400 that will be described below may be provided in the printer controller 100.

The post-processing apparatus 4 includes a plurality of motors M1 to M11 serving as drive sources for conveying sheets or drive sources of the binding processing portion 4A, in addition to the entrance sensor 27, the pre-intermediate supporting sensor 38, the plunger solenoid 45, and the stapler 51 described above. Among these, an inlet motor M1 rotationally drives the inlet rollers 21. A pre-buffer motor M2 rotationally drives the pre-buffer rollers 22. A reverse conveyance motor M3 rotationally drives the reverse conveyance rollers 24. An in-body discharge motor M4 rotationally drives the in-body discharge rollers 26. A kick-out motor M5 rotationally drives the kick-out rollers 29. The other motors M6 to M11 that are mainly related to a binding process performed by the binding processing portion 4A and discharge of the bound sheet bundle will be described later. To be noted, although each roller described above is driven by an independent motor, which is corresponding one of the motors M1 to M5, a plurality of rollers can be controlled by one motor as long as the driving state of each roller can be appropriately controlled as will be described below.

The operation sequence of each roller will be described below with reference to flowcharts of FIGS. 6 to 9. Each step of the flowcharts is processed by executing the program read by the CPU 401 of the finisher controller 400 from the memory 402. In addition, each operation sequence is started in the case where the finisher controller 400 has received a notification indicating that execution of an image formation job in which the lower discharge tray 37 is set as the sheet discharge destination has been started from the printer controller 100.

To be noted, in the description below, the start and stop of rotation of roller and change of rotation speed of the roller refer to processing of the CPU 401 to transmit a signal instructing a rotation speed or a rotation direction to a driving circuit of each of the motors M1 to M5. In addition, an "activation timer", a "stop timer", and the like refer to functions of the timer 403 to count down, on the basis of a preset waiting time, to the execution timing of a target process with respect to the occurrence time of a predetermined event.

Operation Sequence of Inlet Rollers

Figure 6:
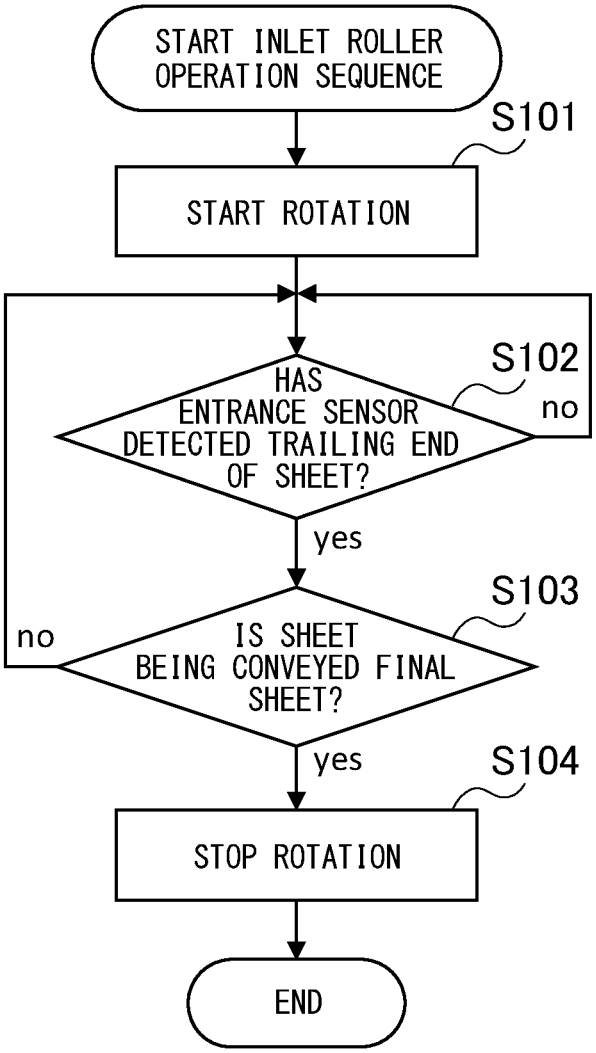
FIG. 6 is a flowchart illustrating an operation sequence of inlet rollers according to the first exemplary embodiment.

First, the operation sequence of the inlet rollers 21 will be described with reference to FIG. 6.

In step S101, rotation of the inlet rollers 21 is started at the target speed V1. In step S102, a standby state is maintained while determining whether or not passage of the trailing end of the sheet in the entry path 81 has been detected by the entrance sensor 27. When the entrance sensor 27 detects the passage of the trailing end of the sheet, whether or not the sheet being conveyed is a final sheet is determined in step S103, and in the case where the sheet is not the final sheet, the process returns to step S102 and is continued. In the case where the sheet being conveyed is the final sheet in step S103, the rotation of the inlet rollers 21 is stopped in step S104, and the operation sequence is finished.

Operation Sequence of Pre-Buffer Rollers

Figure 7:
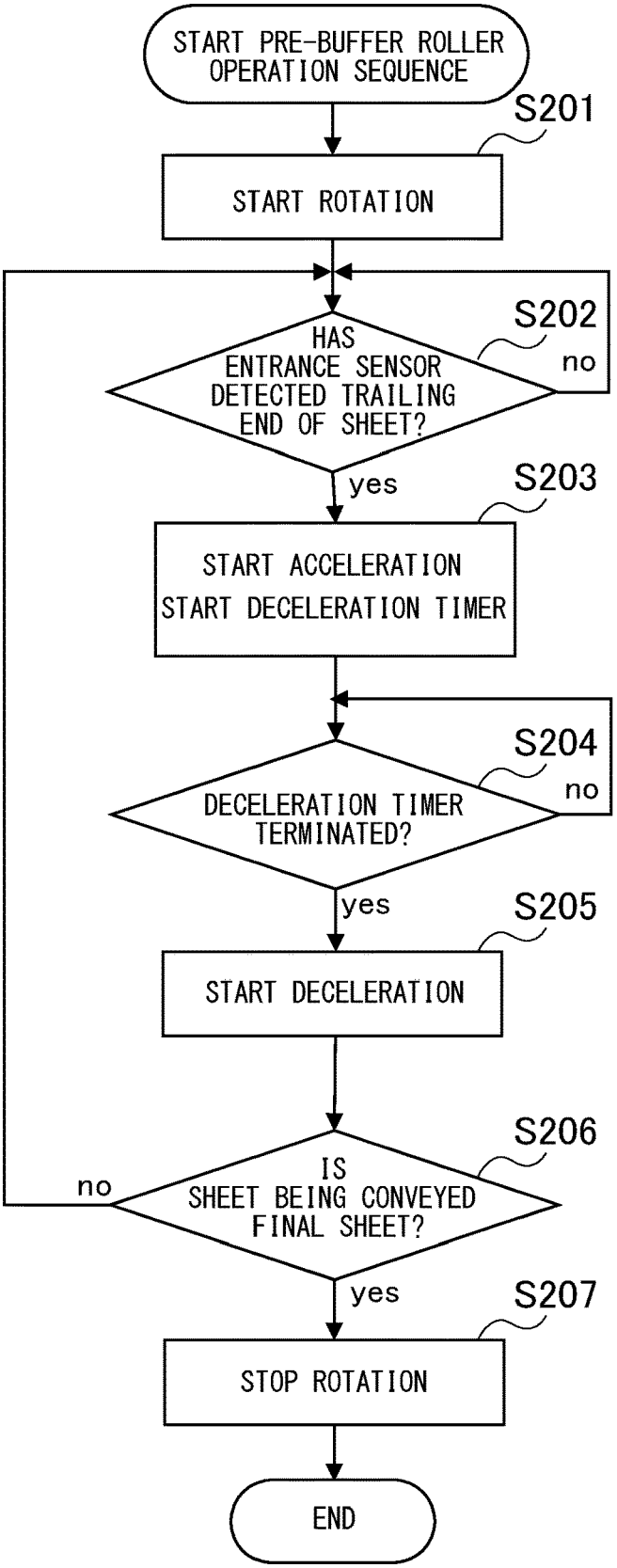
FIG. 7 is a flowchart illustrating an operation sequence of pre-buffer rollers according to the first exemplary embodiment.

Next, an operation sequence of the pre-buffer rollers 22 will be described with reference to FIG. 7.

In step S201, rotation of the pre-buffer rollers 22 is started at the target speed V1. In step S202, a standby state is maintained while determining whether or not passage of the trailing end of the sheet in the entry path 81 has been detected by the entrance sensor 27. When the entrance sensor 27 detects the passage of the trailing end of the sheet, in step S203, processing of accelerating the pre-buffer rollers 22 to the target speed V2 is started and a deceleration timer is set.

The termination time of the deceleration timer is set to a timing at which the trailing end of the sheet passes through the pre-buffer rollers 22 or a timing thereafter.

In step S204, a standby state is maintained while counting down the deceleration timer. When the countdown is finished, processing of decelerating the pre-buffer rollers 22 to the target speed V1 is started in step S205. In step S206, whether or not the sheet being conveyed is a final sheet is determined, and in the case where the sheet is not the final sheet, the process returns to step S202 and is continued. In the case where the sheet being conveyed is the final sheet in step S206, the rotation of the pre-buffer rollers 22 is stopped in step S207, and the operation sequence is finished.

Operation Sequence of Reverse Conveyance Rollers

Next, an operation sequence of the reverse conveyance rollers 24 will be described with reference to FIG. 8.

In step S301, whether or not the sheet being conveyed is a target of the buffering operation is determined. In the case where the sheet is a target of the buffering operation, the process proceeds to step S302, and in the case where the sheet is not a target of the buffering operation, the process proceeds to step S321. The sheet serving as a target of the buffering operation is, in the case of executing an image formation job of forming a plurality of copies of sheet bundles by the binding processing portion 4A, a sheet of a next copy that is passed onto the post-processing apparatus 4 from the image forming apparatus 1 before the binding process on a sheet bundle of the previous copy is completed. The number of sheets serving as targets of the buffering operation is preset in accordance with the contents of the image formation job notified from the printer controller 100, for example, particularly, the interval of discharge of sheets from the image forming apparatus 1, the sheet length in the conveyance direction, the process speed, and the like.

Steps S302 to S320 correspond to an operation performed on a sheet serving as a buffering target. In step S302, whether or not the sheet being conveyed is the first sheet is determined. In the case where the sheet is the first sheet, the process proceeds to step S303, and in the case where the sheet is not the first sheet, the process proceeds to step S307.

In step S303, rotation of the reverse conveyance rollers 24 is started at the target speed V1 in the pre-reversal rotation direction R1, and the reverse conveyance rollers 24 are set to the abutting state in which the nip portion is formed. In step S304, a standby state is maintained while determining whether or not the entrance sensor 27 has detected passage of the trailing end of the sheet in the entry path 81. When the entrance sensor 27 detects the passage of the trailing end of the sheet, processing of accelerating the reverse conveyance rollers 24 to the target speed V2 is started in step S305, and each timer is set in step S306.

The termination time of a reverse conveyance timer is set to a timing after the second end of the sheet passes the non-return flap 23 and before the second end of the sheet passes through the reverse conveyance rollers.

The termination time of a separation timer is set to a timing after the leading end of the sheet reversed by the reverse conveyance rollers 24, that is, the second end of the sheet reaches the in-body discharge rollers 26.

Figure 9:
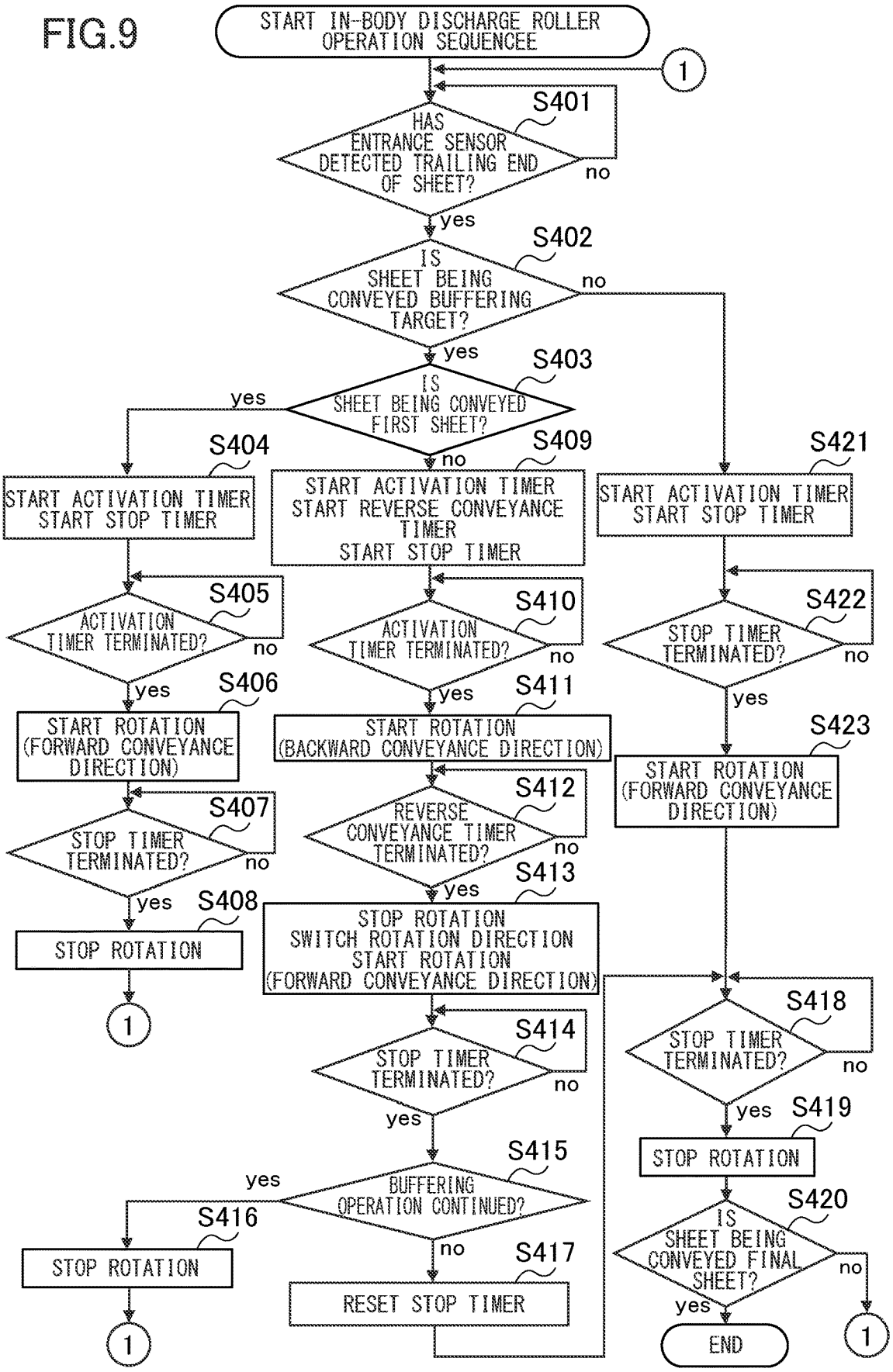
FIG. 9 is a flowchart illustrating an operation sequence of in-body discharge rollers according to the first exemplary embodiment.

The termination time of a stop timer is set so as to be synchronized with stop of the in-body discharge rollers 26 in step S408 of FIG. 9.

After step S306, the process proceeds to step S313 similarly to the case where the sheet being conveyed is not the first sheet.

In step S307, a standby state is maintained while determining whether or not the entrance sensor 27 has detected passage of the trailing end of the sheet in the entry path 81. When the entrance sensor 27 detects the passage of the trailing end of the sheet, each timer is set in step S308.

The termination time of the activation timer is set so as to be synchronized with the start of backward conveyance of the sheet in step S411 of FIG. 9 by the in-body discharge rollers 26.

The termination time of a nip timer is set to a timing after the peripheral speed of the reverse conveyance rollers 24 whose rotation is started in step S310 below reaches the speed V2.

The termination time of a reverse conveyance timer is set to a timing after the trailing end of the sheet in the entry path 81 passes the non-return flap 23 and before the trailing end of the sheet passes the reverse conveyance rollers 24.

The termination time of the separation timer is set to a timing after the leading end of the sheet reversed by the reverse conveyance rollers 24, that is, the second end of the sheet reaches the in-body discharge rollers 26.

The termination time of the stop timer is set so as to synchronize with stop of the in-body discharge rollers 26 in step S419 of FIG. 9.

In step S309, a standby state is maintained while counting down the activation timer. Here, while the reverse conveyance rollers 24 are standing by in the separate state, the sheet being conveyed reaches the reverse conveyance rollers 24, and is superimposed on a sheet nipped between the in-body discharge rollers 26 as illustrated in FIG. 3D. When the countdown is finished, rotation of the reverse conveyance rollers 24 is started at the target speed V1 and in the pre-reversal rotation direction R1 in step S310. In step S311, a standby state is maintained while counting down the nip timer. When the countdown is finished, supply of power to the plunger solenoid 45 is stopped in step S312, and the reverse conveyance rollers 24 are caused to abut each other as illustrated in FIG. 4A. At this time, the reverse conveyance rollers 24 are switched from the separate state to the abutting state while the reverse conveyance rollers 24 are rotating at a peripheral speed equal to that of the in-body discharge rollers 26. After step S312, the process proceeds to step S313 similarly to the case where the sheet being conveyed is the first sheet.

In step S313, a standby state is maintained while counting down the reverse conveyance timer. When the countdown is finished, in step S314, the reverse conveyance rollers 24 are temporarily stopped as illustrated in FIG. 4B, the rotation direction is switched from the pre-reversal rotation direction R1 to the post-reversal rotation direction R2, and the reverse conveyance rollers 24 are reactivated at the target speed V2. In step S315, whether or not to continue the buffering operation, that is, whether or not the sheet to be conveyed next is also a target of the buffering operation is determined, and in the case where the buffering operation is to be continued, the process proceeds to step S316. In step S316, a standby state is maintained while counting down the separation timer. When the countdown is finished, in step S317, supply of power to the plunger solenoid 45 is stopped, and the reverse conveyance rollers 24 are separated from each other as illustrated in FIG. 4C. In step S318, a standby state is maintained while counting down the stop timer. When the countdown is finished, in step S319, the reverse conveyance rollers 24 are stopped. In step S320, whether or not the sheet being conveyed is the final sheet is determined, and in the case where the sheet is not the final sheet, the process returns to step S3010 and is continued. In the case where it has been determined in step S320 that the sheet being conveyed is the final sheet, the operation sequence is finished. In contrast, in the case where it has been determined to not continue the buffering operation in step S315, a standby state is taken in step S331 until the stop timer is terminated, and then the stop timer is reset in step S332. The termination time of the reset timer is set to a timing after the trailing end of the sheet in the in-body discharge path 82 has passed through the reverse conveyance rollers 24. After step S332, the process proceeds to step S318, and the processing described above is performed.

Steps S321 to S329 correspond to an operation on a sheet that is not a buffering target. In this case, the reverse conveyance of the sheet by the reverse conveyance rollers 24 is performed while the reverse conveyance rollers 24 are still in the abutting state. That is, in step S321, rotation of the reverse conveyance rollers 24 is started at the target speed V1 in the pre-reversal rotation direction R1, and the reverse conveyance rollers 24 is set to the abutting state in which the nip portion is formed. In step S322, a standby state is maintained while determining whether or not the entrance sensor 27 has detected passage of the trailing end of the sheet in the entry path 81. When the entrance sensor 27 detects the passage of the trailing end of the sheet, processing of accelerating the reverse conveyance rollers 24 to the target speed V2 is started in step S323, and each timer is set in step S324.

The termination time of the reverse conveyance timer is set to a timing after the second end of the sheet passes the non-return flap 23 and before the second end of the sheet passes through the reverse conveyance rollers.

The termination time of the stop timer is set to a timing after the trailing end of the sheet in the in-body discharge path 82 passes through the reverse conveyance rollers 24.

In step S325, a standby state is maintained while counting down the reverse conveyance timer. When the countdown is finished, in step S326, the reverse conveyance rollers 24 are temporarily stopped, the rotation direction of the reverse conveyance rollers 24 is switched from the pre-reversal rotation direction R1 to the post-reversal rotation direction R2, and the reverse conveyance rollers 24 are reactivated at the target speed V2. In step S327, a standby state is maintained while counting down the stop timer. When the countdown is finished, in step S328, the reverse conveyance rollers 24 are stopped. In step S329, whether or not the sheet being conveyed is the final sheet is determined, and in the case where the sheet is not the final sheet, the process returns to step S301 and is continued. In the case where it has been determined in step S329 that the sheet being conveyed is the final sheet, the operation sequence is finished.

Operation Sequence of In-Body Discharge Rollers

Next, the operation sequence of the in-body discharge rollers 26 will be described with reference to FIG. 9.

In step S401, a standby state is maintained while determining whether or not passage of the trailing end of the sheet in the entry path 81 has been detected by the entrance sensor 27. When the entrance sensor 27 detects the passage of the trailing end of the sheet, whether or not the sheet being conveyed is a target of the buffering operation is determined in step S402. In the case where the sheet is a target of the buffering operation, the process proceeds to step S403, and in the case where the sheet is not a target of the buffering operation, the process proceeds to step S421. In step S403, whether or not the sheet being conveyed is the first sheet of a sheet bundle to be processed by the binding processing portion 4A is determined. In the case where the sheet is the first sheet of the sheet bundle, the process proceeds to step S404, and in the case where the sheet is not the first sheet of the sheet bundle, the process proceeds to step S409.

In step S404, each timer is set on the basis of the timing at which the entrance sensor 27 has detected the passage of the trailing end of the sheet in step S401.

The termination time of the activation timer is set to such a timing that the in-body discharge rollers 26 can be accelerated to the target speed V2 before the sheet reversed by the reverse conveyance rollers 24 reaches the in-body discharge rollers 26.

The termination time of the stop timer is set to a timing when the leading end of the sheet in the in-body discharge path 82 is conveyed to a predetermined distance past the reverse conveyance rollers 24.

In step S405, a standby state is maintained while counting down the activation timer. When the countdown is finished, in step S406, rotation of the in-body discharge rollers 26 is started at the target speed V2 in the rotation direction R3 following the forward conveyance direction in the in-body discharge path 82. In step S407, a standby state is maintained while counting down the stop timer. When the countdown is finished, the in-body discharge rollers 26 are stopped in step S408, and the process returns to step S401. The timing at which the in-body discharge rollers 26 are stopped in step S408 is synchronized with the timing of stopping the reverse conveyance rollers 24 in step S319 of FIG. 8. In addition, by stopping the in-body discharge rollers 26 in step S408, the first sheet serving as a buffering target is stopped in a state of being held by the in-body discharge rollers 26 as illustrated in FIG. 3D.

Steps S409 to S418 correspond to an operation performed when conveying a sheet serving as a buffering target excluding the first sheet. To be noted, during execution of steps S409 to S413, the in-body discharge rollers 26 come into contact not with the sheet being conveyed but with the sheet held by the in-body discharge rollers 26, that is, the sheet being buffered. For example, when the in-body discharge rollers 26 operate in the case where the second sheet S2 serves as the "sheet being conveyed", the in-body discharge rollers 26 actually move the first sheet S1 that is being buffered in the period between FIGS. 4B and 4C, until the second end S2*b* of the sheet S2 reaches the in-body discharge rollers 26.

In step S409, each timer is set on the basis of the timing at which the entrance sensor 27 has detected the passage of the trailing end of the sheet in step S401.

The termination time of the activation timer is set such that the offset amount between the sheet being buffered, whose conveyance is started in the backward conveyance direction in step S411 below, and the sheet being conveyed is the predetermined offset amount k.

Figure 8:
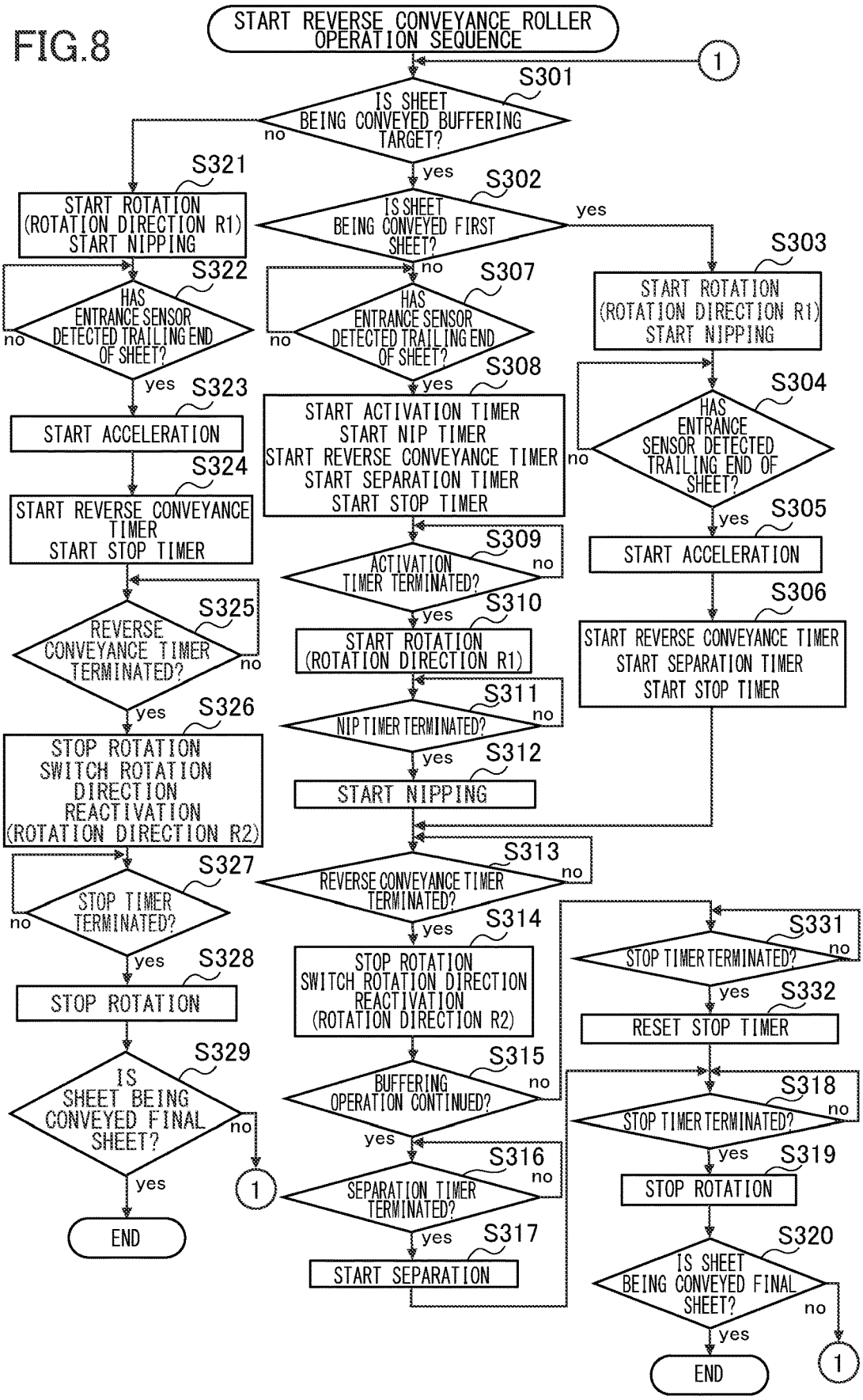
FIG. 8 is a flowchart illustrating an operation sequence of reverse conveyance rollers according to the first exemplary embodiment.

The termination time of the reverse conveyance timer is set so as to synchronize with the timing at which rotation of the reverse conveyance rollers 24 is started in the post-reversal rotation direction R2 in step S314 of FIG. 8.

The termination time of the stop timer is set to a timing when the second end of the sheet being conveyed is conveyed to a predetermined distance past the in-body discharge rollers 26. In the case where a plurality of sheets are buffered by being held by the in-body discharge rollers 26, the stop timer is set with respect to the second end of the uppermost sheet.

In step S410, a standby state is maintained while counting down the activation timer. When the countdown is finished, rotation of the in-body discharge rollers 26 is started at the target speed V2 in the rotation direction R4 following the backward conveyance direction in the in-body discharge path 82 in step S411. As a result of this, the sheet being buffered is conveyed in the backward conveyance direction, and is superimposed at the predetermined offset amount k on the sheet being conveyed fed from the pre-buffer rollers 22 as illustrated in FIGS. 4A and 4B. In addition, the conveyance speed V2 at which the in-body discharge rollers 26 convey the sheet in the backward conveyance direction is equal to the conveyance speed at which the pre-buffer rollers 22 deliver the sheet into the reverse conveyance rollers 24.

In step S412, a standby state is maintained while counting down the reverse conveyance timer. When the countdown is finished, in step S413, the in-body discharge rollers 26 are temporarily stopped, the rotation direction of the in-body discharge rollers 26 is reversed from the reverse rotation direction R4 to the normal rotation direction R3, and the in-body discharge rollers 26 are reactivated at the target speed V2. This reversing operation of the in-body discharge rollers 26 is performed in synchronization with the reversing operation of the reverse conveyance rollers 24 performed in step S314 of FIG. 8. As a result of this, the sheet being conveyed and the sheet being buffered are passed onto the in-body discharge rollers 26 from the reverse conveyance rollers 24 in a superimposed state as illustrated in FIG. 4C.

In step S414, a standby state is maintained while counting down the stop timer. When the countdown is finished, whether or not to continue the buffering operation, that is, whether or not the sheet that reaches the in-body discharge rollers 26 next is also a buffering target, is determined in step S415. In the case of continuing the buffering operation, the in-body discharge rollers 26 are stopped in step S416 on the basis of the termination of the stop timer, and the process returns to step S401 and is continued. In this case, processing of steps S409 to S414 is repeated on the next sheet, and thus three or more sheets are superimposed on one another in the buffering portion. In the case where the buffering operation is not to be continued, the stop timer is reset in step S417, and the rotation of the in-body discharge rollers 26 is continued. The termination time of the reset stop timer is set to a timing after the trailing end of the sheet in the in-body discharge path 82, that is, the first end of the sheet being conveyed has passed through the in-body discharge rollers 26. In this case, a standby state is taken while counting down the stop timer in step S418, and when the countdown is finished, the in-body discharge rollers 26 are stopped in step S419. In step S420, whether or not the sheet being conveyed is the final sheet is determined. In the case where the sheet is not the final sheet, the process returns to step S401 and is continued. In the case where the sheet is the final sheet, the operation sequence is finished.

Steps S421 to S423 correspond to an operation performed on a sheet that is not a buffering target. In this case, the in-body discharge rollers 26 simply convey the sheet received from the reverse conveyance rollers 24 in the forward conveyance direction toward the binding processing portion 4A without conveying the sheet in the backward conveyance direction. That is, in step S421, each timer is set on the basis of the timing at which the entrance sensor 27 has detected the passage of the trailing end of the sheet in step S401.

The termination time of the activation timer is set to such a timing that the in-body discharge rollers 26 can be accelerated to the target speed V2 before the sheet reversed by the reverse conveyance rollers 24 reaches the in-body discharge rollers 26.

The termination time of the stop timer is set to a timing after the trailing end of the sheet in the in-body discharge path 82 passes through the in-body discharge rollers 26.

In step S422, a standby state is maintained while counting down the activation timer, and when the countdown is finished, in step S423, rotation of the in-body discharge rollers 26 is started at the target speed V2 in the rotation direction R3 following the forward conveyance direction in the in-body discharge path 82. Then, a standby state is maintained while counting down the stop timer in step S418, and when the countdown is finished, the in-body discharge rollers 26 are stopped in step S419. In step S420, whether or not the sheet being conveyed is the final sheet is determined. In the case where the sheet is not the final sheet, the process returns to step S401 and is continued, and in the case where the sheet is the final sheet, the operation sequence is finished.

Binding Processing Portion

Figure 10A:
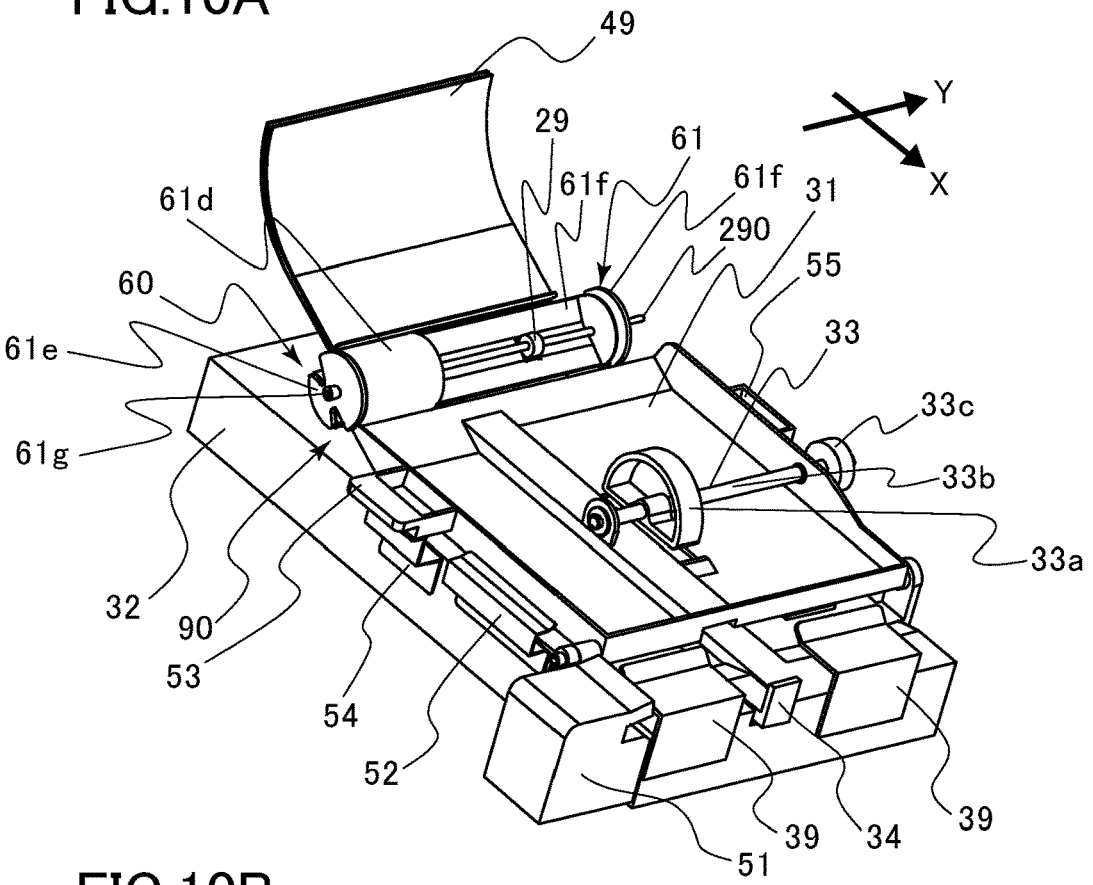
FIG. 10A is a perspective view of a binding processing portion according to the first exemplary embodiment.

Next, a binding processing portion 4A will be described. FIG. 10A is a perspective view of the binding processing portion 4A, and FIG. 10B is a perspective view of the binding processing portion 4A in a state in which an intermediate supporting upper guide 31, which is a part of the binding processing portion 4A, is open.

Figure 10B:
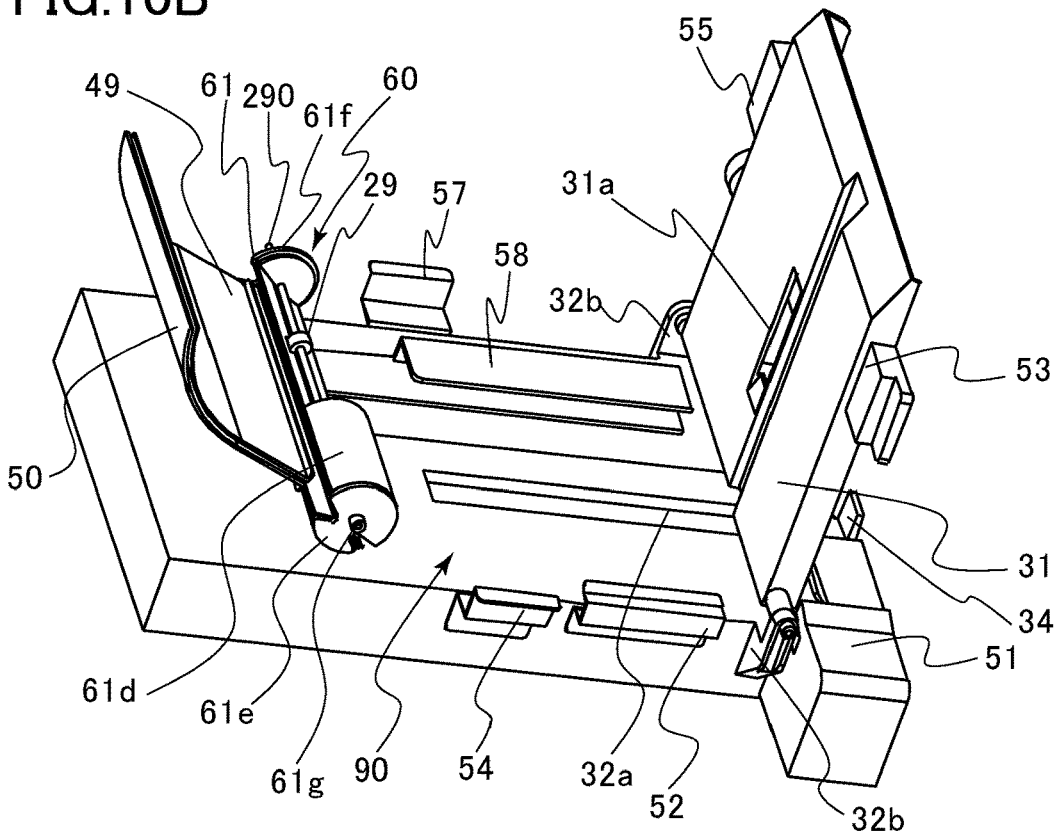
FIG. 10B is a perspective view of the binding processing portion according to the first exemplary embodiment in a state in which an intermediate supporting upper guide is open.

As illustrated in FIGS. 1, 10A, and 10B, the binding processing portion 4A includes a stapler 51, an intermediate supporting upper guide 31, an intermediate supporting lower guide 32, longitudinal alignment standard plates 39, a longitudinal alignment roller 33, a bundle discharge guide 34, and a guide driving portion 35. The binding processing portion 4A forms a bound sheet bundle by performing, by the stapler 51, a binding process on sheets discharged from the in-body discharge path 82 and stacked on the intermediate supporting portion 90.

The intermediate supporting upper guide 31 and intermediate supporting lower guide 32 constitute an intermediate supporting portion 90 on which a sheet to be subjected to processing is supported. The intermediate supporting lower guide 32 is a supporting portion of the present exemplary embodiment that supports thereon a sheet discharged by the kick-out rollers 29, which are the most downstream rollers in the in-body discharge path 82.

The kick-out rollers 29 are disposed in a space defined by a drum guide 61, which is a drum-shaped guide, and constitute a drum unit 60 together with the drum guide 61. The drum guide 61 presses the trailing end portion of a preceding sheet that has been previously discharged onto the intermediate supporting portion 90 so as to suppress collision of the leading end of a succeeding sheet, which is discharged by the kick-out rollers 29 next, with the trailing end of the preceding sheet. Details of the configuration and effect of the drum unit 60 will be described later.

The longitudinal alignment roller 33 serving as a moving member of the present exemplary embodiment is disposed above the intermediate supporting lower guide 32. The longitudinal alignment roller 33 includes a roller portion 33*a* formed from an elastic material such as a synthetic rubber or an elastomer resin and adjusted such that the outer peripheral surface thereof has a predetermined friction coefficient. The roller portion 33*a* is supported by a shaft portion 33*b* rotatably supported by the intermediate supporting upper guide 31, and is driven to intermittently rotate once at a time by a drive transmission device including a gear portion 33*c*. The roller portion 33*a* serving as an outer peripheral portion of the longitudinal alignment roller 33 has a noncircular shape as viewed in the axial direction of the shaft portion 33*b*. In a standby state before the sheet is discharged onto the intermediate supporting portion 90, the longitudinal alignment roller 33 is held at such a rotation angle that the roller portion 33*a* is not exposed from the intermediate supporting upper guide 31. In addition, while the longitudinal alignment roller 33 rotates once, the roller portion 33*a* is temporarily exposed through an opening portion 31*a* provided in the intermediate supporting upper guide 31, and comes into contact with an upper surface of the uppermost sheet of the sheets supported on the intermediate supporting lower guide 32 to apply a conveyance force to the sheet. The contact pressure of the longitudinal alignment roller 33 on the sheet is adjusted such that the longitudinal alignment roller 33 slips after the sheet abuts the longitudinal alignment standard plates 39.

The intermediate supporting portion 90 is provided with a pressing guide 56 that is a flexible sheet member. The pressing guide 56 is disposed to abut the intermediate supporting lower guide 32, and presses the upper surface of a sheet supported on the intermediate supporting portion 90 by a predetermined pressurizing force.

The longitudinal alignment standard plates 39 serving as regulating members of the present exemplary embodiment are provided downstream of the longitudinal alignment roller 33 in the sheet discharge direction of the kick-out rollers 29. The longitudinal alignment standard plates 39 each include, as a regulating portion that abuts an end portion of the sheet, a longitudinal alignment standard surface 39*a* that projects upward from the upper surface of the intermediate supporting lower guide 32. In addition, the two longitudinal alignment standard plates 39 of the present exemplary embodiment are provided on both sides in a direction perpendicular to the sheet discharge direction, that is, in the sheet width direction.

In the description below, a direction in which the sheet discharged by the kick-out rollers 29 moves toward the longitudinal alignment standard plates 39 in the binding processing portion 4A will be referred to as a "longitudinal alignment direction". The longitudinal alignment direction is a direction following the forward conveyance direction in the in-body discharge path 82, and is a direction in which the longitudinal alignment roller 33 moves a sheet toward the longitudinal alignment standard plates 39. In addition, a direction opposite to the longitudinal alignment direction, that is, a direction in which a sheet bundle is discharged from the binding processing portion 4A will be referred to as a "bundle discharge direction".

The stapler 51 performs a binding process at a predetermined position on a plurality of sheets supported on the intermediate supporting portion 90 and aligned in the longitudinal alignment direction and the sheet width direction. The stapler 51 of the present exemplary embodiment is provided on the same side as a lateral alignment standard plate 52 in the sheet width direction, and is provided so as to be movable in the longitudinal alignment direction and in the bundle discharge direction. In addition, the intermediate supporting lower guide 32 is large enough to support sheets of A4 size thereon that has been conveyed thereto in a long side feeding direction in which the longitudinal alignment direction is parallel to a long side direction and the sheet width direction is parallel to a short side direction. Therefore, the stapler 51 can perform not only corner binding in which a corner portion of the sheet bundle supported on the intermediate supporting portion 90 is stapled but also long side binding in which the stapler 51 staples a plurality of positions along the long side of the sheet bundle while moving with respect to the sheet bundle. To be noted, the stapler 51 is not limited to a stapler that binds the sheets by using staples, and a stapleless binding system may be employed. Examples of the stapleless binding system include a system that causes compression bonding between sheets by nipping the sheets between concave and convex surfaces, and a system that cuts a part of the sheets into a U shape and folds the U-shaped portion.

A bundle discharge guide 34 is provided between the two longitudinal alignment standard plates 39 as a push-out member that pushes out processed sheets from the intermediate supporting portion 90. The bundle discharge guide 34 is attached to a guide driving portion 35 illustrated in FIG. 1, and can move in the bundle discharge direction and in the longitudinal alignment direction. In addition, a slide groove 32*a* that guides movement of the bundle discharge guide 34 is defined in the intermediate supporting lower guide 32 as illustrated in FIG. 10B.

The lateral alignment standard plate 52 is fixed to the intermediate supporting lower guide 32, and a lateral alignment jogger 58 is provided so as to be movable in the sheet width direction with respect to the lateral alignment standard plate 52. The lateral alignment standard plate 52 includes a standard wall 52*a* projecting upward from the upper surface of the intermediate supporting lower guide 32 and extending along the longitudinal alignment direction, and is opposed to the lateral alignment jogger 58 in the sheet width direction. The lateral alignment standard plate 52 functions as a standard member (i.e., reference member) that serves as a standard (reference) for aligning the position of sheets stacked on the intermediate supporting portion 90 in the sheet width direction. The lateral alignment jogger 58 functions as an aligning member that aligns the sheets stacked on the intermediate supporting portion 90 by pushing the sheets in the sheet width direction such that the sheets abut the standard wall 52*a*.

The intermediate supporting upper guide 31 is supported so as to be pivotable, that is, openable and closable, about a support portion 32*b* of the intermediate supporting lower guide 32 with respect to the intermediate supporting lower guide 32. Abutting plates 54 and 57 fixed to the intermediate supporting lower guide 32 respectively abut an opening/closing handle 53 and a fixing plate 55 of the intermediate supporting upper guide 31, and thus position the intermediate supporting upper guide 31 with respect to the intermediate supporting lower guide 32. The abutting plates 54 and 57 are formed from a magnetizable metal such as iron, the opening/closing handle 53 and the fixing plate 55 include magnet therein, and movement of the intermediate supporting upper guide 31 is regulated by a magnetic force. The opening/closing handle 53 is provided at a position that can be accessed when, for example, an opening/closing cover provided on the front side of a casing of the post-processing apparatus 4 is opened. Therefore, when a jam of sheet has occurred in the binding processing portion 4A, the user can open the opening/closing cover, grip the opening/closing handle 53, and thus open the intermediate supporting upper guide 31 to remove the jammed sheet.

To be noted, instead of the fixing mechanism using magnets, a snap fit mechanism in which a claw shape formed from a resin material is provided on one of the intermediate supporting upper guide 31 and the intermediate supporting lower guide 32 and a recess portion that engages with the claw shape is provided on the other guide may be used. In addition, as another example of a fixing mechanism, the relative movement between the intermediate supporting upper guide 31 and the intermediate supporting lower guide 32 may be regulated by providing a bar-like projection, that is, a dowel, on one of the intermediate supporting upper guide 31 and the intermediate supporting lower guide 32 and providing a hook that engages with this projection on the other guide.

As illustrated in FIG. 5, the post-processing apparatus 4 includes a longitudinal alignment motor M6, a jogger driving motor M7, a stapler moving motor M8, a binding motor M9, a guide driving motor M10, and a bundle discharge motor M11 mainly as drive sources related to the operation of the binding processing portion 4A. The longitudinal alignment motor M6 supplies a driving force that causes the longitudinal alignment roller 33 to operate intermittently to rotate once at a time. The jogger driving motor M7 moves the lateral alignment jogger 58 in the sheet width direction. The stapler moving motor M8 moves the stapler 51 in the longitudinal alignment direction and the bundle discharge direction. The binding motor M9 causes the stapler 51 to perform the operation of binding a sheet bundle. The guide driving motor M10 drives the guide driving portion 35 to slide the bundle discharge guide 34. The bundle discharge motor M11 rotationally drives the bundle discharge rollers 36.

A drum unit driving motor M12 is provided as a driving portion that supplies, to the drum guide 61 and the kick-out rollers 29, a driving force for executing the rotation operation of the drum guide 61 and the conveyance of a sheet by the kick-out rollers 29. A drum control solenoid 85 controls the rotation operation of the drum guide 61 by switching on/off of drive transmission from the drum unit driving motor M12 to the drum guide 61.

Drum Unit

Next, a configuration of the drum unit 60 serving as an example of a conveyance unit will be described in detail. The drum unit 60 includes the kick-out rollers 29 serving as conveyance members and the drum guide 61 serving as a guide member.

FIG. 11 is a section view of the drum unit 60 taken at the nip portion of the kick-out rollers 29 as viewed in the sheet width direction. FIGS. 12A to 12C are each a perspective view of the drum unit 60 as viewed in directions different from each other. To be noted, in FIG. 12A, illustration of a drum upper guide 61*b* that will be described later is omitted.

Figure 11A:
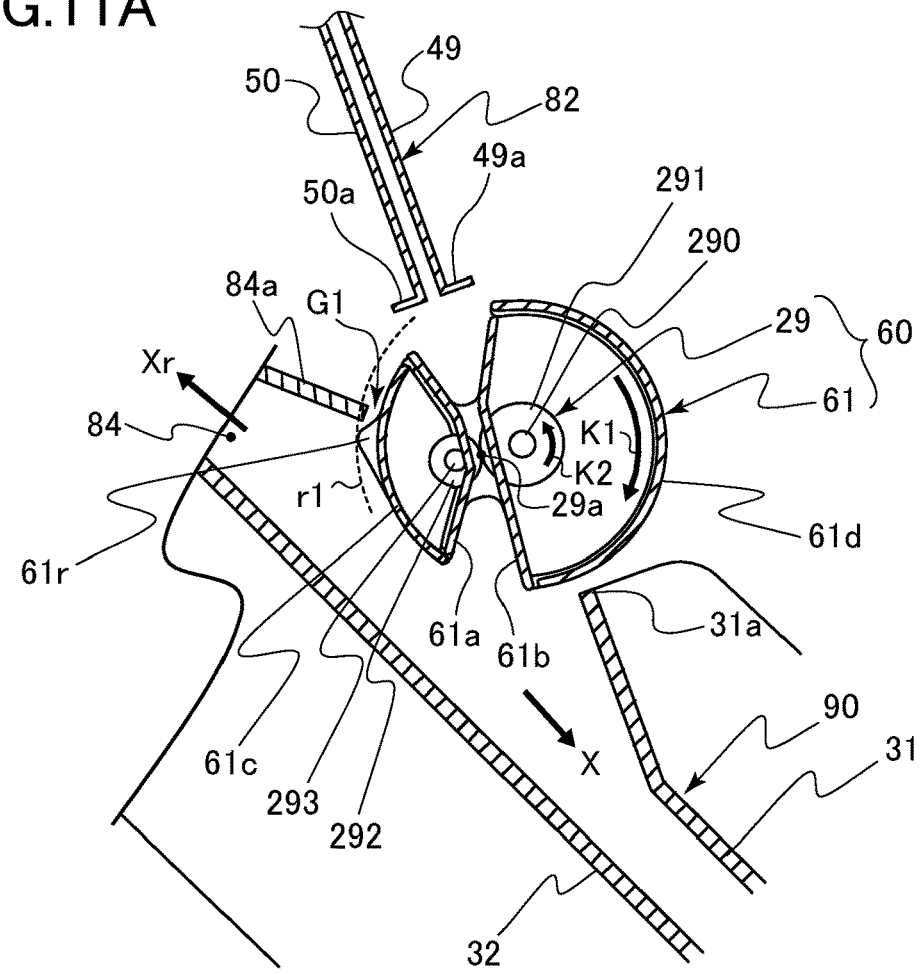
FIGS. 11A and 11B are each a section view of a drum unit according to the first exemplary embodiment.
Figure 12A:
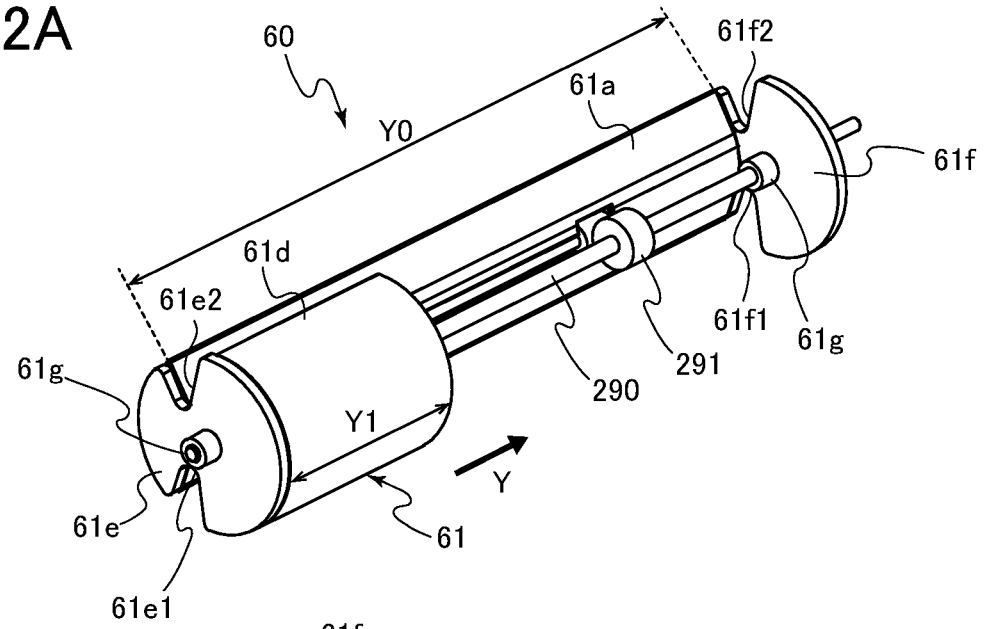
FIGS. 12A to 12C are each a perspective view of the drum unit according to the first exemplary embodiment.
Figure 12B:
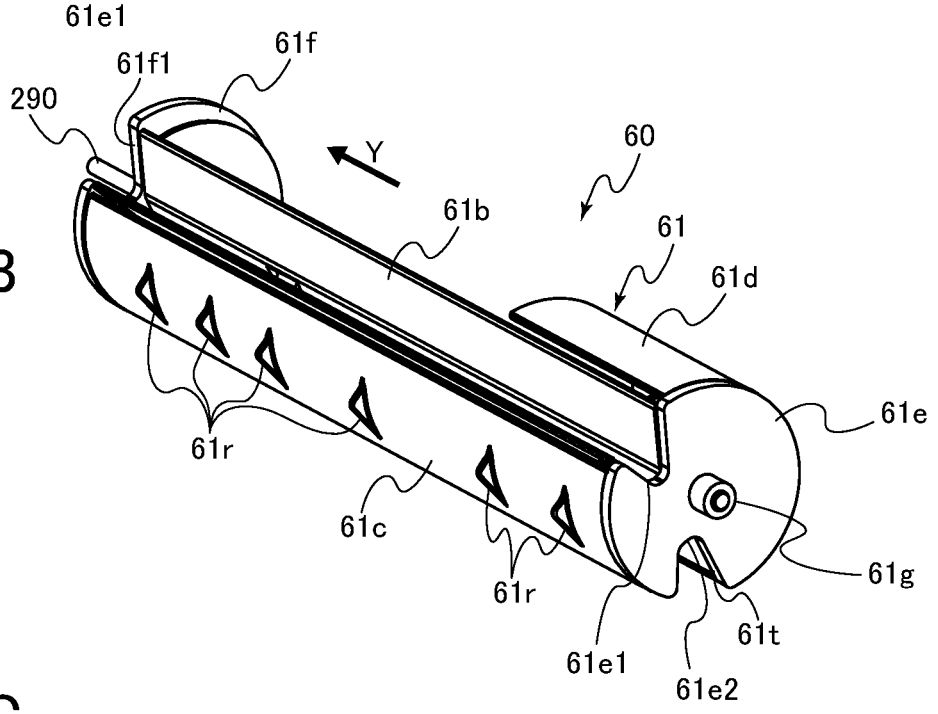
Figure 12C:
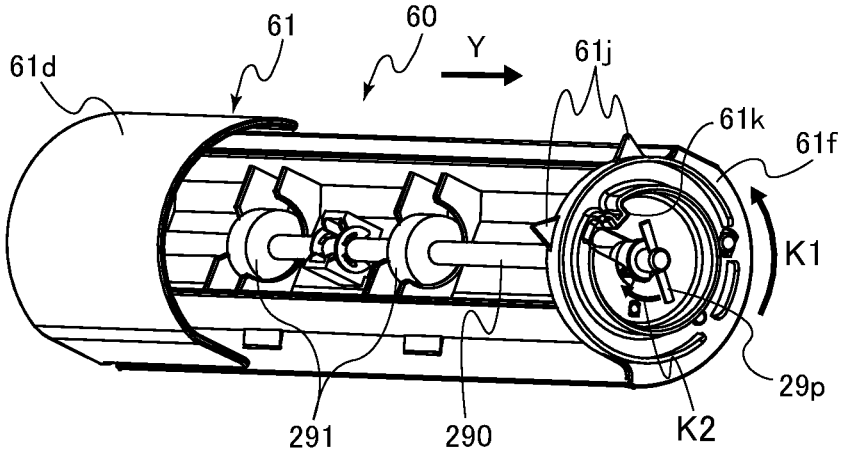

As illustrated in FIG. 11A, the kick-out rollers 29 are constituted by a kick-out driving roller 291 and a kick-out driven roller 292 that is rotationally driven by the rotation of the kick-out driving roller 291. In the description below, the kick-out driving roller 291 and the kick-out driven roller 292 will be simply referred to as a driving roller 291 and a driven roller 292. The driving roller 291 is attached to a driving shaft 290, and the driven roller 292 is supported by a driven shaft 293. The driving roller 291 serves as a first roller of the present exemplary embodiment which rotates by receiving supply of a driving force from the drum unit driving motor M12 illustrated in FIG. 5 serving as a drive source, that is, a driving portion. The driven roller 292 serves as a second roller of the present exemplary embodiment that forms a nip portion 29*a* by abutting the driving roller 291 and is rotationally driven by the rotation of the driving roller 291, that is, follows the rotation of the driving roller 291. In the nip portion 29*a*, a sheet is conveyed while being nipped between the driving roller 291 and the driven roller 292.

Meanwhile, as illustrated in FIGS. 11A and 12A to 12C, the drum guide 61 is a guide member having an approximate cylindrical shape extending in the sheet width direction in the nip portion 29*a* of the kick-out rollers 29, that is, in the axial direction of the kick-out rollers 29. The drum guide 61 is rotatable about a rotation axis extending in the sheet width direction. In the description below, the sheet width direction in the nip portion 29*a* of the kick-out rollers 29, that is, the rotation axis direction of the drum guide 61, will be referred to as a lengthwise direction Y of the drum unit 60.

The drum guide 61 includes a drum lower guide 61*a*, a drum upper guide 61*b*, a drum lower cover 61*c*, and a drum upper cover 61*d*. The drum guide 61 of the present exemplary embodiment rotates in a predetermined rotation direction K1 about a rotation axis coaxially provided with the driving roller 291. This rotation direction K1 is opposite to the rotation direction of the driving roller 291 conveying a sheet, that is, a roller driving direction K2.

The drum lower guide 61*a* is a guide serving as a first guide portion of the present exemplary embodiment that guides a vertically lower surface of the sheet conveyed by the kick-out rollers 29, that is, a surface of the sheet facing the intermediate supporting lower guide 32 in the intermediate supporting portion 90. The drum upper guide 61*b* is a guide serving as a third guide portion of the present exemplary embodiment that guides a vertically upper surface of the sheet conveyed by the kick-out rollers 29, that is, a second surface opposite to a first surface in the case where the lower surface of the sheet is the first surface. The drum lower guide 61*a* and the drum upper guide 61*b* constitute an in-drum conveyance path passing through the nip portion 29*a* of the kick-out rollers 29 in the drum unit 60 as viewed in the lengthwise direction Y. That is, the present exemplary embodiment is an example of a configuration in which the nip portion 29*a* of the kick-out rollers 29 is positioned within a region surrounded by a rotation trajectory drawn by the drum lower cover 61*c* when the drum guide 61 rotates.

In the description below, a position of the drum unit 60 in which the drum unit 60 is capable of receiving a sheet from the in-body discharge path 82 will be referred to as a home position of the drum unit 60. When the drum unit 60 is in the home position, one opening portion of the in-drum conveyance path faces an opening defined by downstream ends 49*a* and 50*a* of an intermediate conveyance upper guide 49 and an intermediate conveyance lower guide 50. In addition, when the drum unit 60 is in the home position, the other opening portion of the in-drum conveyance path faces a space between the intermediate supporting lower guide 32 and the intermediate supporting upper guide 31 of the intermediate supporting portion 90.

The drum lower cover 61*c* and the drum upper cover 61*d* constitute an outer peripheral portion of the drum guide 61 about the rotation axis of the driving roller 291. The drum lower cover 61*c* and the drum upper cover 61*d* of the present exemplary embodiment are each formed in an approximate arcuate shape about the rotation axis of the driving roller 291, and extend in the lengthwise direction Y as illustrated in FIGS. 12A and 12B.

The drum lower cover 61*c* is a guide serving as a second guide portion of the present exemplary embodiment that faces the intermediate supporting lower guide 32 in a state in which the drum unit 60 is in the home position. The drum lower cover 61*c* has a function of pressing the trailing end of a sheet supported on the intermediate supporting portion 90 from above after the rotation operation of the drum unit 60. The drum upper cover 61*d* is a guide serving as a fourth guide portion of the present exemplary embodiment that faces the upper surface of the sheet in the course of the drum unit 60 rotating from the home position in the rotation direction K1 and the drum lower cover 61*c* facing the upper surface of the sheet.

In other words, when the drum unit 60 is in the home position, the drum lower cover 61*c* and the drum lower guide 61*a* are positioned below the in-drum conveyance path, that is, on the lower-left side in FIG. 11B. In addition, when the drum unit 60 is in the home position, the drum upper cover 61*d* and the drum upper guide 61*b* are positioned above the in-drum conveyance path, that is, on the upper-right side in FIG. 11B.

As illustrated in FIGS. 12A and 12B, side plates 61*e* and 61*f* are provided at respective end portions of the drum unit 60 in the lengthwise direction Y. The drum lower guide 61*a*, the drum lower cover 61*c*, the drum upper guide 61*b*, and the drum upper cover 61*d* are supported by the side plates 61*e* and 61*f*. In addition, the side plates 61*e* and 61*f* are each provided with a bearing 61*g* that the driving shaft 290 penetrates. That is, the drum guide 61 is rotatably supported with respect to the driving shaft 290 via the bearings 61*g*. In other words, the drum lower guide 61*a*, the drum lower cover 61*c*, the drum upper guide 61*b*, and the drum upper cover 61*d* are rotatably supported by the side plates 61*e* and 61*f* serving as holding portions with respect to the axial center of the driving shaft 290 serving as the rotation axis of the present exemplary embodiment.

The side plates 61*e* and 61*f* respectively include downstream cutouts 61*e*1 and 61*f*1 and respectively include upstream cutouts 61*e*2 and 61*f*2. The downstream cutouts 61*e*1 and 61*f*1 are recess shapes recessed from the downstream side toward the upstream side in the sheet conveyance direction of the kick-out rollers 29 as viewed in the lengthwise direction Y, that is, the rotation axis direction of the drum guide 61. These recess shapes serve as first recess portions. The upstream cutouts 61*e*2 and 61*f*2 are recess shapes recessed from the upstream side toward the downstream side in the sheet conveyance direction of the kick-out rollers 29 as viewed in the lengthwise direction Y, that is, the rotation axis direction of the drum guide 61. These recess shapes serve as second recess portions. The effects of the downstream cutouts 61*e*1 and 61*f*1 and the upstream cutouts 61*e*2 and 61*f*2 will be described in detail in a fourth exemplary embodiment that will be described later. Ignoring the downstream cutouts 61*e*1 and 61*f*1 and the upstream cutouts 61*e*2 and 61*f*2, the side plates 61*e* and 61*f* of the present exemplary embodiment are each a member having an approximate disk chape centered on the rotation axis of the drum guide 61.

Meanwhile, the driven shaft 293 illustrated in FIG. 11A is rotatably supported by an unillustrated bearing provided on the drum lower guide 61*a*. Therefore, the driven roller 292 is configured to rotate once around the driving roller 201 when the drum unit 60 rotates once.

As viewed in the lengthwise direction Y of the drum unit 60, the driving shaft 290 to which the driving roller 291 is attached is disposed in a space enclosed by the drum upper guide 61*b* and the drum upper cover 61*d*. A part of the outer peripheral portion of the driving roller 291 is exposed to the in-drum conveyance path through an opening portion defined in the drum upper guide 61*b*. Similarly, the driven shaft 293 to which the driven roller 292 is attached is disposed in a space enclosed by the drum lower guide 61*a* and the drum lower cover 61*c* as viewed in the lengthwise direction Y of the drum unit 60. A part of the outer peripheral portion of the driven roller 292 is exposed to the in-drum conveyance path through an opening portion defined in the drum lower guide 61*a*, and abuts the driving roller 291.

Details of Drum Guide

Details of the shape of the drum guide 61 will be described. In the description below, the shapes and positional relationships between portions constituting the drum guide 61 will be described for a state in which the drum unit 60 is in the home position as illustrated in FIGS. 11A and 11B.

Figure 11B:
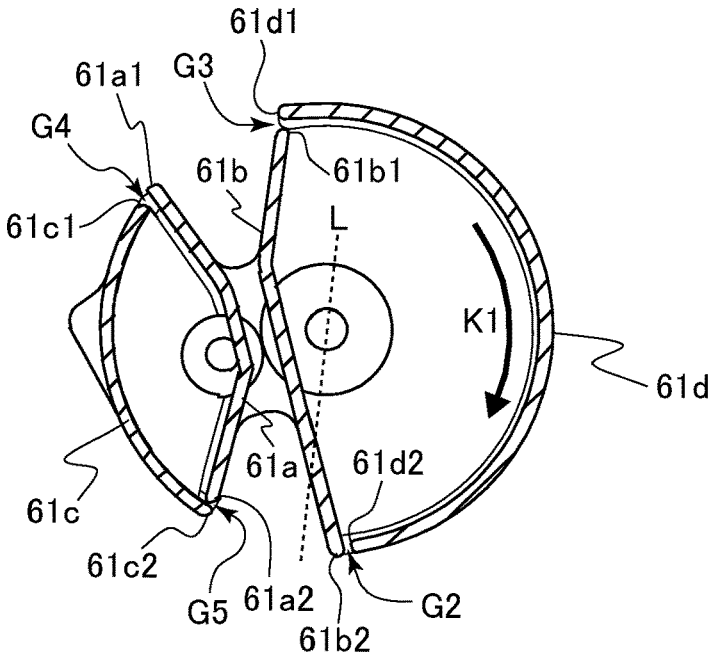

As illustrated in FIGS. 11A and 11B, the drum lower guide 61*a* and the drum upper guide 61*b* are disposed such that the width of the in-drum conveyance path increases toward the upstream end in a conveyance direction X as viewed in the lengthwise direction Y of the drum unit 60. That is, the distance between the drum lower guide 61*a* and the drum upper guide 61*b* in a direction intersecting with the conveyance direction X, that is, in an inter-shaft direction of the kick-out rollers 29, in an area upstream of the rotation axis of the drum unit 60 in the conveyance direction X is larger at a position closer to the upstream end of the in-drum conveyance path. By widening the upstream portion of the in-drum conveyance path as described above, the possibility of the leading end of the sheet discharged from the in-body discharge path 82 getting caught by the drum lower cover 61*c* or the drum upper cover 61*d* can be lowered.

Similarly, the drum lower guide 61*a* and the drum upper guide 61*b* are disposed such that the width of the in-drum conveyance path increases toward the downstream end in the conveyance direction X. That is, the distance between the drum lower guide 61*a* and the drum upper guide 61*b* in the direction crossing the conveyance direction X in an area downstream of the rotation axis of the drum unit 60 in the conveyance direction X is larger at a position closer to the downstream end of the in-drum conveyance path. By widening the downstream portion of the in-drum conveyance path as described above, the trailing end of the sheet can be smoothly moved out of the drum guide 61 in the rotation operation of the drum unit 60 that will be described later.

In addition, in the area downstream of the rotation axis of the drum unit 60 in the conveyance direction X, the drum upper guide 61*b* extends in a direction inclined with respect to a straight line L passing through the rotation axis of the drum unit 60. The drum upper guide 61*b* is inclined in such a direction that a radially outward portion thereof with respect to the rotation axis of the drum unit 60 is more upstream in the rotation direction K1 of the drum unit 60. By inclining the downstream portion of the drum upper guide 61*b* as described above, the trailing end of the sheet can be smoothly moved out of the drum guide 61 without the trailing end of the sheet getting caught by the drum upper guide 61*b* in the rotation operation of the drum unit 60 that will be described later.

Further, a downstream end 61*b*2 of the drum upper guide 61*b* extends toward the outer peripheral side of the drum unit 60 to such a position as to cover a downstream end 61*d*2 of the drum upper cover 61*d* as viewed in the tangential direction of the rotation direction K1 at the downstream end 61*b*2. As a result of this, the possibility of the trailing end of the sheet entering a gap G2 between the downstream end 61*b*2 of the drum upper guide 61*b* and the downstream end 61*d*2 of the drum upper cover 61*d* and getting caught by the drum guide 61 when the drum unit 60 rotates in the rotation direction K1 can be reduced.

Meanwhile, an upstream end 61*d*1 of the drum upper cover 61*d* extends upstream in the rotation direction K1 to a position approximately the same as an upstream end 61*b*1 of the drum upper guide 61*b* in an area further on the outer peripheral side than the upstream end 61*b*1 of the drum upper guide 61*b*. As a result of this, the possibility of the trailing end of the sheet entering a gap G3 between the upstream end 61*b*1 of the drum upper guide 61*b* and the upstream end 61*d*1 of the drum upper cover 61*d* and getting caught by the drum guide 61 when the drum unit 60 rotates in the rotation direction K1 can be reduced.

The drum lower guide 61*a* and the drum lower cover 61*c* have a similar configuration. That is, an upstream end 61*a*1 of the drum lower guide 61*a* extends toward the outer peripheral side of the drum unit 60 to such a position as to cover an upstream end 61*c*1 of the drum lower cover 61*c* as viewed in the tangential direction of the rotation direction K1 at the upstream end 61*a*1. In addition, a downstream end 61*c*2 of the drum lower cover 61*c* extends upstream in the rotation direction K1 to a position approximately the same as a downstream end 61*a*2 of the drum lower guide 61*a* in an area further on the outer peripheral side than the downstream end 61*c*2 of the drum lower guide 61*a*. As a result of this, the possibility of the trailing end of the sheet entering gaps G4 and G5 between the drum lower guide 61*a* and the drum lower cover 61*c* and getting caught by the drum guide 61 when the drum unit 60 rotates in the rotation direction K1 can be reduced.

Here, as illustrated in FIGS. 12A and 12B, the drum lower guide 61*a*, the drum upper guide 61*b*, and the drum lower cover 61*c* of the present exemplary embodiment are formed as surfaces extending in the lengthwise direction Y of the drum unit 60, that is, the sheet width direction. The length Y0 of these surfaces in the lengthwise direction Y is set such that a region where a sheet of the maximum width among sheets that can be conveyed by the post-processing apparatus 4 through the binding processing portion 4A passes through is covered. As a result of the drum lower guide 61*a* and the drum upper guide 61*b* having the length Y0 described above, the drum guide 61 can stably guide a sheet conveyed in the in-drum conveyance path regardless of the size of the sheet. In addition, as a result of the drum lower cover 61*c* having the length Y0 described above, the trailing end of the sheet supported on the intermediate supporting portion 90 can be pressed regardless of the size of the sheet, or even in the case where an end portion of the sheet in the width direction is curled up. The effect of the drum lower cover 61*c* pressing the trailing end of the sheet will be described later in detail.

Meanwhile, the drum upper cover 61*d* of the present exemplary embodiment is provided only in a region having a length Y1 provided in an end portion of the drum unit 60 on the same side as the lateral alignment standard plate 52 described above, that is, on the side opposite to the lateral alignment jogger 58, in the lengthwise direction Y of the drum unit 60. In addition, the region having the length Y1 extends to a position further on the inside in the width direction than a side end position of a sheet having the smallest width among sheets that can be conveyed by the post-processing apparatus 4 through the binding processing portion 4A. This is because the rotation operation of the drum guide 61 and the alignment operation by the lateral alignment jogger 58 can be smoothly performed in parallel as will be described later even in the case where the drum upper cover 61*d* does not have the length Y0 like the drum lower cover 61*c*.

Figure 14:
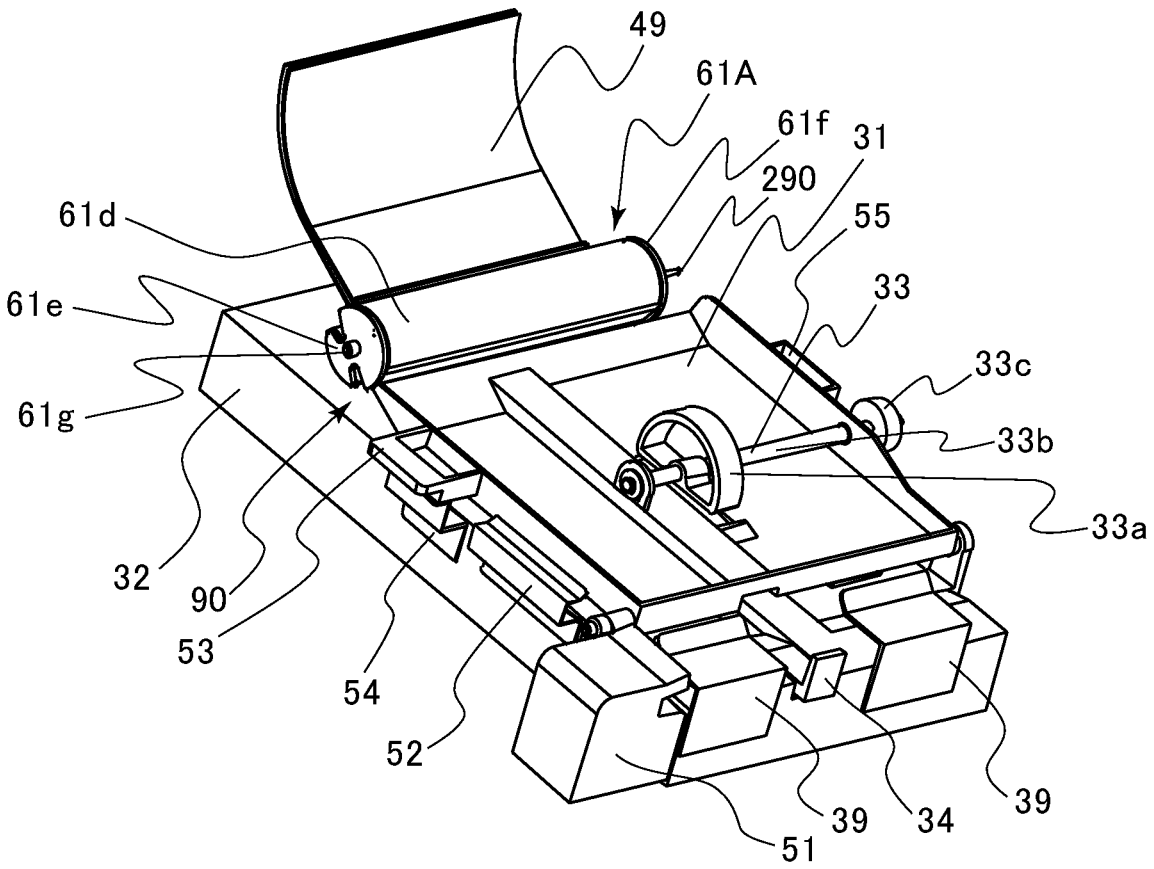
FIG. 14 is a perspective view of a binding processing portion according to a modification example.

To be noted, as in a modification example illustrated in FIG. 14, the drum upper cover 61*d* may have a length approximately equal to that of the drum lower cover 61*c* in the lengthwise direction Y, that is, approximately the total length of the drum unit 60.

As illustrated in FIGS. 11A and 12B, the drum lower cover 61*c* is provided with a plurality of ribs 61*r* projecting toward the outer peripheral side of the drum guide 61 and extending in the circumferential direction of the drum unit 60. When a sheet bundle supported on the intermediate supporting portion 90 and having undergone the binding process as necessary is conveyed in a bundle discharge direction Xr toward the bundle discharge rollers 36 illustrated in FIG. 1, these ribs 61*r* function as a guide for smoothly passing the sheet bundle over to the second discharge path 84. To be noted, as described above, a sheet or a sheet bundle supported on the intermediate supporting portion 90 is pushed out of the intermediate supporting portion 90 in the bundle discharge direction Xr by a bundle discharge guide 34 serving as a push-out member.

When the drum unit 60 is in the home position as illustrated in FIG. 11A, the ribs 61*r* are positioned upstream of an upper guide 84*a* of the second discharge path 84 in the bundle discharge direction Xr of the sheets in the second discharge path 84. In addition, as a result of the ribs 61*r* being provided downstream of a gap G1 between the drum lower cover 61*c* and the upper guide 84*a* as viewed in the lengthwise direction Y of the drum unit 60, the ribs 61*r* suppress the leading end of the sheet bundle in the bundle discharge direction Xr entering the gap G1.

To be noted, it is preferable that the amount of projection of the ribs 61*r* is set such that a rotation trajectory r1 of the ribs 61*r* drawn when the drum unit 60 rotates intersects with the upper guide 84*a* and a cutout that allows passage of the ribs 61*r* therethrough is provided in the upper guide 84*a*. As a result of this, the possibility of part of the sheet bundle entering the gap G1 can be reduced more.

Driving Configuration of Drum Unit

Next, a driving configuration of the drum unit 60 will be described. As described above, the drum guide 61 constituting the drum unit 60 and the driving roller 291 of the kick-out rollers 29 are coaxially provided, and the drum guide 61 is relatively rotatable with respect to the driving roller 291. In the present exemplary embodiment, a configuration in which the drum guide 61 and the driving roller 291 are both driven by the drum unit driving motor M12, which is a shared drive source, is employed.

FIG. 12C is a perspective view of a drive input configuration for the drum unit 60 to receive a driving force from the drum unit driving motor M12. An engagement pin 29*p* is inserted, in a direction intersecting with the lengthwise direction Y, in an end portion of the driving shaft 290 of the driving roller 291 in the lengthwise direction Y of the drum unit 60. In addition, a key 61*k* for key engagement is formed in the side plate 61*f* of the drum guide 61. The engagement pin 29*p* and the key 61*k* are provided in end portions on the same side of the drum unit 60 in the lengthwise direction Y.

Figure 13A:
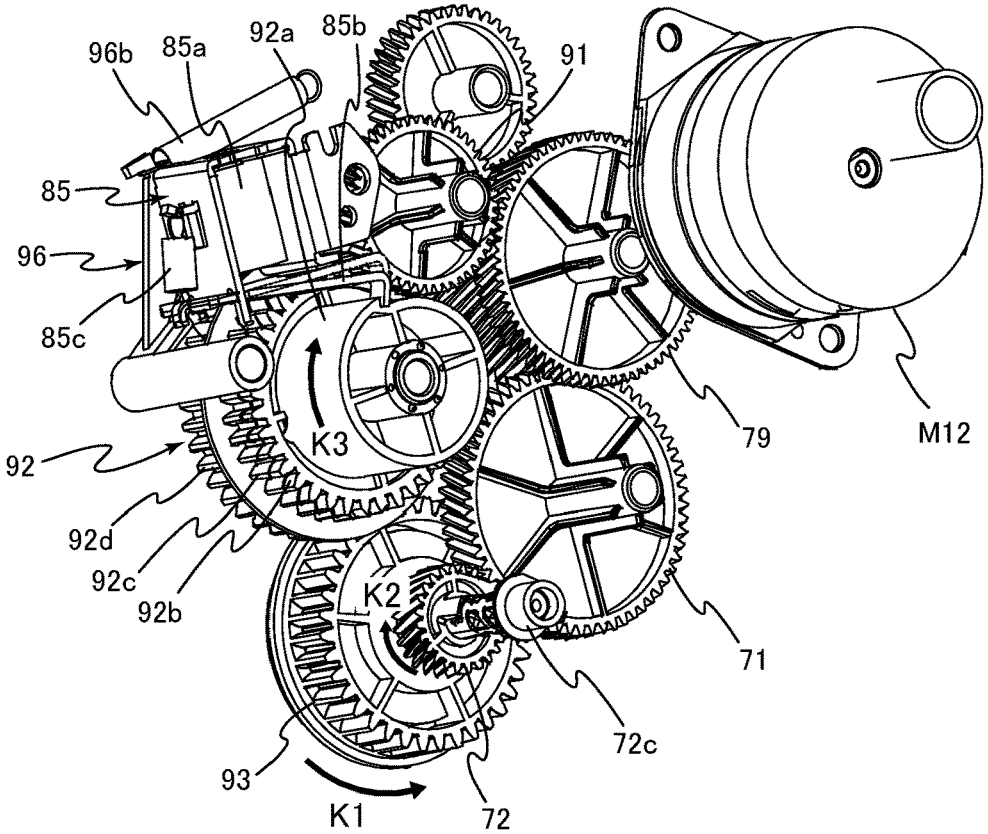
FIGS. 13A and 13B are diagrams for describing a driving configuration of the drum unit according to the first exemplary embodiment.
Figure 13B:
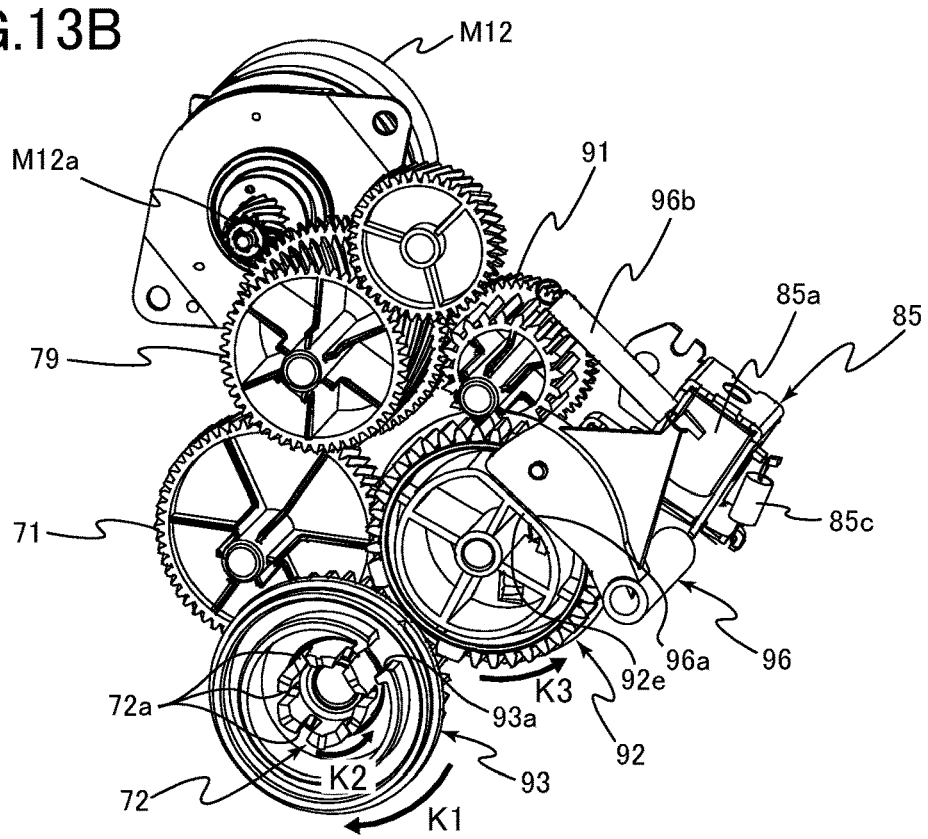

FIGS. 13A and 13B are perspective views of a drive transmission mechanism for the drum unit 60 incorporated in the post-processing apparatus 4. FIG. 13A illustrates the drive transmission mechanism as viewed from the outside in the lengthwise direction Y of the drum unit 60, and FIG. 13B illustrates the drive transmission mechanism as viewed from the inside, that is, the same side as the drum unit 60, in the lengthwise direction Y.

As illustrated in FIG. 13B, this drive transmission mechanism includes a first output gear 72 and a second output gear 93 as output members for outputting the driving force from the drum unit driving motor M12. The first output gear 72 includes an engagement groove 72*a* that engages with the engagement pin 29*p* of the driving shaft 290, and integrally rotates with the driving shaft 290 in a state in which the engagement pin 29*p* is engaged with the engagement groove 72*a*. The second output gear 93 includes a key groove 93*a* that engages with the key 61*k* of the drum guide 61, and integrally rotates with the drum guide 61 in a state in which the key 61*k* is engaged with the key groove 93*a*. The first output gear 72 and the second output gear 93 are coaxially provided and supported by an output shaft 72*c* illustrated in FIG. 13A, and can relatively rotate with respect to each other.

To be noted, projections 61*j* are provided on the outer circumferential portion of the side plate 61*f* of the drum guide 61 as references for aligning the key 61*k* with the key groove 93*a* when attaching the drum unit 60 to the post-processing apparatus 4 by moving the drum unit 60 in the lengthwise direction Y. Meanwhile, a plurality of engagement grooves 72*a* are defined in radial directions such that the engagement pin 29*p* smoothly engages with an engagement groove 72*a* even when the drum unit 60 is attached without aligning the engagement pin 29*p* with an engagement groove 72*a*.

In FIGS. 13A and 13B, the driving force from the drum unit driving motor M12 is transmitted to the input gear 79 through the motor output shaft M12*a*, and then branched and transmitted to a transmission path to the first output gear 72 and a transmission path to the second output gear 93.

First, a transmission path between the input gear 79 and the first output gear 72 will be described. This transmission path serves as a first transmission portion. The input gear 79 is engaged with a first idler gear 71, and the first idler gear 71 is engaged with the first output gear 72. Therefore, the rotation of the drum unit driving motor M12 is transmitted through the input gear 79 and the first idler gear 71, and rotates the first output gear 72 in a roller driving direction K2. Then, the driving roller 291 of the kick-out rollers 29 is rotated in the roller driving direction K2 by rotation transmitted through an engagement portion between the engagement groove 72*a* and the engagement pin 29*p* illustrated in FIG. 12C. To be noted, the gear ratio of the gear train from the drum unit driving motor M12 to the first output gear 72 is set such that the peripheral speed of the driving roller 291 is equal to the sheet conveyance speed in the in-body discharge path 82, that is, the speed V2 described above.

Next, a transmission path from the input gear 79 to the second output gear 93 will be described. This transmission path serves as a second transmission portion. The input gear 79 is engaged with a second idler gear 91 in addition to the first idler gear 71, and the second idler gear 91 is capable of engaging with a first gear portion 92*b* and a second gear portion 92*c* of a rotation control gear unit 92. The rotation control gear unit 92 transmits the rotation received through the first gear portion 92*b* and the second gear portion 92*c* to the second output gear 93 through a third gear portion 92*d*.

Here, the timing of start of motion of the rotation control gear unit 92 is controlled by the drum control solenoid 85, and the rotation control gear unit 92 is configured to rotate once each time power is supplied to the drum control solenoid 85 in a state in which the drum unit driving motor M12 is rotating.

Specifically, the first gear portion 92*b* and the second gear portion 92*c* are configured as sector gears, and do not engage with the second idler gear 91 at initial positions illustrated in FIGS. 13A and 13B corresponding to the home position of the drum unit 60. The first gear portion 92*b* and the second gear portion 92*c* are relatively rotatable to a predetermined angle, and the first gear portion 92*b* receives an urging force in an arrow K3 direction from an unillustrated spring. In addition, an engagement portion 92*a* that engages with a hook portion 85*b* of the drum control solenoid 85 is provided on the first gear portion 92*b*. The hook portion 85*b* is formed from a metal plate attracted by a solenoid body 85*a*, and is urged by a restoration spring 85*c* in such a direction as to engage with the engagement portion 92*a*.

The third gear portion 92*d* is a member that integrally rotates with the second gear portion 92*c*, and includes a contact surface 92*e* that abuts a positioning member 96. The contact surface 92*e* is a surface obtained by cutting off a portion of a circle centered on the rotation axis of the third gear portion 92*d* to form a D-shape, and is provided in a phase corresponding to the home position of the drum unit 60. The positioning member 96 includes a positioning portion 96*a* that abuts the contact surface 92*e* of the third gear portion 93*d*, and the positioning portion 96*a* is urged by a positioning spring 96*b* to be pressed against the contact surface 92*e* to restrict the rotation of the third gear portion 92*d*.

In the case where the rotation operation of the drum unit 60 is not performed, power is not supplied to the drum control solenoid 85. In this case, the hook portion 85*b* is engaged with the engagement portion 92*a* as illustrated in FIG. 13A, and thus the first gear portion 92*b* is locked in the initial position and the rotation thereof in the arrow K3 direction is restricted. As a result of this, the state in which the second idler gear 91 is opposed to teeth-missing portions of the first gear portion 92*b* and the second gear portion 92*c* is maintained, and transmission of drive to the second output gear 93 is blocked. In addition, since the rotation of the third gear portion 92*d* is restricted by the positioning member 96 pressing the contact surface 92*e* of the third gear portion 92*d*, the second output gear 93 does not rotate. That is, the drum unit 60 is kept in the home position while power is not supplied to the drum control solenoid 85.

When starting the rotation operation of the drum unit 60, the finisher controller 400 of the post-processing apparatus 4 illustrated in FIG. 5 supplies power to the drum control solenoid 85 for a short time in a state in which the drum unit driving motor M12 is rotating. Then, the hook portion 85*b* is attracted to the solenoid body 85*a* and is separated from the engagement portion 92*a*, and thus the lock of the first gear portion 92*b* is released. The first gear portion 92*b* starts rotating in the arrow K3 direction by the urging force from the unillustrated spring, and continues rotating by engaging with the second idler gear 91. Further, when the first gear portion 92*b* rotates to a predetermined angle with respect to the second gear portion 92*c*, stoppers provided on the first gear portion 92*b* and the second gear portion 92*c* engage with each other, and the first gear portion 92*b* and the second gear portion 92*c* start integrally rotating in the arrow K3 direction. The second gear portion 92*c* continues rotating by engaging with the second idler gear 91.

In accordance with this rotation of the second gear portion 92*c*, the third gear portion 92*d* rotates against the urging force of the positioning spring 96*b* while lifting up the positioning member 96. As a result of this, the second output gear 93 rotates in the rotation direction K1, and the drum unit 60 rotates in the rotation direction K1 via the engagement between the key groove 93*a* and the key 61*k* illustrated in FIG. 12C.

Then, when the first gear portion 92*b* rotates once and returns to the initial position, the engagement portion 92*a* engages with the hook portion 85*b* of the drum control solenoid 85 to which supply of power has been already finished, and thus the first gear portion 92*b* is locked in the initial position again. Then, when the second gear portion 92*c* returns to the initial position, the first gear portion 92*b* and the second gear portion 92*c* are both disengaged from the second idler gear 91. In addition, the positioning member 96 abuts the contact surface 92*e* of the third gear portion 92*d* again, and thus the drum unit 60 is positioned in the home position.

As described above, in the present exemplary embodiment, a configuration in which the drum guide 61 and the driving roller 291 are both driven by a driving force from the drum unit driving motor M12 serving as a shared drive source is employed. However, a motor for rotating the drum guide 61 and a motor for rotating the kick-out rollers 29 may be separately provided. In addition, the mechanism for controlling the drive transmission such that the drum unit 60 rotates once at a time is not limited to that described above, and the rotation once at a time may be realized by using a motor such as a stepping motor whose rotation amount can be highly precisely controlled and instructing a certain rotation amount to the motor.

Operation of Drum Unit

Next, the operation of the drum unit 60 when discharging and stacking sheets onto and on the intermediate supporting portion 90 will be described with reference to FIGS. 15A through 16C.

Figure 15A:
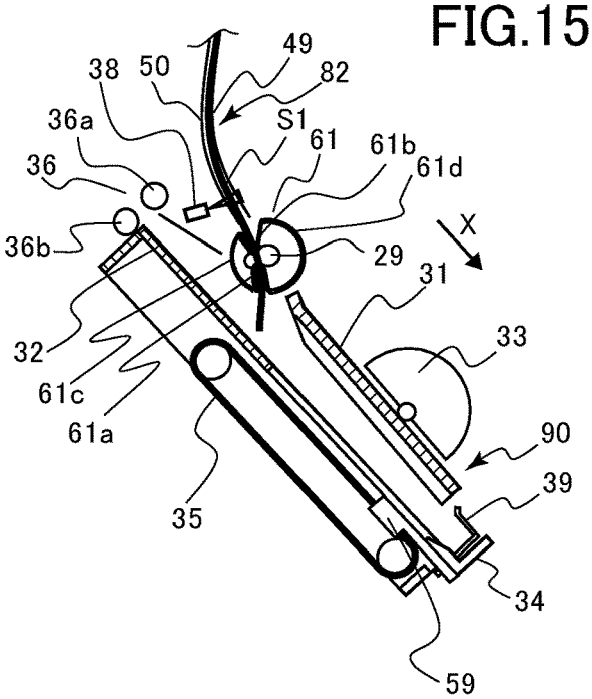
FIGS. 15A to 15C are diagrams for describing the operation of the binding processing portion according to the first exemplary embodiment.
Figure 15B:
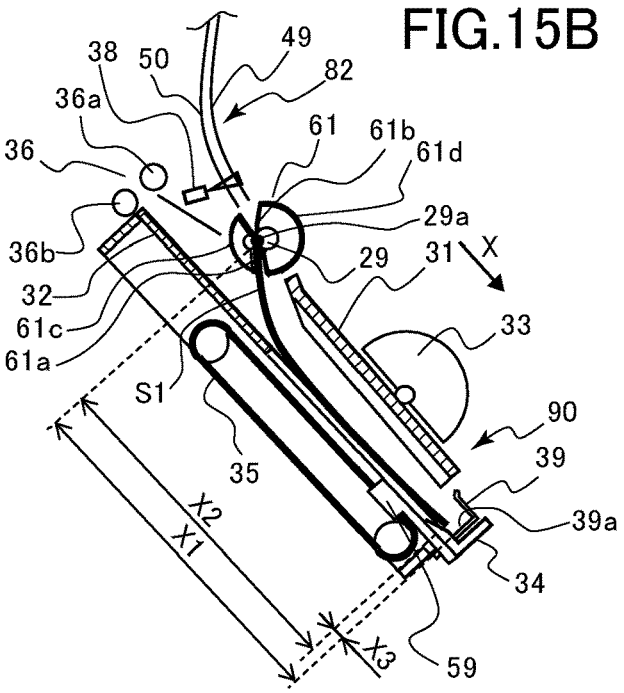

FIG. 15A illustrates a state at the start of discharge of a sheet S1 serving as the first sheet onto the intermediate supporting portion 90. At this time, the drum unit 60 is in the home position, and the kick-out rollers 29 have been rotationally driven since before receiving the sheet S1. The leading end of the sheet S1 having reached the drum unit 60 by being guided by the intermediate conveyance upper guide 49 and the intermediate conveyance lower guide 50 constituting the in-body discharge path 82 is conveyed in the conveyance direction X by the kick-out rollers 29. As a result of this, as illustrated in FIG. 15B, the leading end of the sheet S1 is delivered out from the in-drum conveyance path of the drum unit 60 toward the intermediate supporting portion 90, and is conveyed toward the longitudinal alignment standard plates 39 while sliding on the intermediate supporting lower guide 32. To be noted, the conveyance direction X is a direction in which the sheet delivered out by the kick-out rollers 29 moves along the intermediate supporting lower guide 32.

FIG. 15B illustrates a state immediately after the trailing end of the sheet S1 in the conveyance direction X has passed the nip portion 29*a* of the kick-out rollers 29. At this time, the drum unit 60 has not started the rotation operation yet.

Here, in FIG. 15B, X1 represents a distance from the longitudinal alignment standard surfaces 39*a*, which are surfaces of the longitudinal alignment standard plates 39 that the leading end of the sheet abuts, to the nip portion 29*a* of the kick-out rollers 29. Meanwhile, X2 represents the length of a portion of the sheet S1 having passed the nip portion 29*a* of the kick-out rollers 29. In the present exemplary embodiment, the longitudinal alignment standard plates 39 and the kick-out rollers 29 are arranged such that the distance X1 from the longitudinal alignment standard surfaces 39*a* to the nip portion 29*a* of the kick-out rollers 29 is larger than the sheet length X2. Therefore, in the state of FIG. 15B, the trailing end of the sheet S1 remains in the in-drum conveyance path in a state in which the lower surface thereof is supported by the drum lower guide 61*a* of the drum guide 61. In addition, there is a gap X3, which can be expressed as X3=X1−X2, between the leading end of the sheet S1 and the longitudinal alignment standard surfaces 39*a*.

Then, power is supplied to the drum control solenoid 85 after the elapse of a predetermined margin time since the time at which the trailing end of the sheet S1 passes the nip portion 29*a*, and thus the rotation operation of the drum unit 60 is started. The time at which the trailing end of the sheet S1 passes through the nip portion 29*a* can be determined on the basis of, for example, timing at which the pre-intermediate supporting sensor 38 has detected passage of the sheet S1 and the conveyance speed of the sheet S1 by the kick-out rollers 29.

Figure 15C:
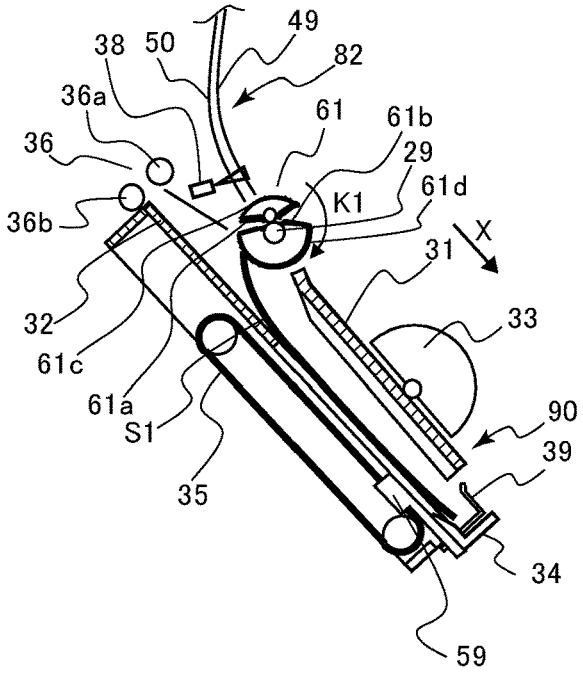

FIG. 15C illustrates a state in which the drum unit 60 has rotated by 90° in the rotation direction K1, which is a clockwise direction in FIG. 15C. As a result of the drum guide 61 rotating, the trailing end of the sheet S1 is pressed down by the drum upper guide 61*b*, and moves to a position between the drum upper cover 61*d* and the intermediate supporting lower guide 32. In addition, although the orientation of the nip portion 29*a* of the kick-out rollers 29 also changes in accordance with the rotation of the drum guide 61, since the trailing end of the sheet S1 has already passed through the nip portion 29*a*, the trailing end of the sheet S1 can be released from the in-drum conveyance path by being pressed by the drum upper guide 61*b*.

As described above, the drum upper guide 61*b* is inclined with respect to a plane passing through the rotation axis of the drum guide 61, that is, the axis of the driving roller 291, such that a portion thereof radially further on the outside is more upstream in the rotation direction K1. Therefore, the trailing end of the sheet S1 smoothly moves down without getting caught by the drum upper guide 61*b*. In addition, since the drum upper cover 61*d* is formed in an approximate arcuate shape centered on the rotation axis as viewed in the lengthwise direction Y, the trailing end of the sheet S1 being dragged by the drum upper cover 61*d* and the sheet S1 moving upstream in the conveyance direction X can be suppressed. Further, since gaps between the drum upper guide 61*b* and the drum upper cover 61*d* are arranged as described above, the trailing end of the sheet entering the gaps G2 and G3 illustrated in FIG. 11B can be suppressed.

In addition, after the start of the rotation operation of the drum unit 60, movement of the lateral alignment jogger 58 illustrated in FIG. 10B starts at a timing when the rotation amount exceeds a predetermined angle. This predetermined angle is set to a value large enough for the trailing end of the sheet S1 to be released from the in-body drum conveyance path. For example, the predetermined angle is set to 60°. As described above, by performing the rotation operation of the drum unit 60 and the alignment operation of the sheet S1 in the width direction by the lateral alignment jogger 58 in parallel at least partially, the throughput of the binding processing portion 4A can be improved.

Incidentally, the drum upper cover 61*d* of the present exemplary embodiment is provided only in a partial region in the width direction as illustrated in FIG. 10B. Although the drum upper cover 61*d* can be omitted, in this case, depending on the degree of curl of the sheet S1 or the like, the movement of the sheet can become unstable when performing the rotation operation of the drum unit 60 and the alignment operation by the lateral alignment jogger 58 in parallel. Specifically, when the lateral alignment jogger 58 moves the sheet S1 toward the lateral alignment standard plate 52, there is a possibility that a corner portion of the sheet, that is, a corner portion defined by the trailing end and a side edge of the sheet S1 on the lateral alignment standard plate 52 side, comes into contact with the side plate 61*e* of the drum guide 61 that is rotating. At this time, if the corner portion of the sheet S1 is caught by the bearing 61*g*, a joint portion 61*t* between the side plate 61*e* and the drum upper guide 61*b* illustrated in FIG. 12B, or the like, there is a possibility that the sheet S1 is damaged or stacking failure occurs.

However, since the drum upper cover 61*d* of the present exemplary embodiment is provided in an end portion region on the same side as the lateral alignment standard plate 52, the corner portion of the sheet does not come into contact with the bearing 61*g* or the joint portion 61*t* even when the lateral alignment jogger 58 is moved during execution of the rotation operation of the drum unit 60. Therefore, the behavior of the sheet can be stabilized while improving the throughput by performing the rotation operation of the drum unit 60 and the alignment operation by the lateral alignment jogger 58 in parallel. In addition, the cost can be reduced as compared with a modification example illustrated in FIG. 14 in which the drum upper cover 61*d* is formed in the entire region in the width direction.

Figure 16A:
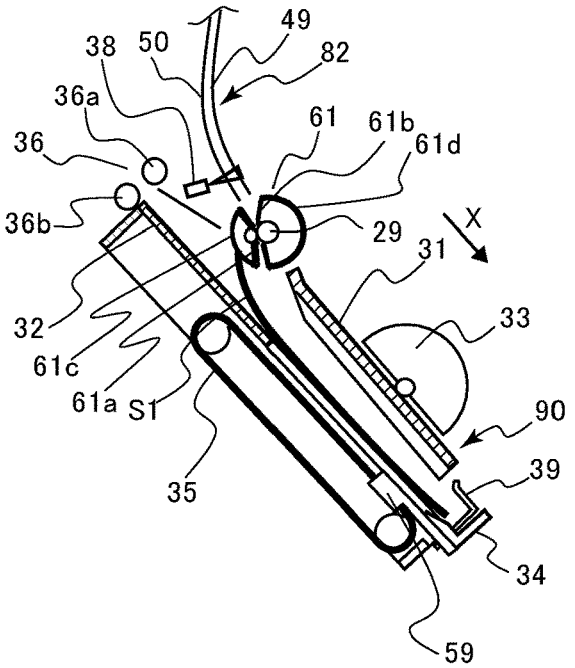
FIGS. 16A to 16C are diagrams for describing the operation of the binding processing portion according to the first exemplary embodiment.

FIG. 16A illustrates a state in which the drum unit 60 has rotated further by 270° from the state of FIG. 15C and has returned to the home position. As a result of the drum unit 60 rotating once and returning to the home position, it becomes possible for the drum unit 60 to receive a succeeding sheet succeeding the sheet S1 into the in-drum conveyance path.

Here, the drum unit 60 is configured such that the drum lower cover 61*c* is positioned above the trailing end of the sheet S1 so as to overlap with the trailing end of the sheet S1 in a state after the rotation operation. That is, when the drum unit 60 is in the home position, a distance X4 from the downstream end 61*a*3 of the drum lower guide 61*a*, that is, the downstream end of the drum lower cover 61*c*, to the longitudinal alignment standard surfaces 39*a* in the conveyance direction X is set to be smaller than the sheet length X2. In other words, the drum unit 60 and the longitudinal alignment standard plates 39 are arranged such that this relationship of length, that is, X4<X2 is satisfied. Therefore, in the state of FIG. 16A after the rotation operation of the drum unit 60, a trailing end portion of the sheet S1 and the drum guide 61 overlap by a length X5, which is the difference between the distance X4 and the sheet length X2. Therefore, lift-up of the trailing end of the sheet S1 can be more reliably restricted.

Figure 16B:
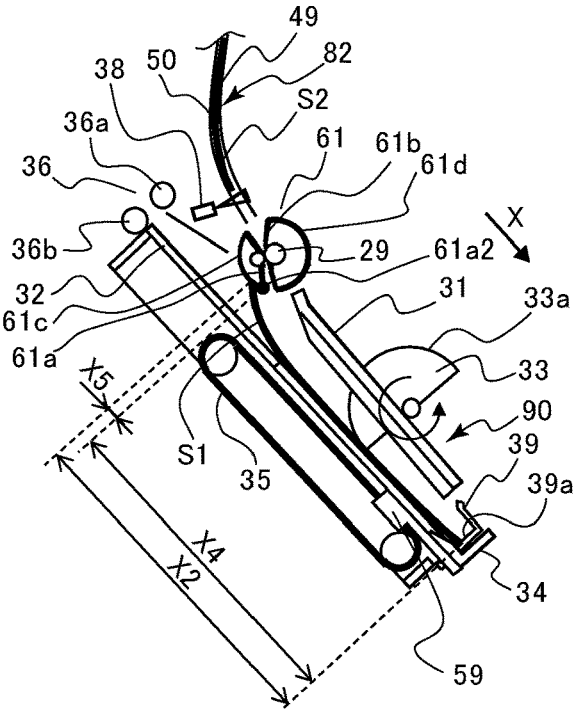

FIG. 16B illustrates a state after the rotation operation of the drum unit 60 has been finished, then the rotation of the longitudinal alignment roller 33 has started, and the longitudinal alignment roller 33 has rotated by 90° in the counterclockwise direction in FIG. 16B. At this time, the roller portion 33*a* constituting the outer circumferential surface of the longitudinal alignment roller 33 comes into contact with the sheet S1, and the sheet S1 is moved toward the longitudinal alignment standard surfaces 39*a* by the conveyance force received from the longitudinal alignment roller 33. In addition, a succeeding sheet S2 has been already conveyed toward the drum unit 60 from the in-body discharge path 82.

Figure 16C:
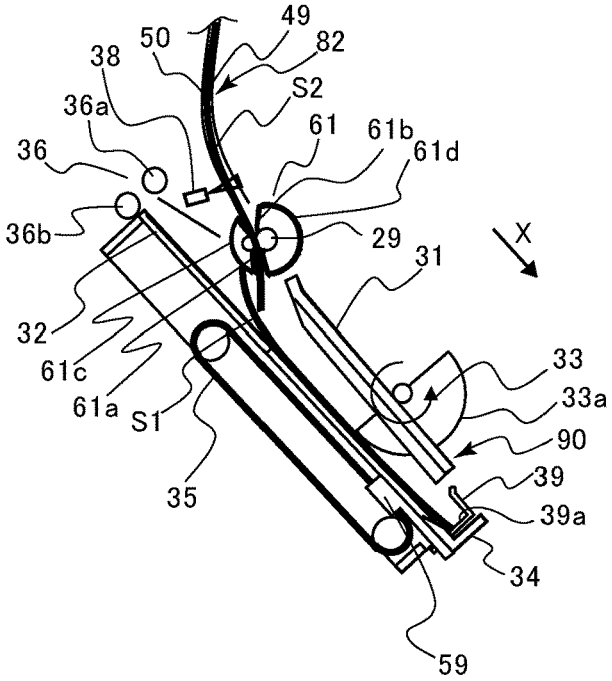

FIG. 16C illustrates a state immediately before the longitudinal alignment roller 33 further rotates by 180° from the state of FIG. 16B and the roller portion 33*a* is separated from the sheet S1. Normally, the leading end of the sheet S1 in the conveyance direction X is brought into contact with the longitudinal alignment standard surfaces 39*a* and the alignment of the sheet S1 in the longitudinal direction is completed before this time point. Then, the longitudinal alignment roller 33 further rotates by 90°, and thus the longitudinal alignment roller 33 returns to the position of FIG. 15A, which is a standby position.

At the time of FIG. 16C, the leading end of the succeeding sheet S2 has already passed through the nip portion 29*a* of the kick-out rollers 29 and been delivered out toward the intermediate supporting portion 90. At this time, the succeeding sheet S2 is conveyed while the lower surface thereof is guided by the drum lower guide 61*a* in a state in which the trailing end of the preceding sheet S1 is pressed by the drum lower cover 61*c*. That is, a region between the drum lower cover 61*c* and the intermediate supporting lower guide 32 where the trailing end of the preceding sheet S1 is present and a path through which the leading end of the succeeding sheet S2 passes, that is, a region over the drum lower guide 61*a*, are partitioned from each other by the drum guide 61.

Therefore, the leading end of the sheet S2 smoothly moves onto the intermediate supporting portion 90 without colliding with the trailing end of the sheet S1, and lands on the upper surface of the sheet S1. As a result of the collision between sheets being suppressed as described above, for example, the position of the sheet S1 being changed by being pushed by the sheet S2 and thus the neatness of the alignment of sheets being degraded, occurrence of damage to the trailing end of the sheet S1 or the leading end of the sheet S2 such as bending of a corner, and the like can be avoided.

To be noted, when the trailing end of the sheet S2 passes through the nip portion 29*a* of the kick-out rollers 29, the rotation operation of the drum unit 60 is performed again. As a result of this, the trailing end of the sheet S2 is pushed out downward from the in-drum conveyance path by the drum upper guide 61*b*, and is eventually held between the drum lower cover 61*c* and the intermediate supporting lower guide 32. In this state, the lower surface of the third sheet conveyed from the in-body discharge path 82 is guided by the drum lower guide 61*a*, and thus collision between the trailing end of the sheet S2 and the leading end of the third sheet is avoided.

After this, the rotation operation of the drum unit 60 is performed once each time one sheet passes through the nip portion 29*a* of the kick-out rollers 29. As a result of this, it becomes possible to avoid, when two sheets are sequentially conveyed in the in-body discharge path 82, the collision between the trailing end of a preceding sheet and the leading end of a succeeding sheet that is conveyed subsequently to the preceding sheet. To be noted, in the case of supporting, on the intermediate supporting portion 90, buffered sheets stacked by the buffering operation by the buffering portion 4B described above, the rotation operation of the drum unit 60 is performed after the trailing end of the final sheet has passed through the nip portion 29*a* of the kick-out rollers 29.

Operation Sequence of Binding Processing Portion

Figure 17:
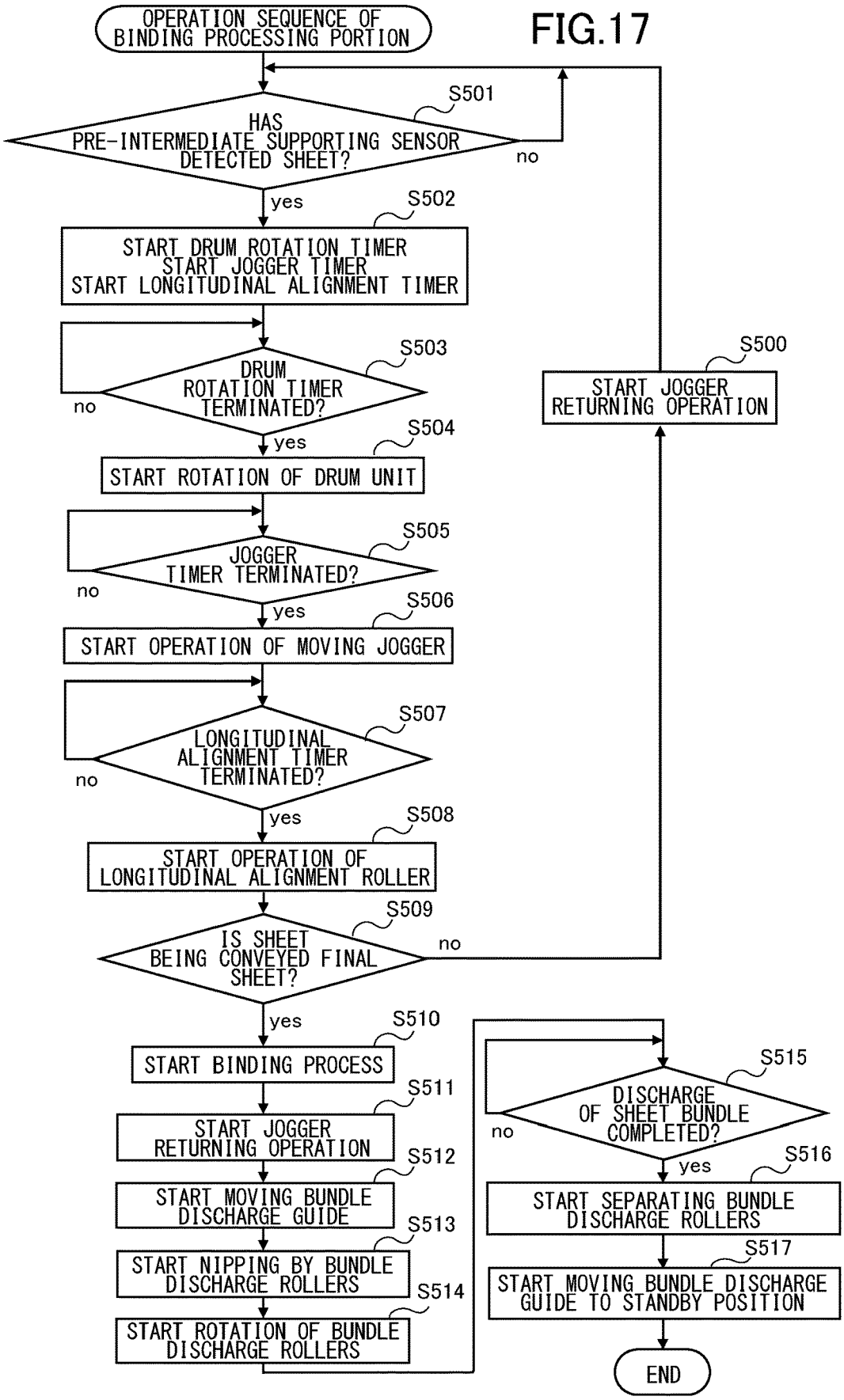
FIG. 17 is a flowchart illustrating an operation sequence of the binding processing portion according to the first exemplary embodiment.

An operation sequence of the binding processing portion that realizes the operation described above will be described with reference to a flowchart of FIG. 17. Each step of the flowchart is processed by the CPU 401 of the finisher controller 400 illustrated in FIG. 5 executing a program read from the memory 402. In addition, this operation sequence is started in the case where the finisher controller 400 has received, from the printer controller 100, a notification indicating that execution of an image formation job that requires a binding process by the binding processing portion 4A has been started.

In step S501, a standby state is taken while determining whether or not the pre-intermediate supporting sensor 38 has detected passage of a sheet in the in-body discharge path 82. When the pre-intermediate supporting sensor 38 detects the sheet, a drum rotation timer, a jogger timer, and a longitudinal alignment timer are set in step S502.

The termination time of the drum rotation timer is set to a timing after the trailing end of the sheet in the conveyance direction X has passed through the nip portion 29*a* of the kick-out rollers 29.

The termination time of the jogger timer is set to a timing when the rotation amount of the drum unit 60 after the start of the rotation operation reaches the predetermined amount, that is, a time obtained by adding a predetermined time to the termination time of the drum rotation timer. For example, the predetermined angle is 60°.

The termination time of the longitudinal alignment timer is set to a time later than the termination time of the jogger timer and later than completion of the alignment operation by the lateral alignment jogger 58.

In step S503, a standby state is taken while counting down the drum rotation timer. When the countdown is finished, power is supplied for a short time to the drum control solenoid 85 in step S504. As a result of this, the driving force of the drum unit driving motor M12 is transmitted to the drum guide 61, and the rotation operation of the drum unit 60 is started. In step S505, a standby state is taken while counting down the jogger timer. When the countdown is finished, in step S506, movement of the lateral alignment jogger 58 from the standby position toward the lateral alignment standard plate 52 is started, and thus the alignment operation in the lateral direction is started. In step S507, a standby state is taken while counting down the longitudinal alignment timer. When the countdown is finished, in step S508, the longitudinal alignment roller 33 is rotated once, and thus the alignment operation in the longitudinal direction is started.

In step S509, whether or not the current sheet is a final sheet, that is, whether or not the current sheet is the final sheet to be supported on the intermediate supporting portion 90 among sheets constituting the sheet bundle that has been subjected to a binding process is determined. In the case where the current sheet is not the final sheet, movement of the lateral alignment jogger 58 is started in step S500, and then the process returns to step S501 and the processing described above is repeated. In the case where the current sheet is the final sheet, the process proceeds to step S510.

In step S510, the binding process on the sheet bundle is performed by the stapler 51. In the case of binding a long side of the sheet bundle, a plurality of positions on the sheet bundle arranged along a side edge thereof are stapled by the stapler 51 while moving the stapler 51 by the stapler moving motor M8. When the binding process is finished, a returning operation of returning the lateral alignment jogger 58 to the standby position is started in step S511, and the bundle discharge guide 34 is moved in the bundle discharge direction in step S512. At this time, the drum unit 60 has already returned to the home position, and the leading end of the sheet bundle in the bundle discharge direction Xr is smoothly guided to the second discharge path 84 by the ribs 61*r* illustrated in FIG. 11A provided on the drum lower cover 61*c* described above.

When the leading end of a sheet bundle SB in the bundle discharge direction passes through the bundle discharge rollers 36 separated from each other, the bundle discharge guide 34 is temporarily stopped, and in step S513, an upper roller 36*a* is lowered such that the bundle discharge rollers 36 nip the sheet bundle SB. Then, the rotation of the bundle discharge rollers 36 is started in step S514, and the sheet bundle SB is discharged onto the lower discharge tray 37.

A standby state is taken in step S515 until the discharge of the sheet bundle SB is completed, and then in step S516, the upper roller 36*a* is lifted such that the bundle discharge rollers 36 are separated from each other again. In addition, in step S517, the bundle discharge guide 34 is moved in the longitudinal alignment direction to return the bundle discharge guide 34 to the standby position. When the bundle discharge guide 34 is back in the standby position, the operation sequence is completed.

Summary of Present Exemplary Embodiment

As described above, in the present exemplary embodiment, the rotation operation of the drum unit 60 serving as a guide member is performed after the trailing end of the preceding sheet has passed through the nip portion 29*a* of the kick-out rollers 29 serving as conveyance members. Then, after the rotation operation of the drum unit 60, the lower surface of the succeeding sheet is guidable by the drum lower guide 61*a* while the trailing end of the preceding sheet is held between the drum lower cover 61*c* and the intermediate supporting lower guide 32. That is, in the present exemplary embodiment, a configuration in which, by rotating a guide member after the trailing end of the preceding sheet has passed through a nip portion of a conveyance member, the trailing end of the preceding sheet is positioned between a second guide portion and a supporting portion and the lower surface of the succeeding sheet is made guidable by a first guide portion is employed. As a result of this, for example, even in the case where the trailing end of the preceding sheet is lifted up from the supporting portion due to curl of the sheet, collision between the trailing end of the preceding sheet and the leading end of the succeeding sheet can be more reliably avoided, and the sheet can be smoothly supported on the supporting portion.

Incidentally, as a substitute configuration for pressing the trailing end portion of the sheet discharged onto the supporting portion, a pressing member having a lever shape hanging down to a position below the nip portion from a pivot shaft provided above the nip portion of the roller pair is known. When the sheet is delivered out from the nip portion, such a pressing member retracts upward about the pivot shaft, and after the trailing end of the sheet passes through the nip portion, the pressing member pivots downward due to the weight thereof or a spring force, and presses the upper surface of the sheet. However, in the case where the curl of the sheet is large, there is a possibility that the pressing member is lifted up, and thus the trailing end of the preceding sheet supported on the supporting portion is lifted up and collides with the leading end of the succeeding sheet delivered out of the nip portion.

Particularly, when more sheets are stacked on the supporting portion, the pressing member becomes more likely to be lifted up by the curl of the large number of sheets. If the load to lift up the pressing member is configured to be large to address this, there is a possibility that a scratch mark is left on the sheet by the pressing member. In addition, if the height of the nip portion with respect to the supporting portion, that is, the distance between the supporting portion and the nip portion in the thickness direction of the sheets supported on the supporting portion, is increased as another method to address this, there is a possibility that the neatness of the alignment of sheets on the supporting portion is degraded or the size of the apparatus increases.

In contrast, in the present exemplary embodiment, a configuration in which a region where the trailing end of the preceding sheet is present and a path through which the leading end of the succeeding sheet passes are partitioned from each other is realized by a guide member that rotates. As a result of this, as compared with the case where the pressing member of a lever shape is used, the collision between the sheets can be more reliably avoided, and merits such as increase in the number of stackable sheets and reduction in the size of the apparatus can be obtained.

To be noted, although a configuration in which the drum unit 60 rotates about the driving shaft 290, which is the rotation shaft of one of the kick-out rollers 29 has been described in the present exemplary embodiment, a different configuration may be employed. For example, the drum unit 60 may be configured to rotate about the nip portion 29*a* of the kick-out rollers 29. In addition, the driven roller 292 of the kick-out rollers 29 may be rotatably supported by the frame member of the post-processing apparatus 4 such that the position of the driven roller 292 does not change even when the drum guide 61 rotates.

In addition, in the present exemplary embodiment, the drum unit 60 is configured to start rotating after the trailing end of the sheet has passed through the nip portion 29*a* of the kick-out rollers 29 as described with reference to FIGS. 15B and 15C and S502 to S504 of FIG. 17. However, the rotation of the drum unit 60 may be started before the trailing end of the sheet passes through the nip portion 29*a* of the kick-out rollers 29 to further improve the throughput. This modification example is realized by setting the termination time of the drum rotation time to a timing before the trailing end of the sheet passes through the nip portion 29*a* of the kick-out rollers 29 in step S502 of FIG. 17.

In the present exemplary embodiment, the rotational driving of the kick-out rollers 29 is continued also after the drum unit 60 has rotated. Therefore, the trailing end of the sheet is released from the nip portion 29*a* after the start of rotation of the drum unit 60, and thus a state in which the trailing end of the sheet is pressed by the drum lower cover 61*c* as illustrated in FIG. 16A is eventually realized. To be noted, to suppress the sheet getting caught, it is preferable that the angle of rotation from the start of rotation of the drum unit 60 to release of the trailing end of the sheet from the nip portion 29*a* is set to be equal to or smaller than a predetermined angle. For example, the predetermined angle is 30°.

Second Exemplary Embodiment

Next, a configuration of a post-processing apparatus according to a second exemplary embodiment will be described. The present exemplary embodiment is different from the first exemplary embodiment in the positional relationship between the kick-out rollers 29 and the drum guide 61. Other elements and effects approximately the same as in the first exemplary embodiment will be denoted by the same reference signs and description thereof will be omitted.

Figure 18:
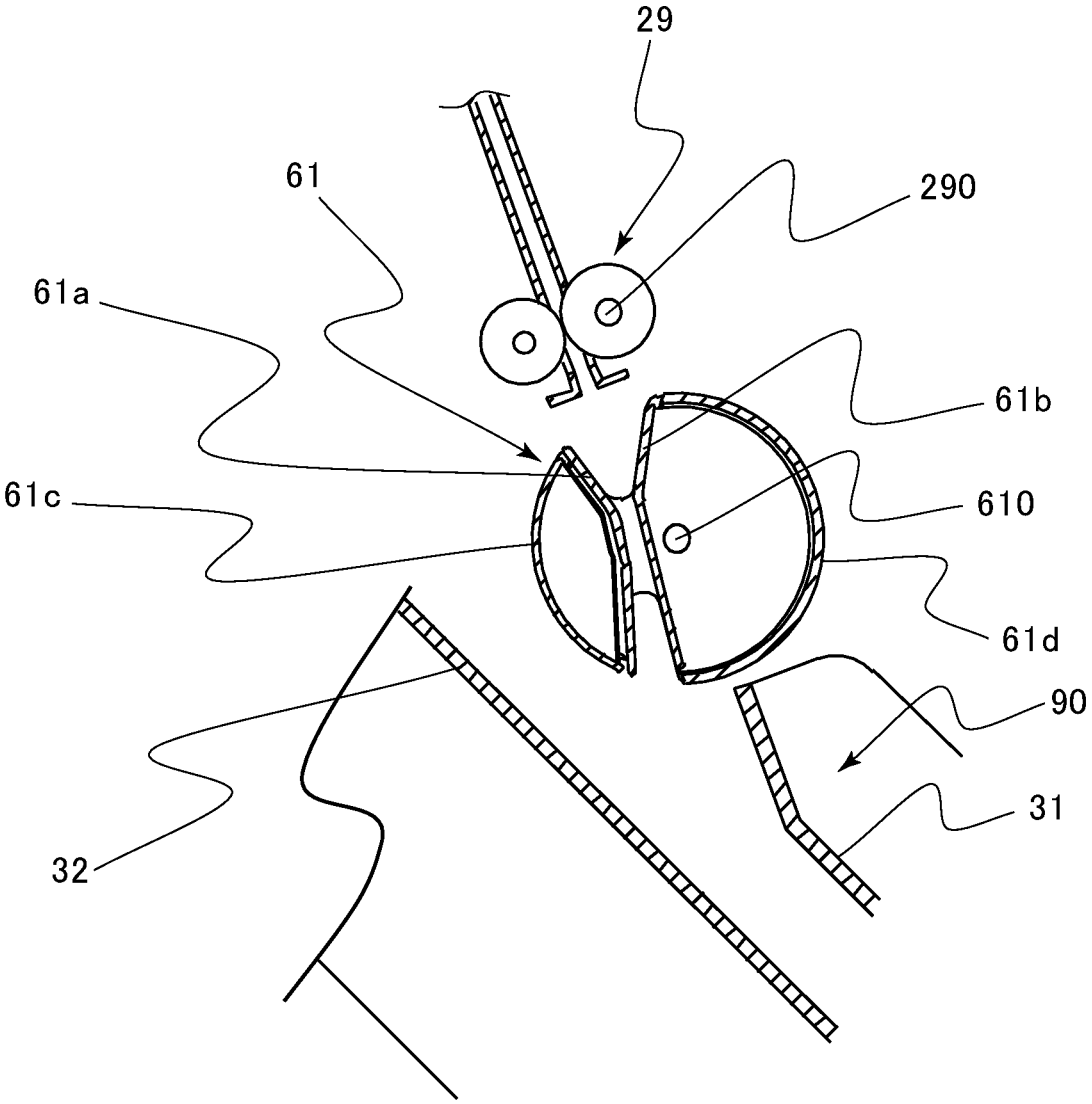
FIG. 18 is a section view of a drum unit according to a second exemplary embodiment.

FIG. 18 is a section view of the kick-out rollers 29 and the drum guide 61 as viewed in the lengthwise direction of the drum guide 61, that is, the axial direction of the kick-out rollers 29 and the width direction of the sheet. The kick-out rollers 29 of the present exemplary embodiment are disposed upstream of the drum guide 61 in the sheet conveyance direction of the kick-out rollers 29. In addition, the kick-out rollers 29 are supported by the frame member of the post-processing apparatus independently from the drum guide 61. In addition, the kick-out rollers 29 and the drum guide 61 are each driven by a different drive source.

The operation of the post-processing apparatus according to the present exemplary embodiment is the same as in the first exemplary embodiment except that the position of each roller of the kick-out rollers 29 does not change when the drum guide 61 rotates. That is, the rotation operation of rotating the drum guide 61 once is started after the trailing end of the preceding sheet has passed through the nip portion 29*a* of the kick-out rollers 29. As a result of this, the trailing end of the preceding sheet whose lower surface has been guided by the drum lower guide 61*a* is released from the in-drum conveyance path by being pressed downward by the drum upper guide 61*b*, and is eventually held between the drum lower cover 61*c* serving as a second guide portion and the intermediate supporting lower guide 32. In this state, the leading end of the succeeding sheet conveyed by the kick-out rollers 29 is guided by the drum upper guide 61*b*. Therefore, similarly to the first exemplary embodiment, collision between the trailing end of the preceding sheet and the leading end of the succeeding sheet can be more reliably avoided, and the sheet can be smoothly supported on the supporting portion.

To be noted, although the rotation operation of the drum unit 60 is performed one rotation at a time in the first and second exemplary embodiments described above, a configuration in which the rotation operation of the drum unit 60 is performed a half rotation at a time may be also employed. In this case, it is preferable that the drum lower guide 61*a* and the drum upper guide 61*b* are formed in shapes that are rotationally symmetrical to each other with respect to the rotation axis of the drum unit 60, and the same is true for the drum lower cover 61*c* and the drum upper cover 61*d*. Further, when the drum lower guide 61*a* is facing the lower surface of the sheet before the start of the rotation operation, the upper surface of the sheet is pressed by the drum upper cover 61*d* by rotating the drum guide 61 by 180° by the rotation operation. Similarly, when the drum upper guide 61*b* is facing the lower surface of the sheet before the start of the rotation operation, the upper surface of the sheet is pressed by the drum lower cover 61*c* by rotating the drum guide 61 by 180° by the rotation operation. In this case, the rotationally symmetrical pair of the drum lower guide 61*a* and the drum upper guide 61*b* function as a first guide portion, and the rotationally symmetrical pair of the drum lower cover 61*c* and the drum upper cover 61*d* function as a second guide portion.

Third Exemplary Embodiment

Next, a configuration of a post-processing apparatus according to a third exemplary embodiment will be described. The present exemplary embodiment is different from the first exemplary embodiment in that a guide having a different shape from the drum guide 61 described above is used. Other elements and effects approximately the same as in the first exemplary embodiment will be denoted by the same reference signs and description thereof will be omitted.

Figure 19A:
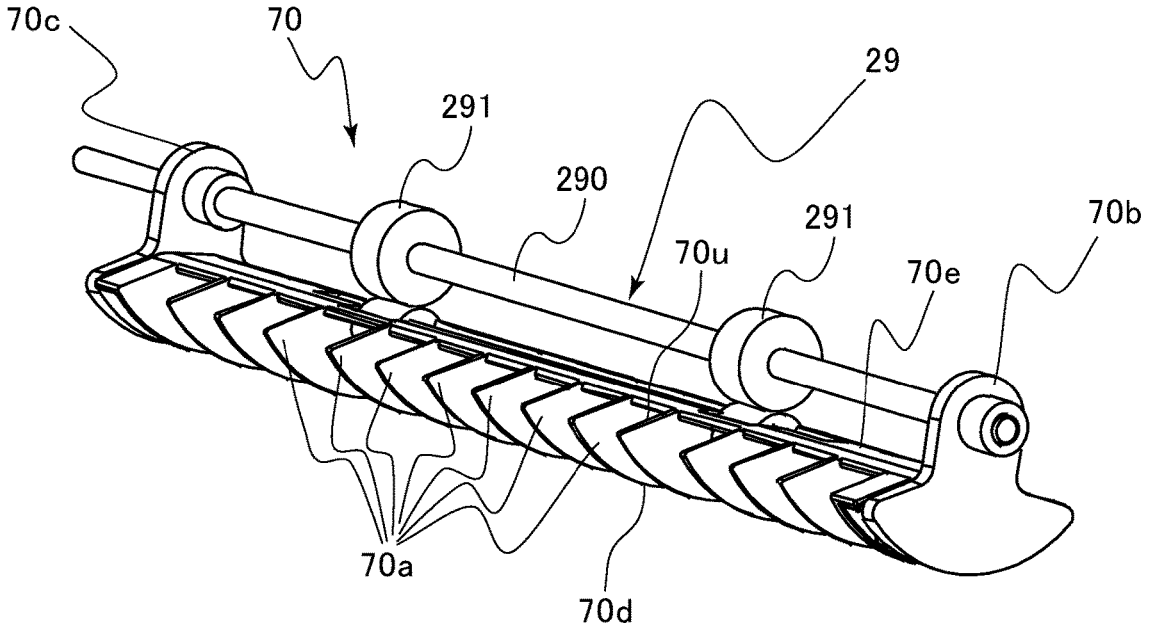
FIG. 19A is a perspective view of a guide unit according to a third exemplary embodiment.
Figure 19B:
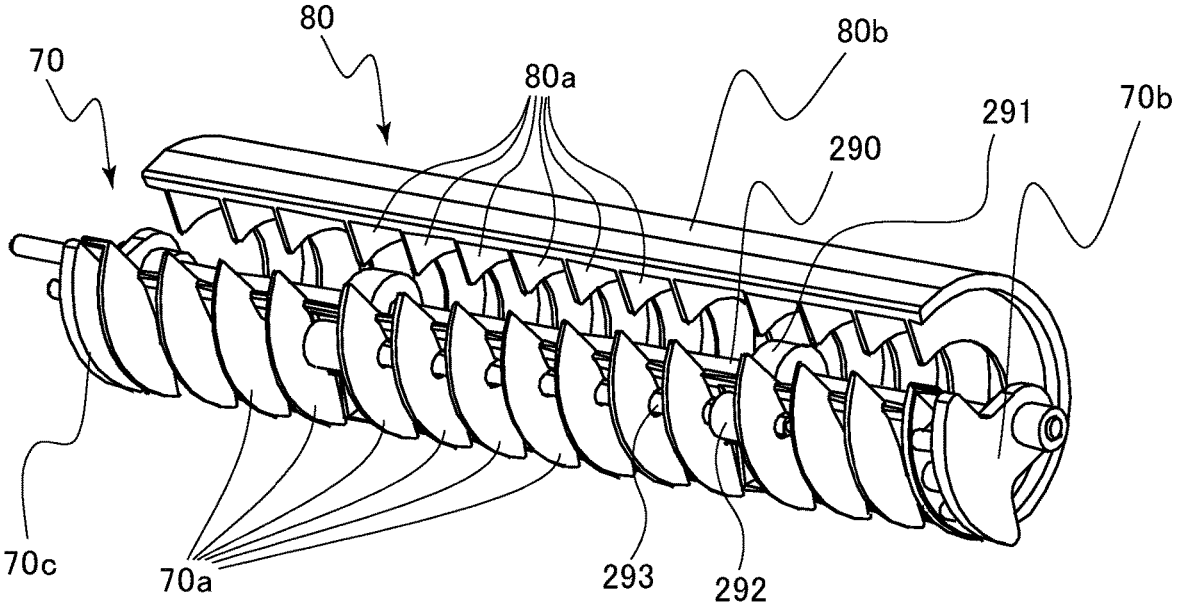
FIG. 19B is a perspective view of the guide unit and an intermediate supporting entrance guide according to the third exemplary embodiment.

FIG. 19A is a perspective view of a guide unit 70 and the kick-out rollers 29. FIG. 19B is a perspective view illustrating an intermediate supporting entrance guide 80 in addition to FIG. 19A. The guide unit 70 is a guide pivotable about the driving shaft 290 of the kick-out rollers 29, and the intermediate supporting entrance guide 80 is a guide fixed to the frame member of the post-processing apparatus. The guide unit 70 and the intermediate supporting entrance guide 80 constitute a guide member of the present exemplary embodiment. In the description below, the axial direction of the driving shaft 290, that is, the rotation axis direction of the guide unit 70 will be referred to as a lengthwise direction of the guide unit 70.

The guide unit 70 includes a front side plate 70*b* at one end portion in the lengthwise direction, a rear side plate 70*c* at the other end portion in the lengthwise direction, and a plurality of lower guides 70*a* between the front side plate 70*b* and the rear side plate 70*c*. The front side plate 70*b*, the rear side plate 70*c*, and the plurality of lower guides 70*a* are each a plate-shaped member extending in a direction intersecting with the lengthwise direction, particularly, with the lengthwise direction as the normal direction, and are connected to each other via a connecting guide surface 70*e* extending in the lengthwise direction. The lower guides 70*a* are held by the front side plate 70*b* and the rear side plate 70*c* serving as holding portions of the present embodiment.

FIG. 19A illustrates a state in which the guide unit 70 is in a home position. An upper surface guide 70*u* made up of upper edges of the plurality of lower guides 70*a* and the connecting guide surface 70*e* when the guide unit 70 is in the home position constitute a first guide portion of the present exemplary embodiment. In addition, a lower surface guide 70*d* made up of lower edges of the plurality of lower guides 70*a* constitute a second guide portion of the present exemplary embodiment.

The nip portion 29*a* of the kick-out rollers 29 is positioned between the upstream end and the downstream end of the lower guides 70*a* in the conveyance direction. The entirety of the driving roller 291 is exposed through the lower guides 70*a*, and the driven roller 292 is exposed through an opening provided in the connecting guide surface 70*e* of the guide unit 70 and in contact with the driving roller 291. In addition, the lower edge of each of the lower guides 70*a* constitute an outer peripheral portion of the guide unit 70, and is formed in an approximate arcuate shape centered on the rotation axis of the guide unit 70.

As illustrated in FIG. 19B, the intermediate supporting entrance guide 80 includes a cover portion 80*b* extending in the lengthwise direction, and a plurality of ribs 80*a* provided on the cover portion 80*b*. The cover portion 80*b* is formed in an approximate arcuate shape centered on the rotation axis of the guide unit 70 as viewed in the lengthwise direction, and extends in the lengthwise direction. The ribs 80*a* are each a plate-shaped member extending inwardly from the cover portion 80*b* toward the rotation axis of the guide unit 70. The plurality of ribs 80*a* are arranged at different positions from the plurality of lower guides 70*a* of the guide unit 70 in the lengthwise direction, preferably such that the plurality of ribs 80*a* are alternately arranged with respect to the plurality of lower guides 70*a* in the lengthwise direction. In a state in which the guide unit 70 is in the home position, the plurality of ribs 80*a* constitute a third guide portion of the present exemplary embodiment that guides the upper surface of the sheet conveyed by the kick-out rollers 29.

The same driving configuration as in the first exemplary embodiment can be used for the kick-out rollers 29 and the guide unit 70. That is, as described with reference to FIGS. 12C and 13, the driving force of a motor serving as a drive source can be distributed to the driving roller 291 of the kick-out rollers 29 and the guide unit 70 to drive the driving roller 291 and the guide unit 70.

An operation of the guide unit 70 according to the present exemplary embodiment will be described with reference to FIGS. 20A to 20D. FIG. 20A illustrates a state after the leading end of the sheet S1 conveyed through the in-body discharge path 82 has passed a conveyance path between the guide unit 70 and the intermediate supporting entrance guide 80. At this time, the guide unit 70 is in the home position. The lower surface of the sheet S1 is guided by an upper surface guide 70*u* of the guide unit 70, and the upper surface of the sheet S1 is guided by the intermediate supporting entrance guide 80.

Figure 20C:
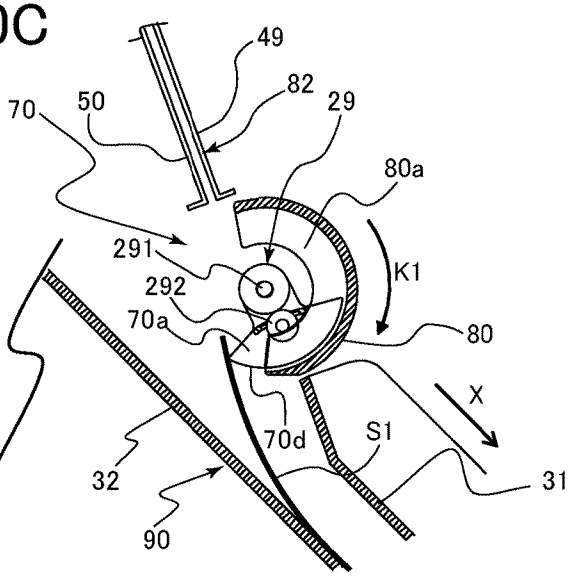
FIGS. 20A to 20D are diagrams for describing the operation of the guide unit according to the third exemplary embodiment.
Figure 20D:
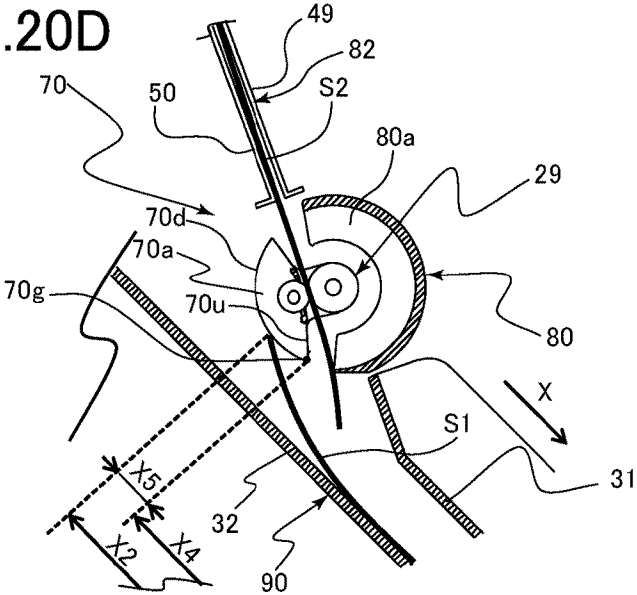
Figure 20A:
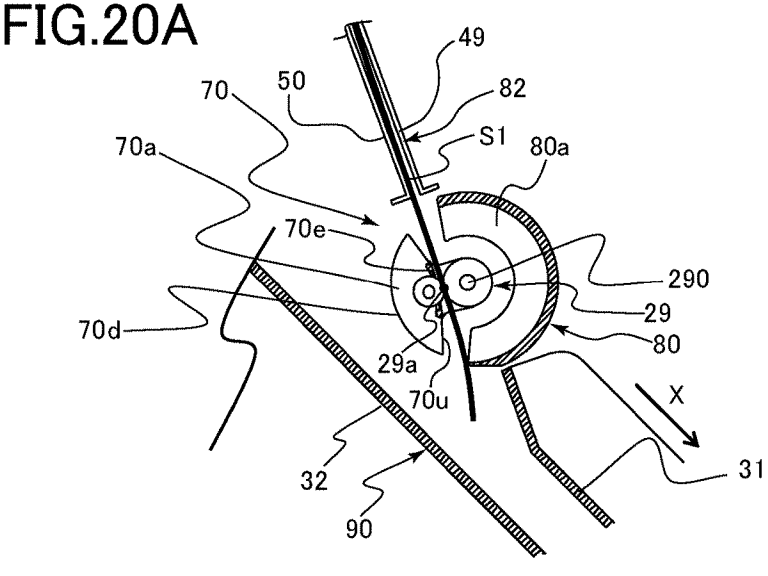
Figure 20B:
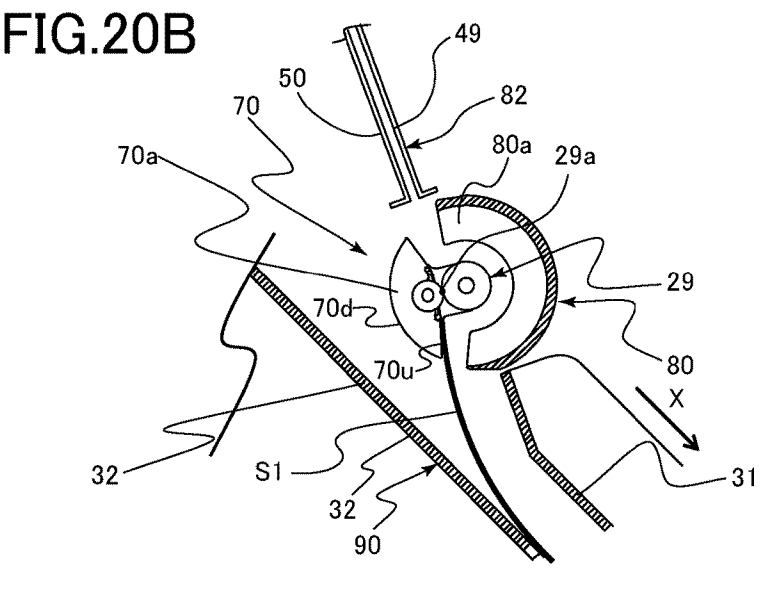

FIG. 20B illustrates a state immediately after the trailing end of the sheet S1 has been released from the nip portion 29*a* of the kick-out rollers 29. The longitudinal alignment standard plates 39 and the kick-out rollers 29 are arranged such that the distance X1 between the nip portion 29*a* and the longitudinal alignment standard surfaces 39*a* of the longitudinal alignment standard plates 39 provided on the intermediate supporting portion 90 in the conveyance direction X is larger than the sheet length X2 as illustrated in FIG. 15B. Therefore, the trailing end of the sheet S1 is supported by the upper surface guide 70*u* from below. In this state, the guide unit 70 starts rotating in the clockwise direction in FIG. 20B while the intermediate supporting entrance guide 80 is still fixed.

FIG. 20C illustrates a state in which the guide unit 70 has rotated by about 270° from the home position in the rotation direction K1, which is the clockwise direction in FIG. 20C. At this time, the trailing end of the sheet S1 has moved to a position between the lower surface guide 70*d* and the intermediate supporting lower guide 32 due to the weight thereof or by being pressed downward by the lower guides 70*a*. As a result of this, the lift-up of the trailing end of the sheet S1 is suppressed by the lower surface guide 70*d* even in the case where the trailing end of the sheet S1 is curled up.

FIG. 20D illustrates a state in which the guide unit 70 has further rotated by 90° in the rotation direction K1 from the state of FIG. 20C and returned to the home position. After this, the lateral alignment jogger 58 and the longitudinal alignment roller 33 sequentially perform an alignment operation, and thus the position of the sheet S1 on the intermediate supporting portion 90 is aligned. In addition, as a result of the guide unit 70 having returned to the home position, it has become possible for the guide unit 70 and the intermediate supporting entrance guide 80 to receive the sheet S2, which is a sheet succeeding the sheet S1.

Here, the guide unit 70 is configured such that the lower surface guide 70*d* overlaps with the trailing end of the sheet S1 at a position above the trailing end of the sheet S1 after the rotation operation similarly to the drum unit 60 of the first exemplary embodiment. That is, when the guide unit 70 is in the home position, the distance X4 from a downstream end 70*g* of the lower surface guide 70*d* to the longitudinal alignment standard surfaces 39*a* in the conveyance direction X is set to be smaller than the sheet length X2. In other words, the guide unit 70 and the longitudinal alignment standard plates 39 are arranged such that this relationship of length, that is, X4<X2 is satisfied. Therefore, in the state of FIG. 20D after the rotation operation of the guide unit 70, a trailing end portion of the sheet S1 and the lower surface guide 70*d* overlap by the length X5, which is the difference between the distance X4 and the sheet length X2. Therefore, lift-up of the trailing end of the sheet S1 can be more reliably restricted.

The sheet S2 having reached the kick-out rollers 29 through the in-body discharge path 82 is conveyed on the upper surface guide 70*u* serving as a first guide portion of the guide unit 70 positioned in the home position. At this time, the trailing end of the sheet S1, which is a preceding sheet, is positioned below the guide unit 70, that is, positioned between the lower surface guide 70*d* serving as a second guide portion and the intermediate supporting lower guide 32 serving as a supporting portion. Therefore, similarly to the first exemplary embodiment, even in the case where the sheet is curled, collision between the trailing end of the preceding sheet and the leading end of the succeeding sheet can be more reliably avoided, and the sheet can be smoothly supported on the supporting portion.

In addition, as a result of disposing the guide unit 70 coaxially with the driving shaft 290 of the kick-out rollers 29, a configuration in which the position of the driving roller 291 does not change even when rotating the guide unit 70. As a result of this, the configuration of the guide unit 70 and the kick-out rollers 29 can be simplified, the number of parts can be reduced, and thus the cost can be reduced.

Fourth Exemplary Embodiment

Next, a configuration of a fourth exemplary embodiment will be described with reference to FIGS. 21A and 21B. The present exemplary embodiment is different from the first exemplary embodiment in the shape of cutouts provided in a side plate of the drum guide 61, which is a drum-shaped guide unit constituting the drum unit 60. In the description below, elements having approximately the same configuration and effects as in the first exemplary embodiment will be denoted by the same reference signs as in the first exemplary embodiment and description thereof will be omitted.

Figure 21A:
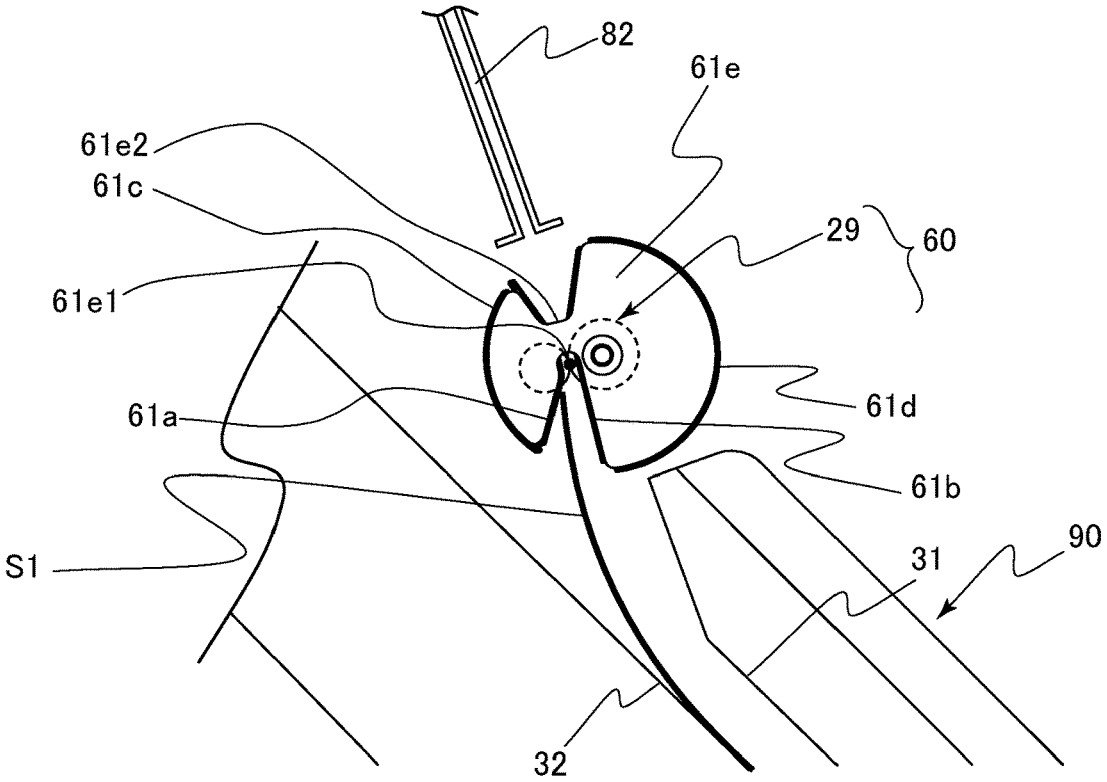
FIG. 21A is a front view of a drum unit according to a fourth exemplary embodiment.
Figure 21B:
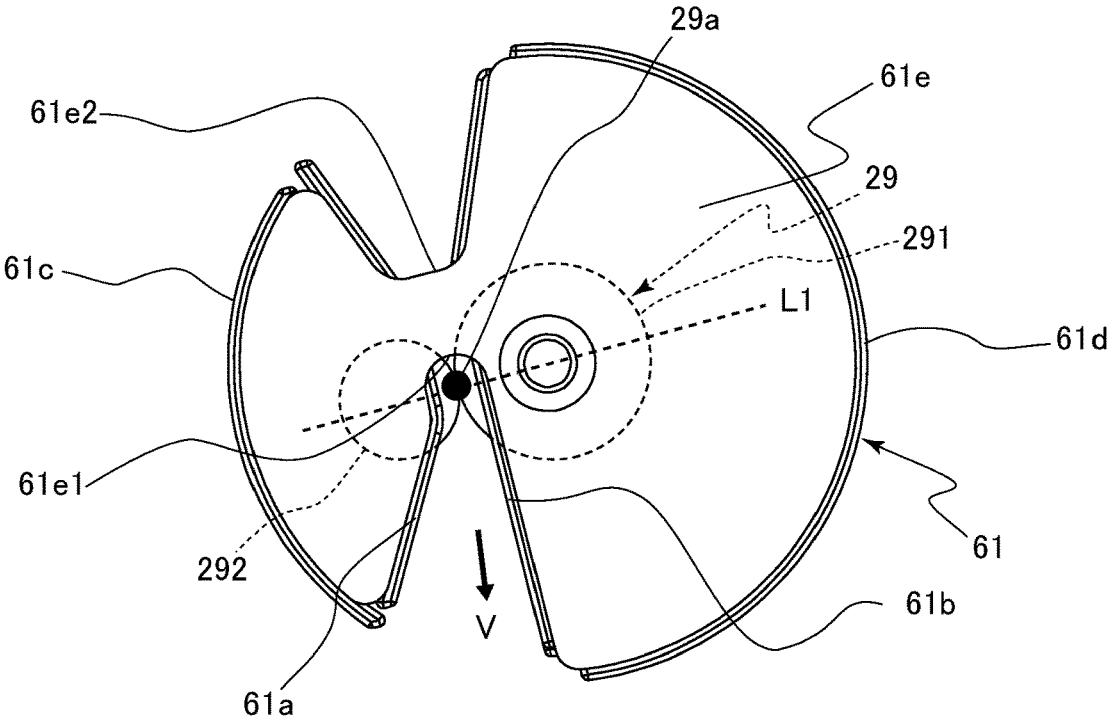
FIG. 21B is an enlarged view of FIG. 21A.

FIG. 21A is a side view of the drum unit 60 according to the present exemplary embodiment as viewed in the rotation axis direction, and FIG. 21B is an enlarged view of FIG. 21A. The drum guide 61 according to the present exemplary embodiment has the same component configuration as the drum guide 61 according to the first exemplary embodiment. The drum guide 61 and the kick-out rollers 29 are each rotatably supported by an unillustrated frame member of the post-processing apparatus. In addition, the kick-out rollers 29 and the drum guide 61 are each rotationally driven by an unillustrated driving portion.

FIG. 21A illustrates a state immediately after the trailing end of the sheet S1 discharged from the in-body discharge path 82 onto the intermediate supporting portion 90 illustrated in FIG. 1 has been released from the nip portion 29*a* of the kick-out rollers 29. The illustrated side plate 61*e* provided on one side of the drum guide 61, that is, the front side of the post-processing apparatus, has a downstream cutout 61*e*1 serving as a first recess portion, which is a recess shape recessed from the downstream side toward the upstream side in a sheet conveyance direction V in the nip portion 29*a* as viewed in the rotation axis direction of the drum guide 61. The downstream cutout 61*e*1 is defined such that the nip portion 29*a* of the kick-out rollers 29 and a portion of the in-drum conveyance path downstream of the nip portion 29*a* in the conveyance direction are exposed as viewed in the rotation axis direction. In other words, the downstream cutout 61*e*1 is defined to a position upstream of a virtual line L1, which connects the rotation axis of the driving roller 291 of the kick-out rollers 29 and the rotation axis of the driven roller 292, in the sheet conveyance direction V. In addition, in a region downstream of the virtual line L1 in the sheet conveyance direction V, the guide surfaces of the drum upper guide 61*b* and the drum lower guide 61*a* that constitute the in-drum conveyance path are positioned within the downstream cutout 61*e*1 or overlap with an edge of the downstream cutout 61*e*1.

The effect of the downstream cutout 61*e*1 will be described. First, in the case where the conveyance of the sheet S1 has stopped for some reason while the sheet S1 is still in the in-drum conveyance path and a user or a service operator has to remove the sheet S1, the sheet S1 can be removed easier as a result of providing the downstream cutout 61*e* 1. That is, when opening the opening/closing cover on the front side of the post-processing apparatus to open the intermediate supporting upper guide 31 illustrated in FIG. 21B to pull out the sheet S1 to the front side, that is, to the front side in FIG. 21A, the sheet S1 can be pulled out smoothly without being interrupted by the side plate 61*e* provided on the front side.

In addition, when aligning the sheet S1 on the intermediate supporting portion 90, as a result of providing the downstream cutout 61*e*1, the operation of the lateral alignment jogger 58 illustrated in FIGS. 21A and 21B can be started earlier. In the description of the first exemplary embodiment, the movement of the lateral alignment jogger 58 illustrated in FIG. 21B is started at a timing when the rotation amount exceeds a predetermined angle after the start of the rotation of the drum unit 60, so as to perform the rotation operation of the drum unit 60 and the alignment by the lateral alignment jogger 58 in parallel. Here, since the downstream cutout 61*e*1 is defined such that the nip portion 29*a* of the kick-out rollers 29 is exposed, the operation of the lateral alignment jogger 58 can be started anytime after the trailing end of the sheet S1, that is, the upstream end of the sheet S1 in the sheet conveyance direction V, has been released from the nip portion 29*a*. This is because, as a result of providing the downstream cutout 61*e*1, the sheet S1 normally does not collide with the side plate 61*e* even if the sheet S1 is pressed toward the side plate 61*e* immediately after the trailing end of the sheet S1 has been released from the nip portion 29*a*. As a result of this, as compared with the first exemplary embodiment, the operation of the lateral alignment jogger 58 can be started even earlier to reduce the time required for the alignment operation, and thus the sheet processing speed of the post-processing apparatus 4 can be improved.

Further, an upstream cutout 61*e*2 serving as a second recess portion, which is a recess shape recessed from the upstream side toward the downstream side in the sheet conveyance direction V in the nip portion 29*a* as viewed in the rotation axis direction of the drum guide 61, is defined in the side plate 61*e*. The upstream cutout 61*e*2 is defined such that a part of the in-drum conveyance path upstream of the nip portion 29*a* of the kick-out rollers 29 in the conveyance direction is exposed. In other words, in a region upstream of the virtual line L1 in the sheet conveyance direction V, the guide surfaces of the drum upper guide 61*b* and the drum lower guide 61*a* that constitute the in-drum conveyance path are positioned within the upstream cutout 61*e*2 or overlap with an edge of the upstream cutout 61*e*2.

The effect of the upstream cutout 61*e*2 will be described. There is a possibility that the rotation operation of the drum guide 61 stops for some reason while the drum guide 61 is rotating, and the trailing end of the sheet S1 supported on the intermediate supporting portion 90 is lifted up by curling or the like, and enters the in-body drum conveyance path. In such a case, when opening the opening/closing cover and removing the sheet S1 by reaching the sheet S1 from the front side of FIG. 21A, the trailing end portion of the sheet S1 getting caught by the side plate 61*e* can be suppressed as a result of providing the upstream cutout 61*e*2. As a result, the sheet S1 remaining in the intermediate supporting portion 90 can be removed more easily.

In addition, as a result of providing the downstream cutout 61*e*1 and the upstream cutout 61*e*2, the length in the conveyance direction V of a region where a corner portion is formed between the side plate 61*e* and the guide surface of the drum upper guide 61*b* and the drum lower guide 61*a* constituting the in-drum conveyance path is smaller. Therefore, a possibility that a side end portion of a sheet enters the corner portion between the side plate 61*e* and the guide surface of the drum upper guide 61*b* and the drum lower guide 61*a* and a conveyance failure occurs can be reduced even in the case of conveying and supporting a wide sheet, for example, a sheet of the maximum width, on the intermediate supporting portion 90. The same applies to a downstream cutout 61*f*1 and an upstream cutout 61*f*2 provided in the side plate 61*f* provided on the opposite side to the side plate 61*e* in the rotation axis direction of the drum guide 61. In addition, forming the side plates 61*e* and 61*f* in the same shape or shapes symmetrical to each other, the design and manufacture can be easier.

To be noted, the upstream end of the downstream cutout 61*e*1 may be at the same position as the nip portion 29*a*, that is, such a position as to be in contact with the virtual line L1 of FIG. 21B, in the sheet conveyance direction V. In addition, the nip portion 29*a* may be positioned slightly upstream of the upstream end of the downstream cutout 61*e*1 such that the nip portion 29*a* is hidden behind the side plate 61*e*.

The effect of the downstream cutouts 61*e*1 and 61*f*1 and the upstream cutouts 61*e*2 and 61*f*2 described above is basically the same for the drum guide 61 of the first exemplary embodiment illustrated in FIGS. 12A and 12B except for difference derived from difference in the size of the cutouts. The difference derived from the difference in the size of the cutouts is, for example, difference in the timing when it becomes possible to start the operation of the lateral alignment jogger 58 after the trailing end of the sheet has passed through the nip portion 29*a* of the kick-out rollers 29.

Modification Example

Although the configuration illustrated in FIGS. 21A and 21B has been employed in consideration of the balance of the merit obtained from the downstream cutouts 61*e*1 and 61*f*1 and the upstream cutouts 61*e*2 and 61*f*2 in the fourth exemplary embodiment described above, the presence/absence and size of the cutouts can be appropriately changed in accordance with the specific configuration of the apparatus. For example, omitting the downstream cutout 61*f*1 and/or the upstream cutout 61*f*2 of the side plate 61*f* can be considered.

Fifth Exemplary Embodiment

Next, a configuration of a fifth exemplary embodiment will be described with reference to FIGS. 22A and 22B. The present exemplary embodiment is different from the first exemplary embodiment in that the sheet conveyance path in the drum unit 60 is open toward one side in the rotation axis direction of the drum guide 61. In the description below, elements having approximately the same configuration and effects as in the first exemplary embodiment will be denoted by the same reference signs as in the first exemplary embodiment and description thereof will be omitted.

Figure 22A:
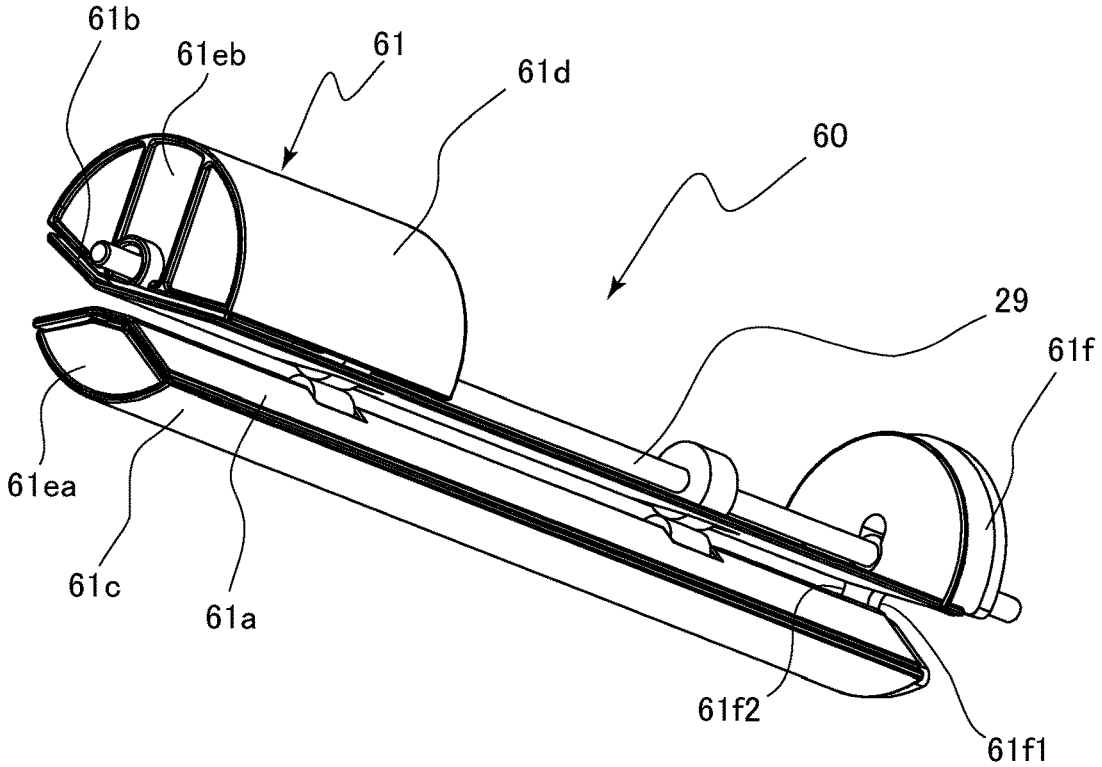
FIG. 22A is a perspective view of a drum unit according to a fifth exemplary embodiment.
Figure 22B:
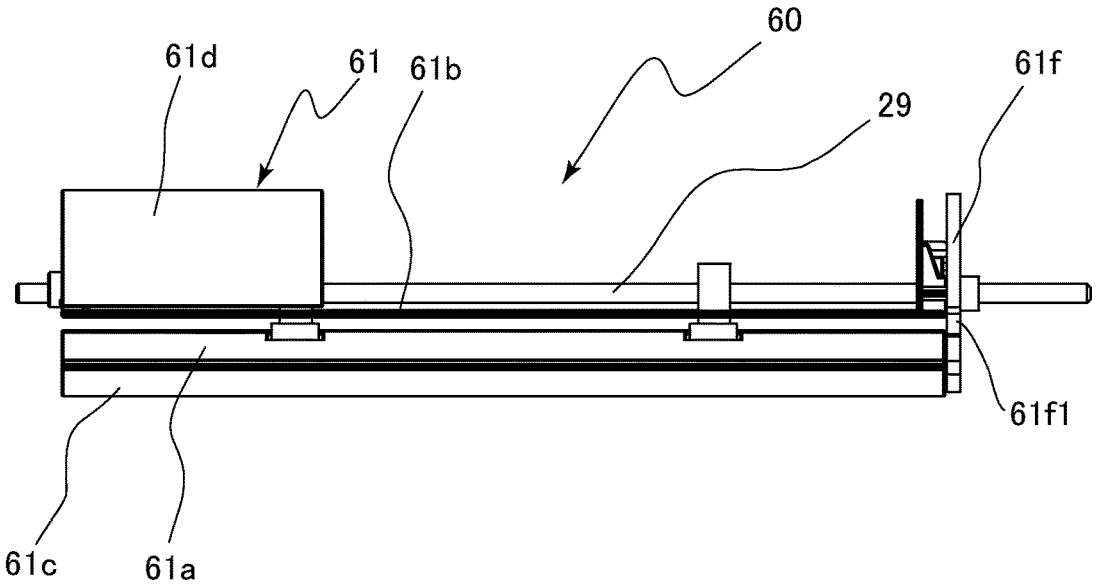
FIG. 22B is a side view of the drum unit according to the fifth exemplary embodiment.

FIG. 22A is a perspective view of the drum unit 60 according to the present exemplary embodiment, and FIG. 22B is a diagram illustrating the drum unit 60 according to the present exemplary embodiment as viewed from the downstream side in the sheet conveyance direction. As illustrated, an end surface of the drum guide 61 according to the present exemplary embodiment on the front side, that is, the left side in FIG. 22A, is divided into a lower portion 61*ea* on one side of the in-drum conveyance path, that is, the lower side in FIG. 22A, and an upper portion 61*eb* on the other side of the in-drum conveyance path, that is, the upper side in FIG. 22A. In other words, the drum guide 61 of the present exemplary embodiment is held by the side plate 61*f* serving as a holding portion on one side in the sheet width direction of a region which the sheet passes through, and the other side in the sheet width direction is open. Therefore, a configuration in which the entirety of the in-drum conveyance path including the nip portion 29*a* of the kick-out rollers 29 is exposed as viewed from the left side in FIG. 22A in the rotation axis direction of the drum guide 61 is employed.

According to this configuration, the drum guide 61 of the present exemplary embodiment basically have the same effect as the downstream cutout 61*e*1 and the upstream cutout 61*e*2 of the side plate 61*e* of the fourth exemplary embodiment.

Sixth Exemplary Embodiment

Next, a configuration of a sixth exemplary embodiment will be described with reference to FIGS. 23A and 23B. The present exemplary embodiment is different from the third exemplary embodiment described above in that a side plate of the guide unit 70 is provided with a cutout. In the description below, elements having approximately the same configuration and effects as in the first and third exemplary embodiments will be denoted by the same reference signs as in the first and third exemplary embodiments and description thereof will be omitted.

Figure 23A:
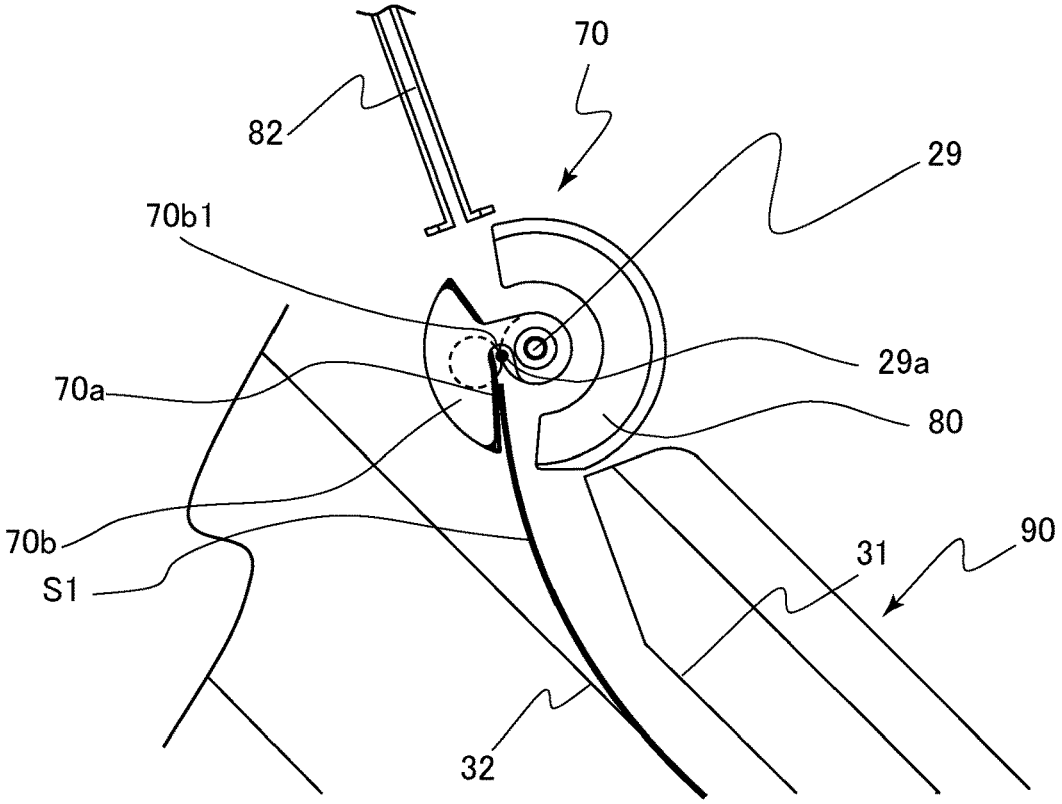
FIG. 23A is a front view of a guide unit according to a sixth exemplary embodiment.
Figure 23B:
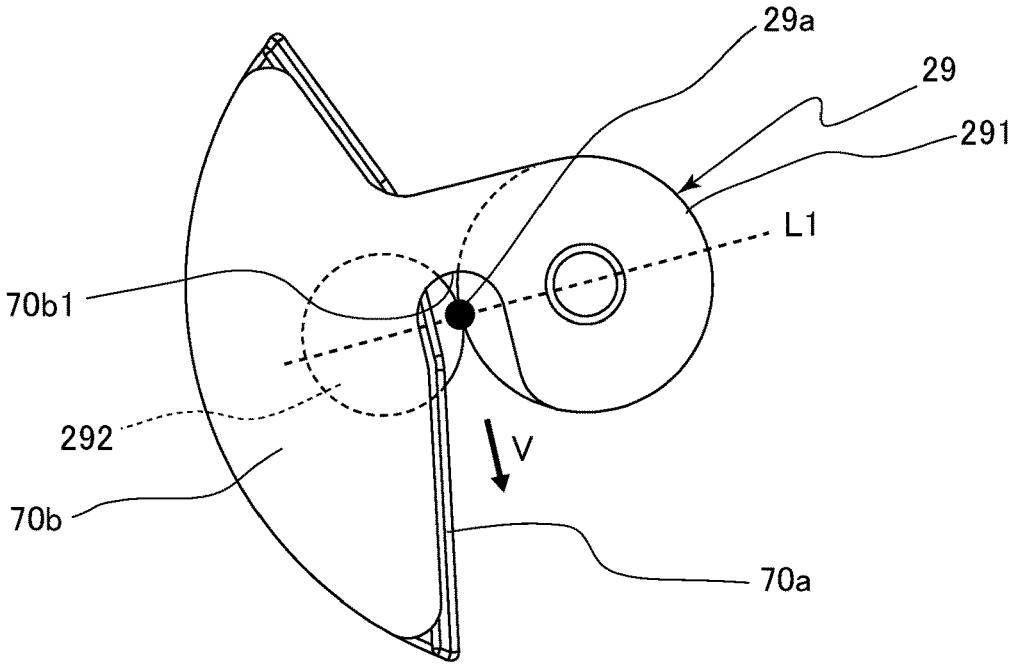
FIG. 23B is an enlarged view of FIG. 23A.

FIG. 23A is a side view of the guide unit 70 according to the present exemplary embodiment as viewed in the rotation axis direction, and FIG. 23B is an enlarged view of FIG. 23A. The front side plate 70*b* provided on one side of the guide unit 70, that is, the front side of the post-processing apparatus has a cutout 70*b*1. The cutout 70*b*1 serves as a first recess portion, which is a recess shape recessed from the downstream side toward the upstream side in the sheet conveyance direction V in the nip portion 29*a*. The cutout 70*b*1 of the present exemplary embodiment is defined such that the nip portion 29*a* of the kick-out rollers 29 and a portion of the in-drum conveyance path downstream of the nip portion 29*a* in the conveyance direction are exposed as viewed in the rotation axis direction. In other words, the cutout 70*b*1 is defined to a position upstream of the virtual line L1, which connects the rotation axis of the driving roller 291 of the kick-out rollers 29 and the rotation axis of the driven roller 292, in the sheet conveyance direction V. In addition, in a region downstream of the virtual line L1 in the sheet conveyance direction V, the guide surfaces of the lower guides 70*a* are positioned above the cutout 70*b*1 or overlap with an edge of the cutout 70*b*1.

By providing the cutout 70*b*1 described above, basically the same effect as the downstream cutout 61*e*1 of the side plate 61*e* of the fourth exemplary embodiment can be obtained. In addition, by providing a cutout similar to the cutout 70*b*1 in the rear side plate 70*c*, basically the same effect as the downstream cutout 61*f*1 of the side plate 61*f* of the fourth exemplary embodiment can be obtained. To be noted, a cutout corresponding to the upstream cutout 61*e*1 of the fourth exemplary embodiment may be provided in the front side plate 70*b*.

Seventh Exemplary Embodiment

Next, a configuration of a seventh exemplary embodiment will be described with reference to FIGS. 24A and 24B. The present exemplary embodiment is different from the sixth exemplary embodiment in that the sheet conveyance path in the guide unit 70 is open toward one side in the rotation axis direction of the guide unit 70. In the description below, elements having approximately the same configuration and effects as in the sixth exemplary embodiment will be denoted by the same reference signs as in the sixth exemplary embodiment and description thereof will be omitted.

Figure 24A:
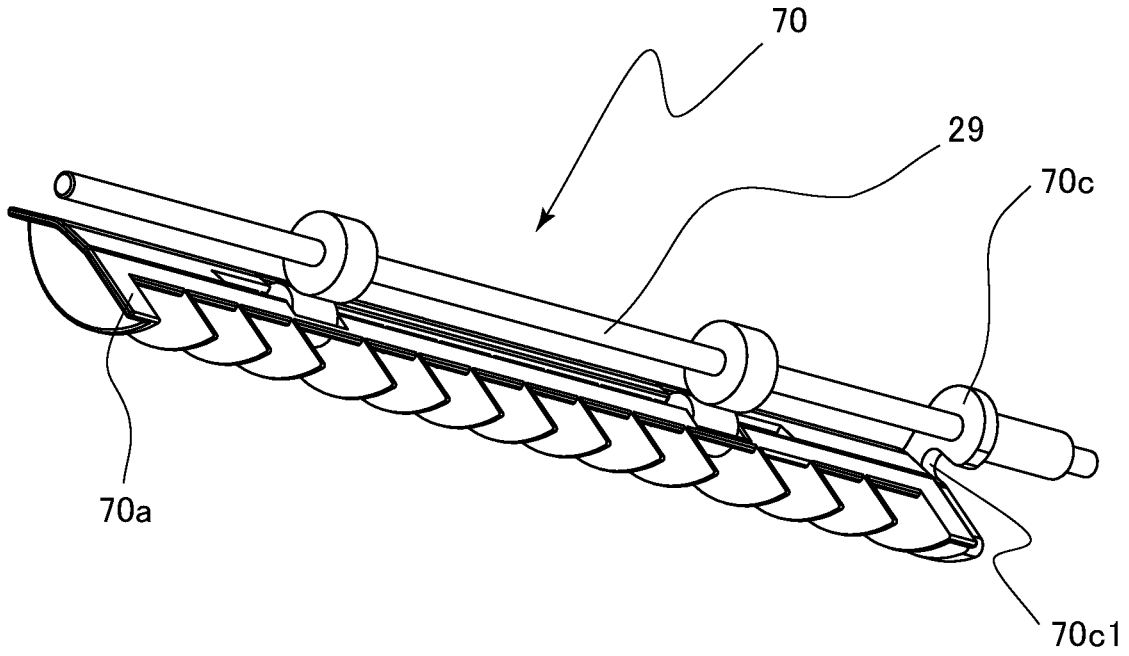
FIG. 24A is a perspective view of a guide unit according to a seventh exemplary embodiment.
Figure 24B:
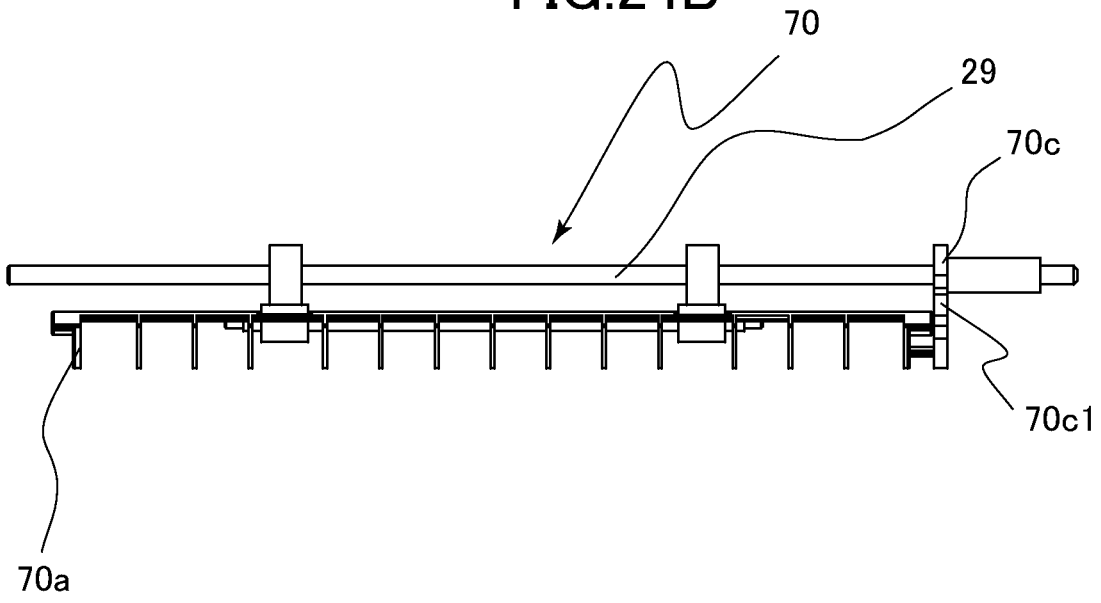
FIG. 24B is a side view of the guide unit according to the seventh exemplary embodiment.

FIG. 24A is a perspective view of the guide unit 70 according to the present exemplary embodiment, and FIG. 24B is a diagram illustrating the guide unit 70 according to the present exemplary embodiment as viewed from the downstream side in the sheet conveyance direction. As illustrated, the front side plate 70*b* as in the sixth exemplary embodiment is not provided at an end portion of the guide unit 70 according to the present exemplary embodiment on the front side, that is, on the left side in FIG. 24A. In other words, the guide unit 70 of the present exemplary embodiment is held by the rear side plate 70*c* serving as a holding portion on one side in the sheet width direction of a region which the sheet passes through, and the other side in the sheet width direction is open. Therefore, a configuration in which the entirety of the sheet conveyance path including the nip portion 29*a* of the kick-out rollers 29 is exposed as viewed from the left side in FIG. 24A in the rotation axis direction of the guide unit 70 is employed.

According to this configuration, the guide unit 70 of the present exemplary embodiment basically have the same effect as the downstream cutout 61*e*1 and the upstream cutout 61*e*2 of the side plate 61*e* of the fourth exemplary embodiment. In addition, as a result of providing the cutout 70*c*1, basically the same effect as the downstream cutout 61*f*1 of the side plate 61*f* of the fourth exemplary embodiment can be obtained.

Eighth Exemplary Embodiment

Next, a configuration of an eighth exemplary embodiment will be described with reference to FIGS. 25A and 25B. The present exemplary embodiment is different from the second exemplary embodiment illustrated in FIG. 18 in that the sheet conveyance path in the drum guide 61 is open toward one side in the rotation axis direction of the drum guide 61. In the description below, elements having approximately the same configuration and effects as in the first exemplary embodiment will be denoted by the same reference signs as in the first exemplary embodiment and description thereof will be omitted.

Figure 25A:
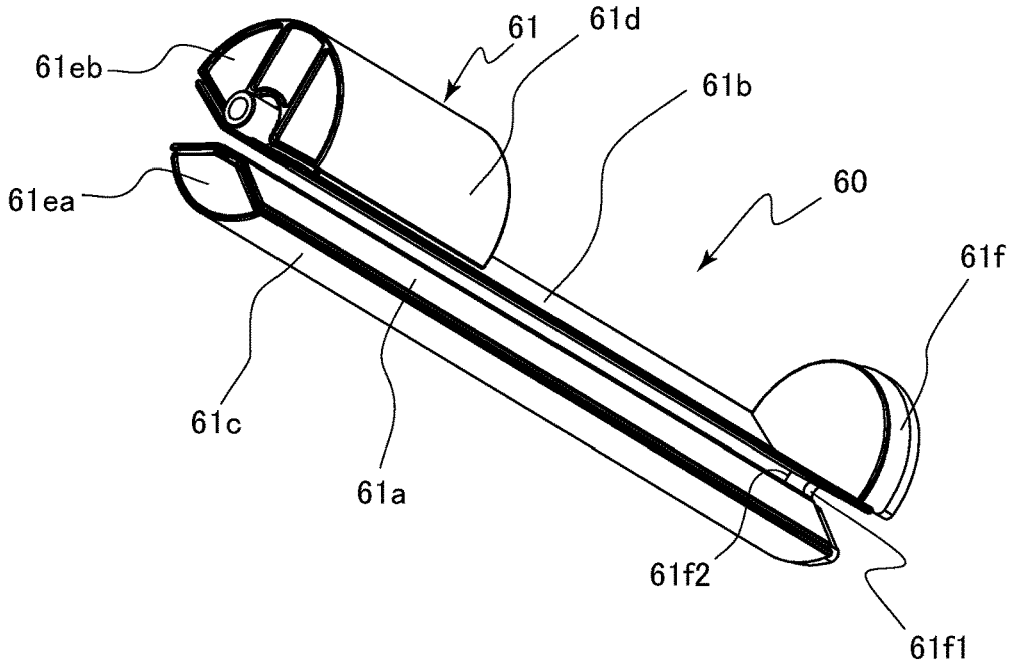
FIG. 25A is a perspective view of a drum unit according to an eighth exemplary embodiment.
Figure 25B:
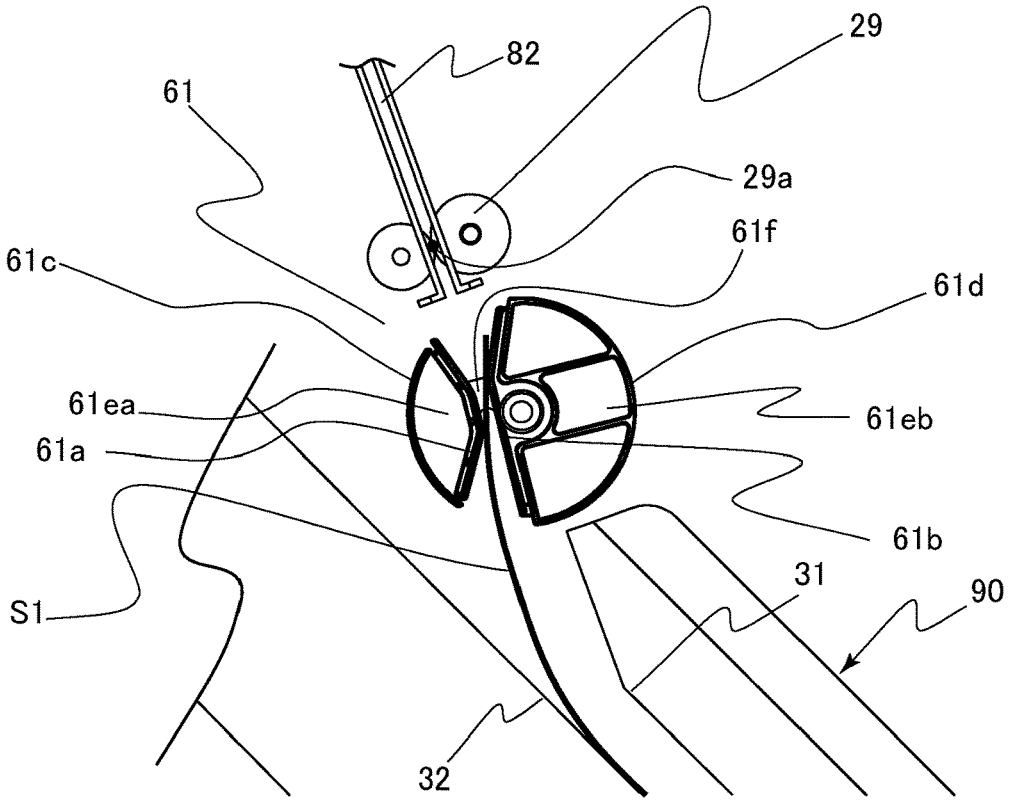
FIG. 25B is a front view of the drum unit according to the eighth exemplary embodiment.

FIG. 25A is a perspective view of the drum guide 61 according to the present exemplary embodiment, and FIG. 25B is a diagram illustrating the drum guide 61 according to the present exemplary embodiment and the surroundings thereof as viewed in the rotation axis direction of the drum guide 61. As illustrated, an end surface of the drum guide 61 according to the present exemplary embodiment on the front side, that is, the left side in FIG. 25A is divided into a lower portion 61*ea* on one side of the in-drum conveyance path, that is, the lower side in FIG. 25A, and an upper portion 61*eb* on the other side of the in-drum conveyance path, that is, the upper side in FIG. 25A. In other words, the drum guide 61 of the present exemplary embodiment is held by the side plate 61*f* serving as a holding portion on one side in the sheet width direction of a region which the sheet passes through, and the other side in the sheet width direction is open. Therefore, a configuration in which the entirety of the in-drum conveyance path including the nip portion 29*a* of the kick-out rollers 29 is exposed as viewed from the left side in FIG. 25A in the rotation axis direction of the drum guide 61 is employed.

According to this configuration, the drum guide 61 of the present exemplary embodiment basically have the same effect as the downstream cutout 61*e*1 and the upstream cutout 61*e*2 of the side plate 61*e* of the fourth exemplary embodiment. In addition, by providing the downstream cutout 61*f*1 and the upstream cutout 61*f*2 in the side plate 61*f*, basically the same effect as the downstream cutout 61*f*1 and the upstream cutout 61*f*2 of the side plate 61*f* of the fourth exemplary embodiment can be obtained.

Ninth Exemplary Embodiment

Next, a configuration of a ninth exemplary embodiment will be described with reference to FIGS. 26A and 26B. The present exemplary embodiment is different from the seventh exemplary embodiment illustrated in FIGS. 24A and 24B in that the guide unit 70 is disposed downstream of the kick-out rollers 29 and the sheet conveyance path defined by the guide unit 70 is open toward one side in the rotation axis direction of the guide unit 70. In the description below, elements having approximately the same configuration and effects as in the seventh exemplary embodiment will be denoted by the same reference signs as in the seventh exemplary embodiment and description thereof will be omitted.

Figure 26A:
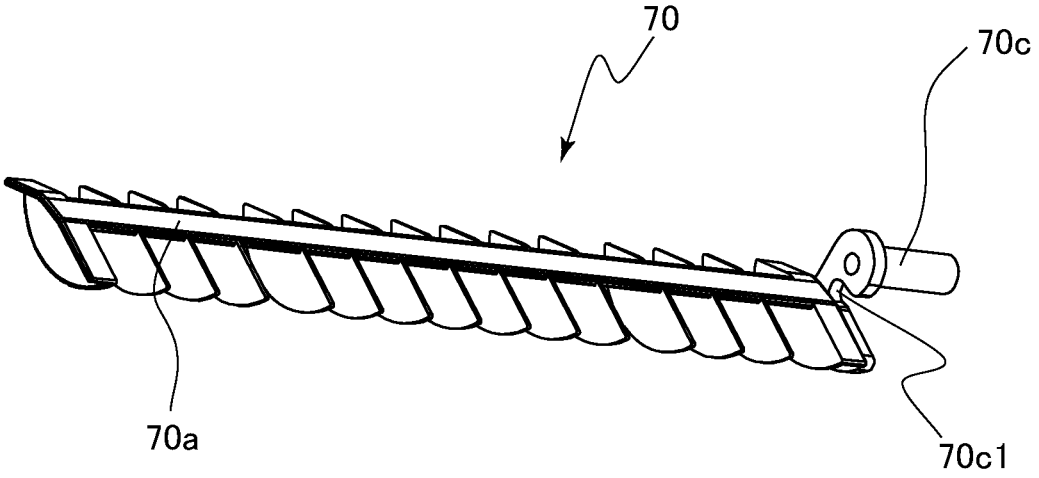
FIG. 26A is a perspective view of a guide unit according to a ninth exemplary embodiment.
Figure 26B:
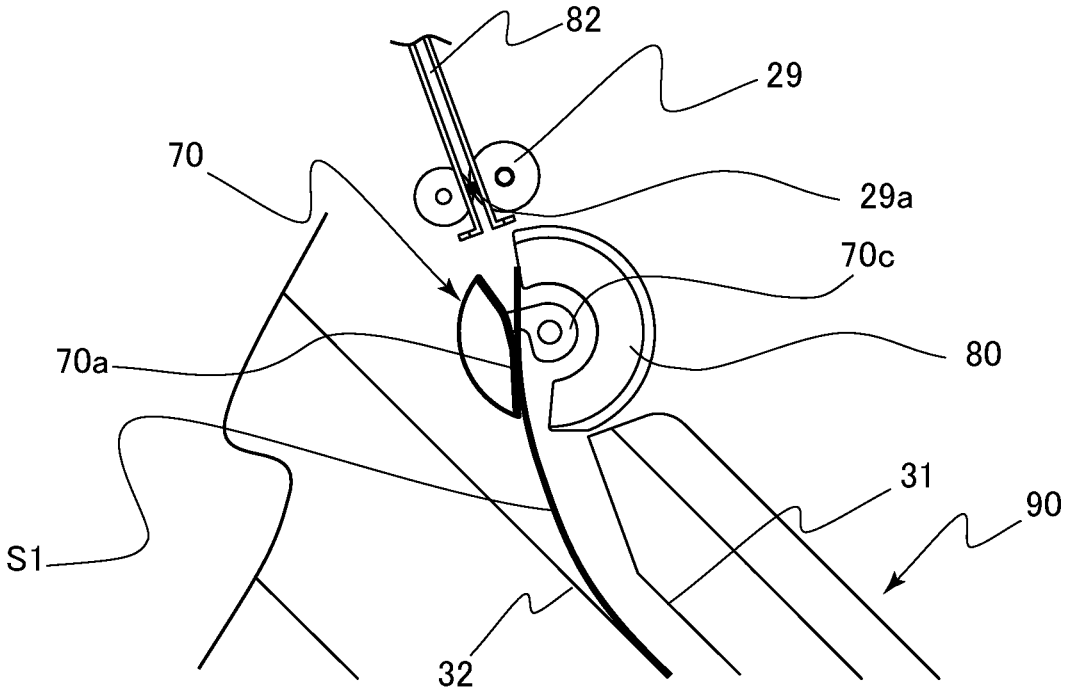
FIG. 26B is a front view of the guide unit according to the ninth exemplary embodiment.

FIG. 26A is a perspective view of the guide unit 70 according to the present exemplary embodiment, and FIG. 26B is a diagram illustrating the guide unit 70 according to the present exemplary embodiment and the surroundings thereof as viewed from the front side in the rotation axis direction of the guide unit 70. Similarly to the seventh exemplary embodiment, the front side plate 70*b* as in the sixth exemplary embodiment is not provided at an end portion of the guide unit 70 according to the present exemplary embodiment on the front side, that is, on the left side in FIG. 26A. In other words, the guide unit 70 of the present exemplary embodiment is held by the rear side plate 70*c* serving as a holding portion on one side in the sheet width direction of a region which the sheet passes through, and the other side in the sheet width direction is open. Therefore, a configuration in which the entirety of the sheet conveyance path including the nip portion 29*a* of the kick-out rollers 29 is exposed as viewed in the rotation axis direction of the guide unit 70 as illustrated in FIG. 26B is employed.

According to this configuration, the guide unit 70 of the present exemplary embodiment basically have the same effect as the downstream cutout 61*e*1 and the upstream cutout 61*e*2 of the side plate 61*e* of the fourth exemplary embodiment. In addition, as a result of providing the cutout 70*c*1 in the rear side plate 70*c*, basically the same effect as the downstream cutout 61*f*1 of the side plate 61*f* of the fourth exemplary embodiment can be obtained.

In addition, as illustrated in FIG. 26B, the guide unit 70 is disposed downstream of the nip portion 29*a* of the kick-out rollers 29 in the sheet conveyance direction. The operation of the post-processing apparatus according to the present exemplary embodiment is approximately the same as in the third exemplary embodiment except that the position of each roller of the kick-out rollers 29 does not change when the guide unit 70 rotates. That is, the rotation operation of the guide unit 70 is started after the trailing end of the preceding sheet has passed through the nip portion of the kick-out rollers 29.

OTHER EMBODIMENTS

To be noted, configurations in which the drum guide 61 or the guide unit 70 is disposed above the intermediate supporting portion 90 provided in the binding processing portion 4A of the post-processing apparatus 4 illustrated in FIG. 1 have been described in the exemplary embodiments described above. However, the present technique can be used as a mechanism for conveying a sheet in a different part of an image forming system. For example, the drum guide 61 or the like may be disposed as a mechanism for discharging a sheet onto the upper discharge tray 25 of the post-processing apparatus 4. In addition, the drum guide 61 or the like may be disposed as a mechanism for discharging a sheet on which an image has been formed by the image forming apparatus 1 onto a discharge tray provided in the image forming apparatus 1 in an image forming system not including the post-processing apparatus 4. Further, the drum guide 61 or the like may be used for a mechanism for conveying a sheet in a field different from the image forming apparatus, for example, in the field of a sorting apparatus that sorts letters and envelops and loading the letters and envelops in distribution containers. To be noted, the rotation axis of the drum guide 61 or the like does not have to be directed in the horizontal direction, and for example, the drum guide 61 may be disposed in an orientation in which the rotation axis is directed in the vertical direction.

In the exemplary embodiments described above, the post-processing apparatus 4 directly connected to the image forming apparatus 1 has been described as an example of a sheet processing apparatus. However, the present technique is also applicable to a sheet processing apparatus that receives a sheet from the image forming apparatus 1 via an intermediate unit, for example, a relay conveyance unit attached to a discharge space of an image forming apparatus of an in-body discharge type. In addition, examples of the image forming system including a sheet processing apparatus and an image forming apparatus include a system in which modules having functions of the image forming apparatus 1 and the post-processing apparatus 4 are incorporated in a single casing.

In addition, the stapler 51 is an example of a processing unit that processes a sheet, and for example, the sheet bundle aligned on the intermediate supporting portion may be discharged onto the lower discharge tray 37 without being bound. In addition, the post-processing apparatus 4 of the exemplary embodiments described above is an example of a sheet conveyance apparatus that conveys a sheet, and the present technique is also applicable to sheet conveyance apparatuses different from sheet processing apparatuses that perform processing on a sheet, or a recording material, on which an image has been formed by an image forming apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2019-213639, filed on Nov. 26, 2019, and 2020-143775, filed on Aug. 27, 2020, which are hereby incorporated by reference herein in their entirety.

What is claimed is:

1. A sheet processing apparatus comprising:

a support on which a sheet is supported;

a conveyor configured to convey the sheet toward the support in a first direction in which a first end of the sheet is a leading end of the sheet;

a rotary guide provided above the support and including a first guide surface configured to guide a lower surface of the sheet conveyed by the conveyor and a second guide surface that is configured to face the support in a state in which the rotary guide is in a predetermined position, wherein in a case where the rotary guide is rotated in a state in which a second end of the sheet opposite to the first end is located above the first guide surface, the rotary guide is configured to move the second end of the sheet from above the first guide surface to a space that is formed between the second guide surface and the support in a state in which the rotary guide is in the predetermined position;

a processor configured to process the sheet supported on the support;

a discharger configured to discharge the sheet processed by the processor; and a moving assembly configured to move the sheet in a second direction in which the second end of the sheet becomes a leading end of the sheet, such that the sheet processed by the processor is moved from the support toward the discharger through the space between the second guide surface and the support;

wherein in a state where the rotary guide is in the predetermined position and before the moving assembly starts moving the sheet in the second direction, the second guide surface extends from a position upstream of the second end of the sheet in the second direction to a position downstream of the second end of the sheet in the second direction.

2. The sheet processing apparatus according to claim 1, wherein the second guide surface is provided with a plurality of ribs which are aligned in a rotation axis direction of the rotary guide, and configured to guide the sheet being moved by the moving assembly in the second direction.

3. The sheet processing apparatus according to claim 2, further comprising:

a conveyance path through which the sheet is conveyed from the space between the second guide surface and the support to the discharger.

4. The sheet processing apparatus according to claim 3, wherein the conveyance path includes an upper surface guide configured to face an upper surface of the sheet being moved by the moving assembly in the second direction, wherein the upper surface guide is located downstream of the rotary guide in the second direction, and wherein the plurality of ribs are projected below a gap between the rotary guide and the upper surface guide.

5. The sheet processing apparatus according to claim 4, wherein when viewed in the rotation axis direction of the rotary guide, a rotation trajectory of tips of the plurality of ribs when the rotary guide rotates overlap an upstream end of the upper surface guide in the second direction, and wherein the upstream end of the upper surface guide is provided with a recess that allows passage of the tips of the plurality of ribs when the rotary guide rotates.

6. The sheet processing apparatus according to claim 4, wherein when viewed in the rotation axis direction of the rotary guide in a state where the rotary guide is in the predetermined position, a downstream end of the second guide surface in the second direction is positioned downstream of an upstream end of the upper surface guide in the second direction.

7. The sheet processing apparatus according to claim 2, wherein the plurality of ribs project outward from the second guide surface in a radial direction with respect to the rotation axis of the rotary guide and extends along a rotation direction of the rotary guide.

8. The sheet processing apparatus according to claim 1, further comprising:

a controller configured to control the rotary guide and the moving assembly, the controller being configured to cause the rotary guide to rotate to the predetermined position before causing the moving assembly to start moving the sheet in the second direction.

9. The sheet processing apparatus according to claim 8, wherein the controller is configured to cause the rotary guide to start rotating after the second end of a preceding sheet has passed the conveyor, and to cause the rotary guide to rotate to the predetermined position before a succeeding sheet conveyed by the conveyor following the preceding sheet reaches the rotary guide.

10. The sheet processing apparatus according to claim 8, wherein in a case where a plurality of sheets are to be supported on the support, the controller is configured to cause the rotary guide to rotate once each time a second end of a sheet among the plurality of sheets passes the conveyor.

11. The sheet processing apparatus according to claim 1, further comprising:

a regulator against which the first end of the sheet is abutted and which is configured to regulate a position of the sheet supported on the support; and a second moving assembly configured to move the sheet supported on the support in the first direction and abut the first end of the sheet against the regulator.

12. The sheet processing apparatus according to claim 1, wherein the conveyor is a roller pair including a first roller and a second roller that form a nip portion and configured to nip and convey the sheet in the nip portion, and wherein the rotary guide is configured to rotate about an axis extending in a rotation axis direction of the first roller.

13. The sheet processing apparatus according to claim 1, wherein the second guide surface is formed in an arcuate shape centered on a rotation axis of the rotary guide as viewed in a rotation axis direction of the rotary guide.

14. The sheet processing apparatus according to claim 1, wherein the rotary guide includes a holding guide provided outside a region, where the sheet conveyed by the conveyor passes, in a rotation axis direction of the rotary guide, and configured to hold the first guide surface such that the first guide surface is rotatable about a rotation axis of the rotary guide, and wherein the holding guide includes a first recess recessed from a downstream side toward an upstream side in the first direction such that a sheet conveyance path formed by the first guide surface is exposed as viewed in the rotation axis direction of the rotary guide.

15. The sheet processing apparatus according to claim 14, wherein the conveyor is a roller pair including a first roller and a second roller that form a nip portion and configured to nip and convey the sheet in the nip portion, and wherein the first recess is defined such that the nip portion is exposed as viewed in the rotation axis direction of the rotary guide.

16. The sheet processing apparatus according to claim 14, wherein the holding guide includes a second recess recessed from the upstream side toward the downstream side in the first direction such that at least a part of the sheet conveyance path formed by the first guide surface is exposed as viewed in the rotation axis direction of the rotary guide.

17. The sheet processing apparatus according to claim 14, further comprising:

an aligning standard provided on a same side as the first recess in the rotation axis direction of the rotary guide and configured to serve as a standard for aligning the sheet supported on the support in the rotation axis direction of the rotary guide;

an aligner provided on an opposite side to the first recess in the rotation axis direction of the rotary guide and configured to press the sheet supported on the support in the rotation axis direction of the rotary guide to bring the sheet into contact with the aligning standard to align the sheet; and a controller configured to control the rotary guide and the aligner, wherein, after the second end of the sheet has passed the conveyor and before a rotation of the rotary guide is finished, the controller is configured to start movement of the aligner for aligning the sheet.

18. The sheet processing apparatus according to claim 1, wherein the rotary guide includes a holding guide provided on a first side in a rotation axis direction of the rotary guide with respect to a region where the sheet conveyed by the conveyor passes and configured to hold the first guide surface such that the first guide surface is rotatable about a rotation axis of the rotary guide, and wherein a sheet conveyance path formed by the first guide surface is open toward a second side opposite to the first side in the rotation axis direction of the rotary guide.

19. The sheet processing apparatus according to claim 18, further comprising:

an aligning standard provided on an opposite side to the holding guide in the rotation axis direction of the rotary guide and configured to serve as a standard for aligning the sheet supported on the support in the rotation axis direction of the rotary guide;

an aligner provided on a same side as the holding guide in the rotation axis direction of the rotary guide and configured to press the sheet supported on the support in the rotation axis direction of the rotary guide to bring the sheet into contact with the aligning standard to align the sheet; and a controller configured to control the rotary guide and the aligner, wherein, after the second end of the sheet has passed the conveyor and before a rotation of the rotary guide is finished, the controller is configured to start movement of the aligner for aligning the sheet.

20. The sheet processing apparatus according to claim 1, further comprising:

an aligning standard provided on a first side in a rotation axis direction of the rotary guide and configured to be a standard for aligning the sheet supported on the support in the rotation axis direction of the rotary guide;

an aligner provided on a second side opposite to the first side in the rotation axis direction of the rotary guide and configured to push the sheet toward the aligning standard to align the sheet.

21. An image forming system comprising:

an image forming apparatus configured to form an image on a sheet; and the sheet processing apparatus according to claim 1 configured to process the sheet on which the image has been formed by the image forming apparatus.

22. A sheet processing apparatus comprising:

a support on which a sheet is supported;

a conveyor configured to convey the sheet toward the support;

a rotary guide provided above the support and including a first guide surface configured to guide a lower surface of the sheet conveyed by the conveyor and a second guide surface that is configured to face the support in a state in which the rotary guide is in a predetermined position, wherein in a case where the rotary guide is rotated in a state in which a trailing end of the sheet is located above the first guide surface, the rotary guide is configured to move the trailing end of the sheet from above the first guide surface to a space that is formed between the second guide surface and the support in a state in which the rotary guide is in the predetermined position;

a processor configured to process the sheet supported on the support;

a discharger configured to discharge the sheet processed by the processor; and a moving assembly configured to move the sheet in a discharge direction, such that the sheet processed by the processor is moved from the support toward the discharger through the space between the second guide surface and the support, wherein in a state where the rotary guide is in the predetermined position and before the moving assembly starts moving the sheet in the discharge direction, the second guide surface extends from a position upstream of a trailing end of the sheet in the discharge direction to a position downstream of the trailing end of the sheet in the discharge direction.

* * * * *